US010736384B2

(12) United States Patent
Baker

(10) Patent No.: US 10,736,384 B2
(45) Date of Patent: Aug. 11, 2020

(54) TENSION RELEASE FASTENER

(71) Applicant: DURAFLEX HONG KONG LTD., Sheung Wan (HK)

(72) Inventor: Scott George Baker, Denver, CO (US)

(73) Assignee: Duraflex Hong Kong Ltd., Hong Kong (HK)

( * ) Notice: Subject to any disclaimer, the term of this patent is extended or adjusted under 35 U.S.C. 154(b) by 0 days.

(21) Appl. No.: 15/709,357

(22) Filed: Sep. 19, 2017

(65) Prior Publication Data

US 2018/0078004 A1 Mar. 22, 2018

Related U.S. Application Data

(60) Provisional application No. 62/460,607, filed on Feb. 17, 2017, provisional application No. 62/396,230, filed on Sep. 19, 2016.

(51) Int. Cl.
*A44B 11/25* (2006.01)

(52) U.S. Cl.
CPC ..... *A44B 11/2592* (2013.01); *A44B 11/2584* (2013.01); *A44B 11/25* (2013.01)

(58) Field of Classification Search
CPC .. A44B 11/25; A44B 11/2584; A44B 11/2592
See application file for complete search history.

(56) References Cited

U.S. PATENT DOCUMENTS 5,144,725 A 9/1992 Krauss
5,311,649 A 5/1994 Suh
5,355,562 A 10/1994 Matoba et al.
5,443,039 A 8/1995 Suchowski et al.
D363,690 S 10/1995 Gallon et al.
5,522,619 A * 6/1996 Collins ..... A44B 11/2503 24/633
5,794,316 A 8/1998 Anscher
5,845,376 A 12/1998 Tung
5,991,985 A 11/1999 Galbreath et al.
D424,474 S 5/2000 Gregory et al.
D514,021 S 1/2006 Chang
7,350,277 B1 4/2008 Canfield et al.
D618,590 S 6/2010 Paik
8,108,976 B2 * 2/2012 Thorbole ..... A44B 11/2511 24/650
8,312,602 B2 11/2012 Paik
D684,088 S 6/2013 Fukazawa
D686,528 S 7/2013 Paik et al.
(Continued)

OTHER PUBLICATIONS

International Search Report and Written Opinion dated Nov. 30, 2017 in connection with International Patent Application No. PCT/US2017/052325 (16 pages).

*Primary Examiner* — Victor D Batson
*Assistant Examiner* — David M Upchurch
(74) *Attorney, Agent, or Firm* — Dorsey & Whitney LLP

(57) ABSTRACT

A counter release buckle is provided herein. More particularly, a counter release buckle disengages in a direction opposite the direction that the buckle member is tensioned in. The counter release buckle releases each of the buckle members in the opposite direction of tension that is or would be placed on the buckle member. The buckle also engages the opposing buckle portions by moving them in the direction that the tension is or would be pulling on the respective buckle member.

29 Claims, 41 Drawing Sheets

(56) References Cited

U.S. PATENT DOCUMENTS

| | | | |
|---|---|---|---|
| D705,122 | S | 5/2014 | Nykoluk |
| D710,249 | S | 8/2014 | Nilsen et al. |
| D711,775 | S | 8/2014 | Paik et al. |
| D711,776 | S | 8/2014 | Iannello et al. |
| 8,813,317 | B2 | 8/2014 | Mitchell et al. |
| 8,935,833 | B2 | 1/2015 | Kaneko |
| D724,994 | S | 3/2015 | Paik et al. |
| D739,974 | S | 9/2015 | Kelleghan |
| D773,339 | S | 12/2016 | Mcclure et al. |
| D801,221 | S | 10/2017 | Paik et al. |
| 2006/0168770 | A1 | 8/2006 | Takahashi et al. |
| 2006/0174459 | A1 | 8/2006 | Bledsoe et al. |
| 2015/0135482 | A1 | 5/2015 | Kuo |
| 2016/0198807 | A1 | 7/2016 | Lin |

* cited by examiner

TENSION RELEASE FASTENER

CROSS-REFERENCE TO RELATED APPLICATIONS

The present application claims priority to U.S. Provisional Patent App. No. 62/396,230, filed Sep. 19, 2016, entitled "Rear Release Buckle," and U.S. Provisional Patent App. No. 62/460,607, filed Feb. 17, 2017, entitled "Tension Release Fastener," which are both incorporated herein by reference in its entirety.

TECHNICAL FIELD

A fastener, more particularly, a buckle that connects into an engaged position in the same direction as the buckle is tensioned by the respective anchor on the opposing portion of the buckle.

BACKGROUND

Traditional buckles are side release buckles such as the one shown in U.S. Pat. No. 5,794,316. In these buckles, two buckle portions engage one another by pulling the buckles toward one another to engage while the opposing portions of the article that the buckles are attached to are simultaneously pulled toward one another, frequently placing the opposing portions of the article in tension allowing the buckle to form a closure by maintaining this tension. In some instances, the article is not placed in tension during the buckling, but when or if the tension is applied it is in the same direction in which the opposing portions of the side release buckle would disengage from one another. Thus, side release buckles have a natural tendency to pull apart due to the tension in the article they hold together. Once clipped together, the two pieces can spontaneously pull apart if enough pressure is applied. Complicated locking solutions have been provided, such as in U.S. Pat. No. 5,794,316, but such solutions add cost and complexity to the device.

Additionally, many side release buckles require two-handed operation in order to easily align and clip together the male and female portions of the buckle. While some buckle designs enable one-handed operation and secure attachment, these solutions can be mechanically complex, such as U.S. Pat. No. 8,813,317, requiring more labor intensive manufacturing processes, costs, and unnecessary complexities.

SUMMARY

In accordance with various embodiments, a buckle system is disclosed that is configured to be attached to an article that places the buckle in tension when connected. The buckle may include a first engagement member configured to be tensioned in a first direction. The buckle may include a second engagement member configured to be tensioned in a second direction. The first engagement member may be received into the second engagement member on a side of the second engagement member opposite the first direction. The first engagement member and the second engagement member may be engaged with one another such that as a tension force is placed on the buckle, the first engagement member is more firmly seated in engagement with the second engagement member.

In accordance with various embodiments, the first engagement member is a plug member and the second engagement member is a receiving member that receives the plug member into a receiving channel. The receiving member and the plug member may be secured to one another by a detent structure allowing petition by more than just tension. The receiving member may include an end stop portion that prevents the plug member from being pulled in the direction of tension through the receiving member. The receiving channel may be defined by a top plate, a base plate and an end stop portion configured to substantially constrain the plug member to linear travel within the receiving member. The receiving channel may include a first side and a second side that are sufficiently separated from one another allowing for a portion of the plug member to extend out of the receiving channel when the plug member and the receiving member are latched or being latched. The plug member may include a body portion in part defining a ring portion to engage and pull in first tensioning direction. The receiving channel may include opposing walls defining a mouth that is narrower than the width of the ring in a relaxed state and wider than the width of the ring portion when the ring is in a tensioned state. The first plug member may include a connection portion on a rear side. The receiving member may include a connection portion on a bottom side below a base plate. The first engagement member connection portion may be a trestle configured to engage a strap.

In accordance with various embodiments, the receiving channel may include a first side and a second side having a separation, wherein a portion of the plug member's first connection portion extends through the separation between. The receiving member may include a base plate that is stepped on lateral sides thereof with a upper portion of the stepped lateral sides forming a portion of the receiving channel and a lower portion of the stepped lateral sides forming a sliding surface for the plug connection portion. The receiving member base plate may connect the separate sides of the receiving channel.

In accordance with various embodiments, the buckle may also include a locking mechanism that prevents or limits the plug member from being removed from the receiving member without user interaction. The locking mechanism may be a tab that extends at an angle in the first direction from a base plate on the receiving member and may have an end surface that is configured to contact a vertical wall of the plug member when the plug member and the receiving member are engaged. The tab may be resiliently movable such that a finger can press on the tab in order to move the tab below the path of the plug member allowing the plug member to slide clear of the receiving member. The receiving member may be more flexible than the plug member. The plug member may include protrusions extending out of lateral sides thereof and the receiving channel includes notches on the internal surfaces of the side walls, wherein the notches are suitable to receive the protrusions.

The side walls of the receiving member may be configured to flexibly separate from one another allowing the protrusions and the notches to engage or disengage securing the plug member and the receiving member together. The plug member may include a body portion that extends from a connection portion, the body portion comprising laterally flexible cantilevered arms. The cantilevered arms have protrusions extending laterally from each. In accordance with various embodiments, a cord may be connected between the cantilevered arms in a configuration such that as the cord is pulled the arms collapse toward one another.

In accordance with various embodiments, a method for connecting a buckle is provided such that the buckle is placed in longitudinal tensioning. A first engagement member having a front side, a rear portion, and a first connection portion that is suitable to anchor the buckle is provided. A second engagement member having a front side, a rear portion, and a second connection portion that is suitable to anchor the second engagement member is provided. The first engagement member front side and the second engagement member front side are pulled toward each other and past each other defining a tensioning direction opposite the direction that the first engagement member is pulled. The first engagement member rear portion is received into the second engagement member back side. The first engagement member is moved opposite the tensioning direction or the second engagement member is moved opposite the tensioning direction once the first engagement member has at least been received in the rear portion of the second engagement member until the first engagement member is fully engaged with the second engagement member thereby latching the buckle.

BRIEF DESCRIPTION OF THE DRAWINGS

The disclosure herein will become more fully apparent from the following appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

Figure 1A:
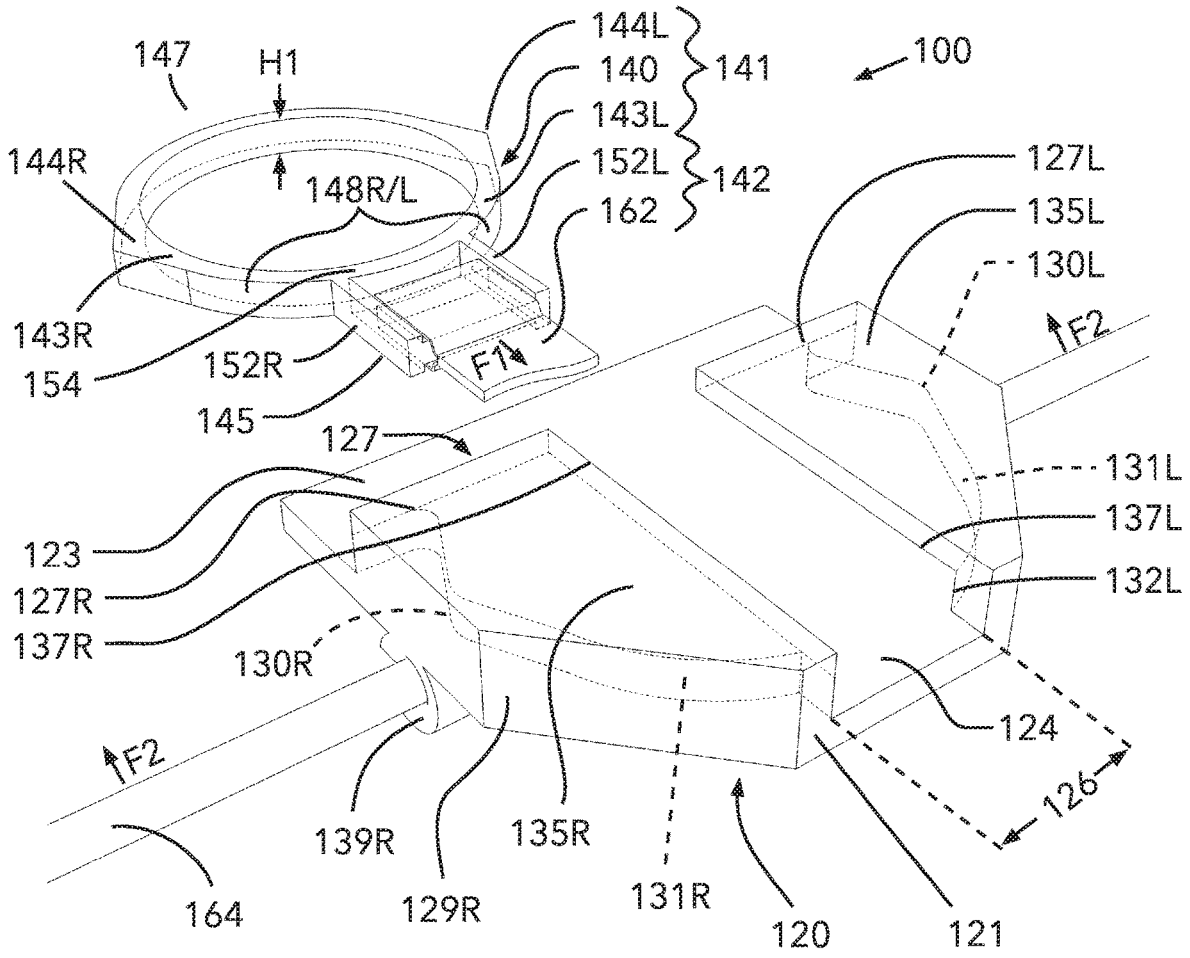
FIG. 1A is a perspective view of an unconnected buckle in accordance with an embodiment.
Figure 1B:
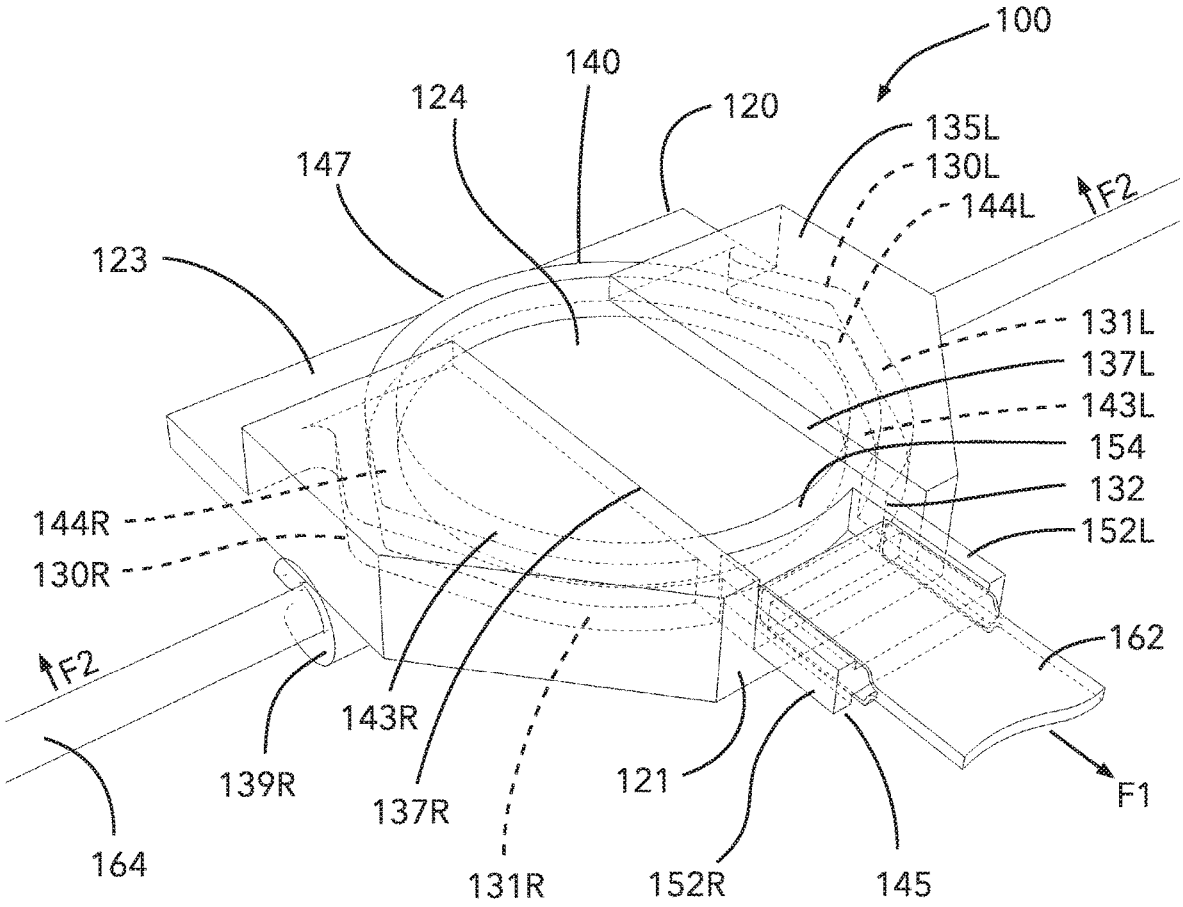
FIG. 1B is a perspective view of a connected buckle in accordance with the embodiment of FIG. 1A.
Figure 1C:
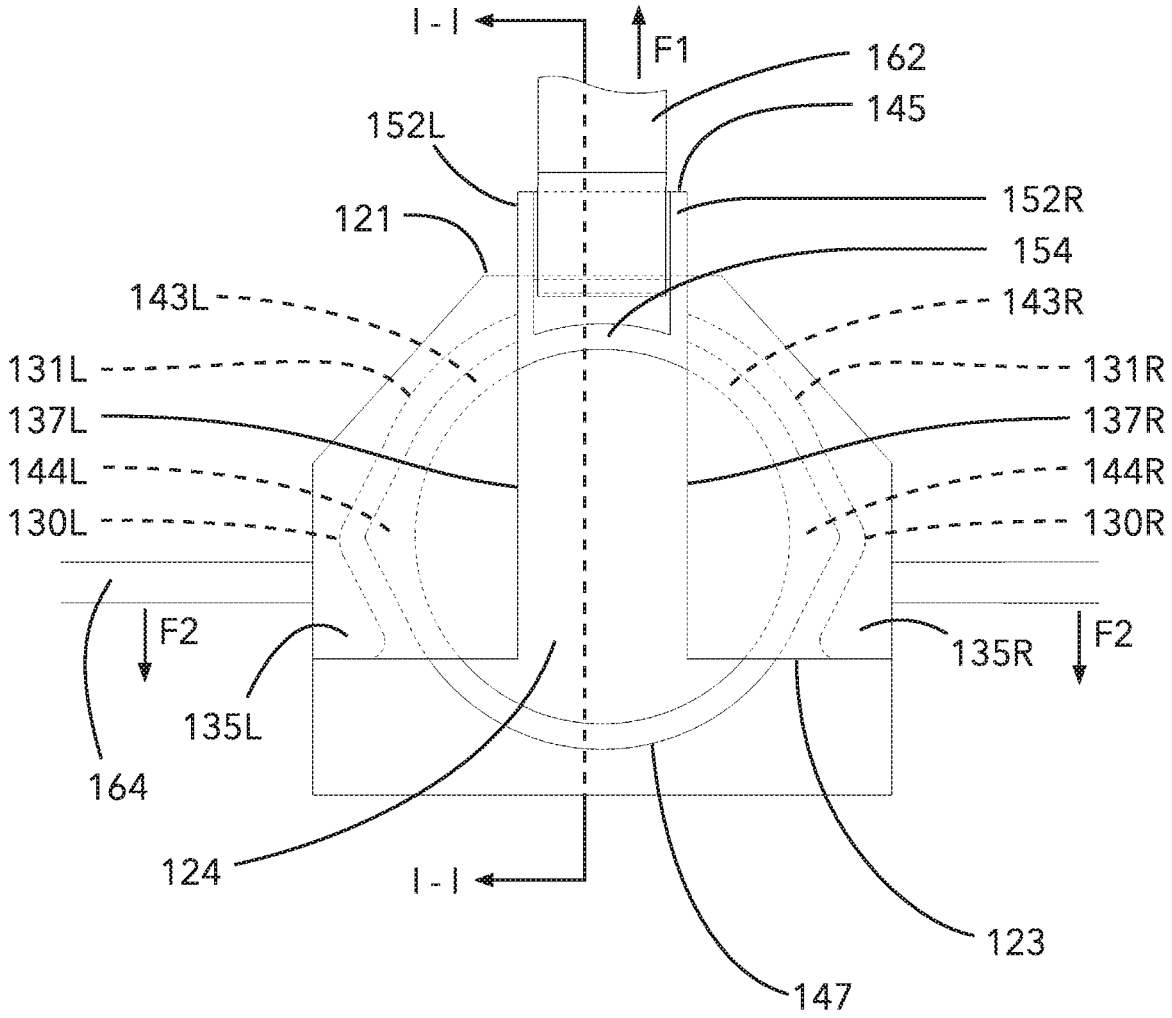
FIG. 1C is a top view of a connected buckle in accordance with the embodiment of FIG. 1A.
Figure 1D:
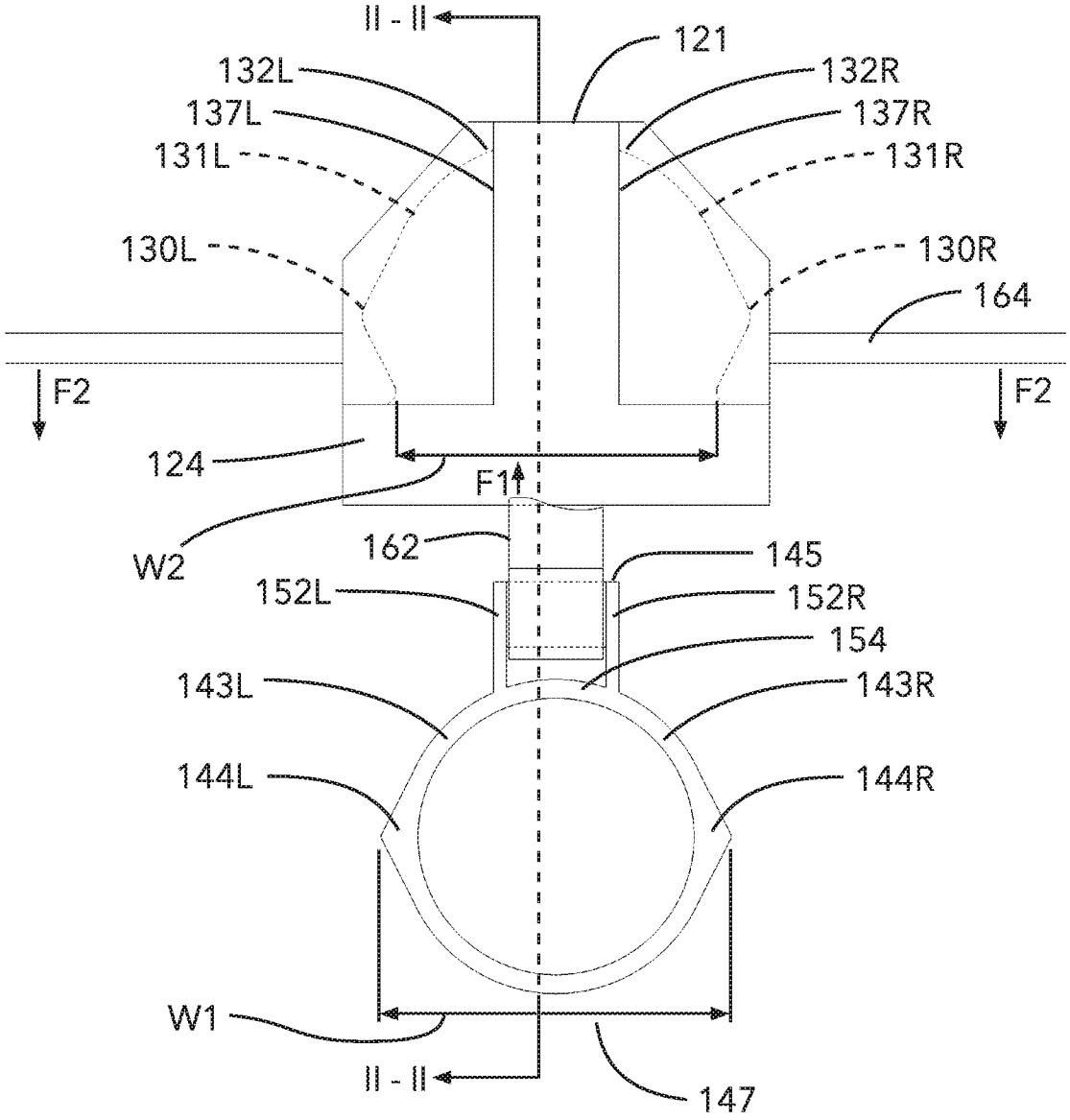
FIG. 1D is a top view of an unconnected buckle in accordance with the embodiment of FIG. 1A.

all arranged in accordance with at least some embodiments of the present disclosure.

DETAILED DESCRIPTION

In response to issues present in the field of fasteners, a tension release fastener, also referred to as a buckle, is provided herein. More particularly, a counter release buckle engages and disengages in a direction opposite traditional buckles. For example, a counter release buckle releases each of the buckle members in the opposite direction of tension that is or would be placed on the buckle member. The buckle also engages the opposing buckle portions by moving them in the direction that the tension is or would be pulling on the respective buckle member. Such a design is an improvement on side release buckles and similar clasps, fasteners and similar mechanisms, as the buckle engages and disengages in the opposite directions as the side release buckles, thus eliminating the natural tendency for the buckles to pull apart when under tension.

The various tension release fastener and embodiments thereof disclosed herein relate generally to buckles, clasps, or other fasteners that are capable of connecting various articles such as straps, webbing, harnesses, collars, and belts to one another, or portions of bags, lids, containers or other similar articles closed. The various fasteners can also be used to connect any two articles together, such as a purse closure or watch or bracelet clasp, or to mount lights, cameras, or other electronics to a secure position. Furthermore, due to the mechanical simplicity of the various buckles disclosed herein, the buckles can be used by automated systems, such as unmanned aerial vehicles (drones), autonomous vehicles, automated production lines or other automated systems to securely attach to and disengage from any item. A person of ordinary skill in the art would appreciate other applications of the buckles disclosed herein. The fasteners can be connected by decreasing the tension pulling on the fastener by the various connections thereto and released by increasing tension on the various connections to the fasteners.

In accordance with various embodiments discussed in more detail herein, the fasteners include two or more pieces. While in some examples the fasteners may include merely two opposing pieces, the device may also include additional components or the two opposing pieces may include subcomponents. Generally, the buckle may include two or more components that work in concert with one another to form a disengageable connection for closing, connecting, or fastening various articles. While a buckle may be a single embodiments of the fasteners as generally described herein, the buckle will be used throughout to describe the various features, elements, and structures of the tension release fastener.

FIGS. 1A-1F show an embodiment of a buckle 100 having opposing engagement members 120, 140. The opposing engagement members 120, 140 are configured to place various forces on one another. Each of the opposing engagement members 120, 140 also includes a connection portion. For example, engagement member 120 includes a connection portion 139R and 139L. Engagement member 140 includes connection portion 142. The connection portions include structures suitable to exert forces on the buckle 100. For example, the buckle 100 may be placed in tension between the respective connection portions of engagement member 120 and engagement member 140.

The connection portions (e.g. 142 or 139L/R) can be positioned on the respective engagement member 120, 140 in any position suitable to allow the buckle 100 to exert the desired closing functionality on the article. For example, engagement member 140 includes the connection portion 142 on an end 145. The portion of the article 162 connecting to the connection portion 142 is configured to exert a reactive force F1 on the engagement member 140. In embodiments in which the portion of the article 162 is a strap as shown in FIGS. 1A-1F, the force F1 is merely a tensile force. For purposes of orientation and description of the buckle 100 herein, the furthermost side of the engagement member 140 in the direction of force F1 is designated as the rear portion or end 145. The furthermost side of the engagement member 140 opposite the direction of force F1 is the front portion or end 147. It should be understood, however, that regardless of the direction of force F1, the connection portion 142 may be located along any portion of the engagement member 140 including the front, middle, or rear portion. But, by way of example, the connection portion 142 is shown on the rear portion 145 of engagement member 140 in each of FIGS. 1A-1F.

In another example, engagement member 120 includes the connection portion 139L/R. The portion of the article 164 connecting to the connection portion 139L/R is configured to exert a reactive force F2 on the engagement member 120. In contrast to the example described above, the portion of the article 164 is not illustrated as strap but is instead illustrated as piping that is frequently formed between seams on various articles such as bags and backpacks. While the portion of article 164 may be the same as the portion of the article 162 in some embodiments, in other embodiments they may be different. As shown in FIGS. 1A-1F, due to the structure of the portion of the article 164 illustrated (e.g. piping), the force F2 can be a tensile force or a compressive force. Thus, F2 can resist any force applied on the connection portion 139R/L. As illustrated in FIGS. 1A-1F, F2 is shown as a tensile force that would be applied to the connection portion in response to the buckle 100 being placed in tension. For purposes of orientation and description of the buckle 100 herein, the furthermost side of the engagement member 120 in the direction of force F2 is designated as the rear portion or end 123. The furthermost side of the engagement member 120 opposite the direction of force F2 is the front portion or end 121. It should be understood, however, that regardless of the direction of force F2, the connection portion 139L/R may be located along any portion of the engagement member 140 including the front, middle, or rear portion. But, by way of example, the connection portion 139L/R is shown between the front and rear portions of engagement member 120 in each of FIGS. 1A-1F.

In accordance with various embodiments, the buckle 100 is configured such that the engagement member 120 and the engagement member 140 engage with one another along their rear portions. To further clarify, the buckle 100 is configured to be placed in tension by tensile forces F1 and F2 and the engagement member 120 and the engagement member 140 engage with one another in the direction of these forces and disengage with one another in the opposite direction as these forces. Thus, in response to the buckle 100 being placed in tension, the engagement member 120 and the engagement member 140 have a tendency to be pulled into engagement as opposed to being pulled apart. In order to separate the engagement member 120 and the engagement member 140, tensile forces F1 and F2 must be overcome to create the separation.

The engagement member 120 and the engagement member 140 may have any of a variety of forms. They may have the same or similar structure as one another, or they may be significantly different. As illustrated in FIGS. 1A-1F, engagement member 120 may be a receiving member and engagement member 140 may be a plug member. The receiving member 120 may be suitable to receive the plug member 140 therein. The receiving member 120 can be structurally similar to a female portion of a connection mechanism. The receiving member 120 forms a holster for the corresponding male member (e.g. plug member 140). The connecting of the two parts occurs by pulling the male plug member into the female holster member from the back edge of the female holster member. (Typical side release buckles connect through the front of the female member, i.e. against the tensile force.) Likewise, the releasing of the buckle occurs by sliding the plug member out of the back of the receiving member.

In accordance with various embodiments, the receiving member 120 includes a receiving channel 127 along the rear portion suitable to engage and receive the plug member 140 therein. Accordingly, the connection portion 142 may extend toward or out of the front portion 121 of the receiving member 120 such that article portion 162 can extend from the front portion 121 of the receiving member in the direction of F1 and apply a force in that direction.

The receiving channel 127 may include a base plate 124, one or more walls (e.g. 129L/R), and a top plate (e.g. 135 L/R). The receiving channel 127 may be formed between the base plate 124 and the top plate (e.g. 135 L/R). The walls may connect the base plate 124 and the top plate (e.g. 135 L/R) and/or provide lateral guidance for the plug 140 into the receiving channel 127.

The receiving member 120 may also include an alignment channel 126. The alignment channel 126 may be structured to form a path to guide the plug 140 along the receiving member 120 until the two are engaged. Examples of a straight path are shown, but other paths could also be included. In accordance with one embodiment, the alignment channel 126 may be defined by a separation in the receiving channel 127 forming separate sides of the receiving channel. For example, one side of the receiving channel 127 may include a base plate 124, a wall 129R and a top plate 135R. This side of the receiving channel 127 is formed between the base plate 124 and the top plate 135R. The wall 129R connects the base plate 124 and the top plate 135R. An opposing structure also can be provided. For example, the other side of the receiving channel 127 may include a base plate 124, a wall 129L and a top plate 135L. This side of the receiving channel 127 is formed between the base plate 124 and the top plate 135L. The wall 129L connects the base plate 124 and the top plate 135L. Accordingly, the base plate 124 connects the separate walls 129R and 129L, the space between the top plates 135R and 135L defines the alignment channel 126, and the space between the top plates and the base plate defines the receiving channel.

The plug member 140 may include one or more features that engage with one or more features of the receiving member 120. For example, the body portion 141 may be sized and shaped to be securely received within the receiving channel 127. In another example, the connection portion 142 may be sized and shaped to be securely guided by the alignment channel.

In accordance with one embodiment, the connection portion 142 is a truss having two side plates 152R and 152L with one or more bars extending there between. The side plates 152R and 152L may be attached to the rear portion 145 of the plug member 140. The side plates 152R and 152L may also be spaced apart such that they are about the same width as the alignment channel 126 but sufficiently smaller to still be able to slide easily within the alignment channel 126. The bars extending between the side plates 152R and 152L may be connected to the article portion 162. In a particular example, the article portion 162 is a strap that extends to the larger article (e.g. a bag). The body portion may have a height H1 that is approximately the same as the height H2 between the base plate 124 and the top plate (e.g. 135R/L) but still be sufficiently smaller to slide between the base plate 124 and the top plate (e.g. 135R/L).

In accordance with various embodiments, the engagement between the plug member 140 and the receiving member 120 may include a securing mechanism to limit separation. The securing mechanism can include detents, latches, locks, pins or any other mechanism that can limit or prevent separation of the plug member 140 and the receiving member 120. For example, as shown in FIGS. 1A-1F, a detent can securely engage the plug member 140 and the receiving member 120. In such an example, one or more portions of the plug member 140 may be flexible and one or more portions of the receiving member 120 may be sufficiently rigid so that when the two members are engaged, the plug member 140 flexes to accomplish the engagement but then retains its original shape or a close approximation of its original shape in order to hold the engagement. For example, the body portion 141 of the plug member may include one or more flexible arms (e.g. 143 L/R). The arms can collapse toward one another such that the width of the body portion 141 is narrowed by the collapse. The widest point of the arms (e.g. 144L/R) may be narrowed by the collapse. In some embodiments, the body portion 141 may be a ring-shaped portion with the arms (e.g. 143 L/R) extending from the connection portion 142 to the widest point (e.g. 144L/R). In such embodiments, the widest points may have an abrupt bend such that the ring is not circular but instead includes elbows (e.g. 144L/R) at the widest points. The elbows (e.g. 144L/R) may be configured to engage in corresponding features within the receiving channel 127. By pulling on the ring portion of the body portion 141 and placing the plug 140 in tension with the portion of the article 162, the ring can elongate causing the distance between the elbows (e.g. 144L/R) to narrow.

In accordance with various embodiments, the receiving member 120 may include a feature that corresponds to and receives the elbows (e.g. 144L/R). For example, the receiving channel 127 may have a narrower mouth having a width W2 that widens along its length. Thus, as the plug is pulled/pushed into the receiving channel the narrower mouth 127A having width W2 flexes the body portion of the plug causing the elbows (e.g. 144L/R) to narrow the width W1 and slide between the narrower mouth portions 127R/L of the channel 127. Width W2 of the mouth is less than the relaxed Width W1 of the plug member. When the plug member is tensioned or compressed, its width W1 decreases to less than W2. Once past the narrower mouth portion 127R/L, the channel widens to an engagement portion 130R/L allowing the body portion 141 of the plug 140 to relax and flex back toward its original shape. The engagement portion 130R/L receives the elbows (e.g. 144L/R), therein securely engaging the plug 140 within the receiving member 120. In this manner, the interior surfaces 131L/R of the receiving channel 127 have a varying profile along the longitudinal length from the rear portion of the receiving member to the front portion of the receiving member. At the mouth 127R/L to the receiving channel 127, the surfaces 131L and 131R may be in close proximities to one another but still sufficiently separated to allow the body portion of the plug 140 through while flexed. The surfaces 131L and 131R then separate as they extend toward the front of the receiving member 120 until they are at their widest at the engagement portions 130R/L. After the engagement portions 130R/L, the surfaces 131L and 131R narrow again as they extend toward the front portion of the receiving member 120. The surfaces may narrow sufficiently such that they form an end stop portion (e.g. 132R/L) that limits or prevents the plug from pulling through the receiving channel 127 or alignment channel 126. The end stop portion (e.g. 132R/L) may engage with forward surfaces 148R/L of the body portion 141 of the plug 140. In various embodiments, the end stop portion may be a fixed stop. The forward surfaces may be sufficiently transverse to the path of the plug 140 through the receiving member 120 that there is insufficient tendency to collapse the body portion of the plug 140. The end stop portion (e.g. 132R/L) may be located at the front portion 121 of the receiving member 120. Here, the alignment channel separates walls that connect the base plate 124 from the top plate 135R/L. The narrowest portion of these vertical walls may be perpendicular to the path of the connection portion 142 of the plug 140 through the receiving member 120. This narrowest portion may define the end stop portion. An end stop portion 132R and 132L, respectively on each side of the receiving channel, may contact the forward surfaces 148R/L of the body portion 141 of the plug 140 thereby limiting or preventing any additional movement of the plug through the receiving member 120.

In accordance with various embodiments, the receiving member 120 includes the connection portion (e.g. 138R/L). While in some embodiments the connection portion may be contagious across the receiving member 120, the example shown in FIGS. 1A-1F corresponds to separate connection portions 138R and 138L that respectively align with separate sides of the receiving channel 127 shown in the same example. It is understood that other configurations are contemplated herein. The separate connection portions 138R and 138L extend from the base plate 124 of the receiving member 120. The connection portions 138R and 138L can be attached to a strap, webbing, or any structural member or extension from an article using a variety of methods. As shown in the examples in FIGS. 1A-1F, the connection portions 138R and 138L are attached to piping.

Figure 1E:
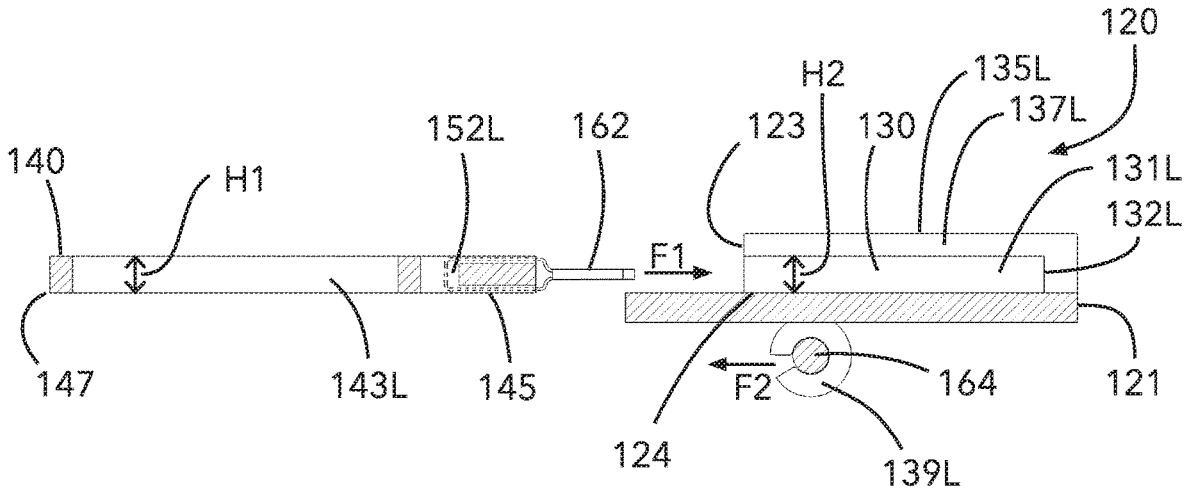
FIG. 1E is a side cross-sectional view of an unconnected buckle viewed along cross-section II-II shown in FIG. 1D and in accordance with the embodiment of FIG. 1A.
Figure 1F:
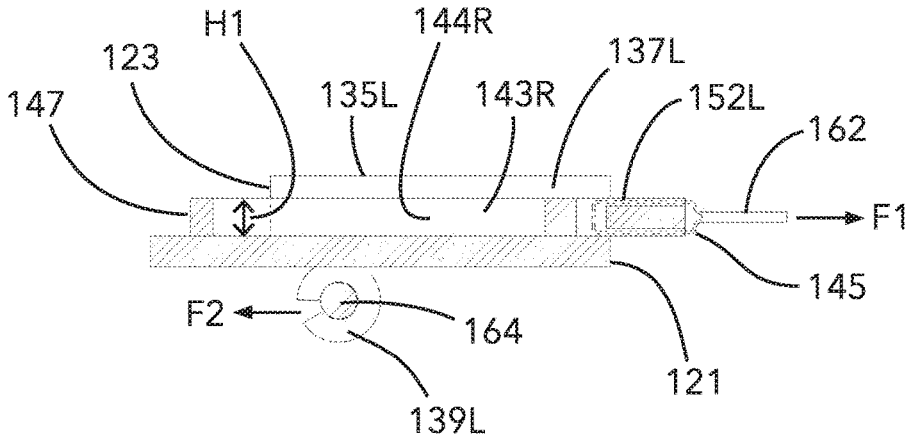
FIG. 1F is a side cross-sectional view of a connected buckle viewed along cross-section I-I shown in FIG. 1C and in accordance with the embodiment of FIG. 1A.

In accordance with various embodiments, the article portion 162 and the article portion 164 may be a part of the same article or different articles. In either arrangement, the engageable and disengageable connection between the article portions 162 and 164 may be adapted to one another. The plug member 140 is attached to article portion 162 and the receiving portion is attached to article 164. The article portions 162 and 164 may have a tendency to pull away from one another. In some embodiments, the article portions 162 and 164 might not be under actual tension but there may be a reason to place the article portions 162 and 164 under tension in order close an opening, take up slack, or perform a similar function. As shown in FIGS. 1E and 1F, the plug member 140 is pulled toward the receiving member 120 and then around the receiving member 120 such that the article portion 162 does or would have a tendency to pull the plug member 140 back toward the receiving member 120 if the article portion 162 was placed in tension. To perform the clipping action, the body portion 141 of the plug 140 is set on the base plate of the holster with the connection portion 142 in the alignment channel 126 of the receiving member 120. Subsequently, the connection portion 142 is pulled, or the strap is pulled toward the receiving member 120 (specifically the rear portion 123) to seat the plug member 140 in the receiving member 120. By providing sufficient force to deform the plug member 140 so that the body portion can enter the mouth of the receiving channel 127 the detent is set, thus clipping the two members together. To separate the plug 140 from the receiving member 120, pressure is applied on the body portion 141 of the plug member 140 opposite the connection portion 142 and in a direction away from the connection portion 142.

Figure 2A:
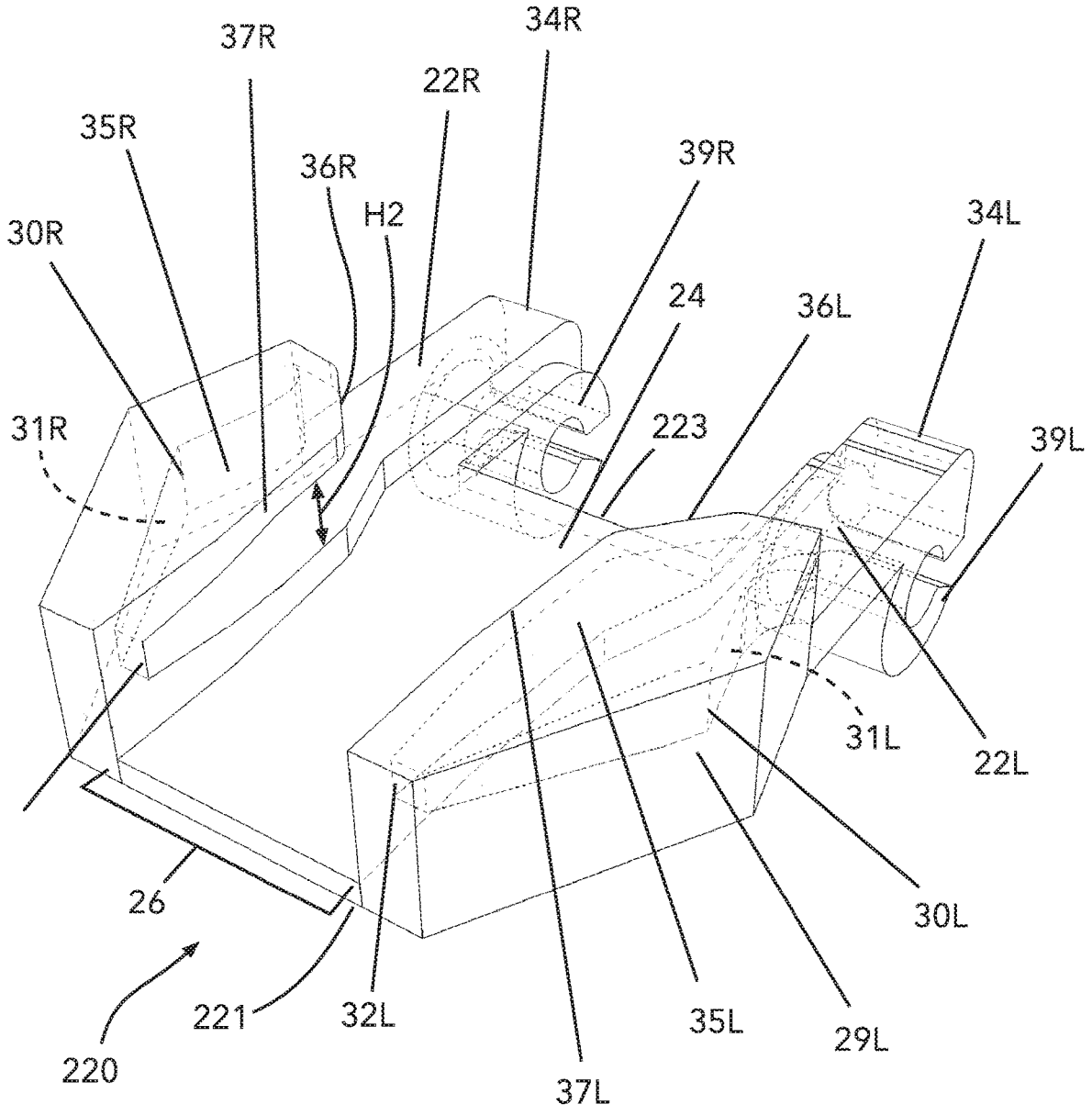
FIG. 2A is a perspective view of a connector member in accordance with an embodiment.
Figure 2B:
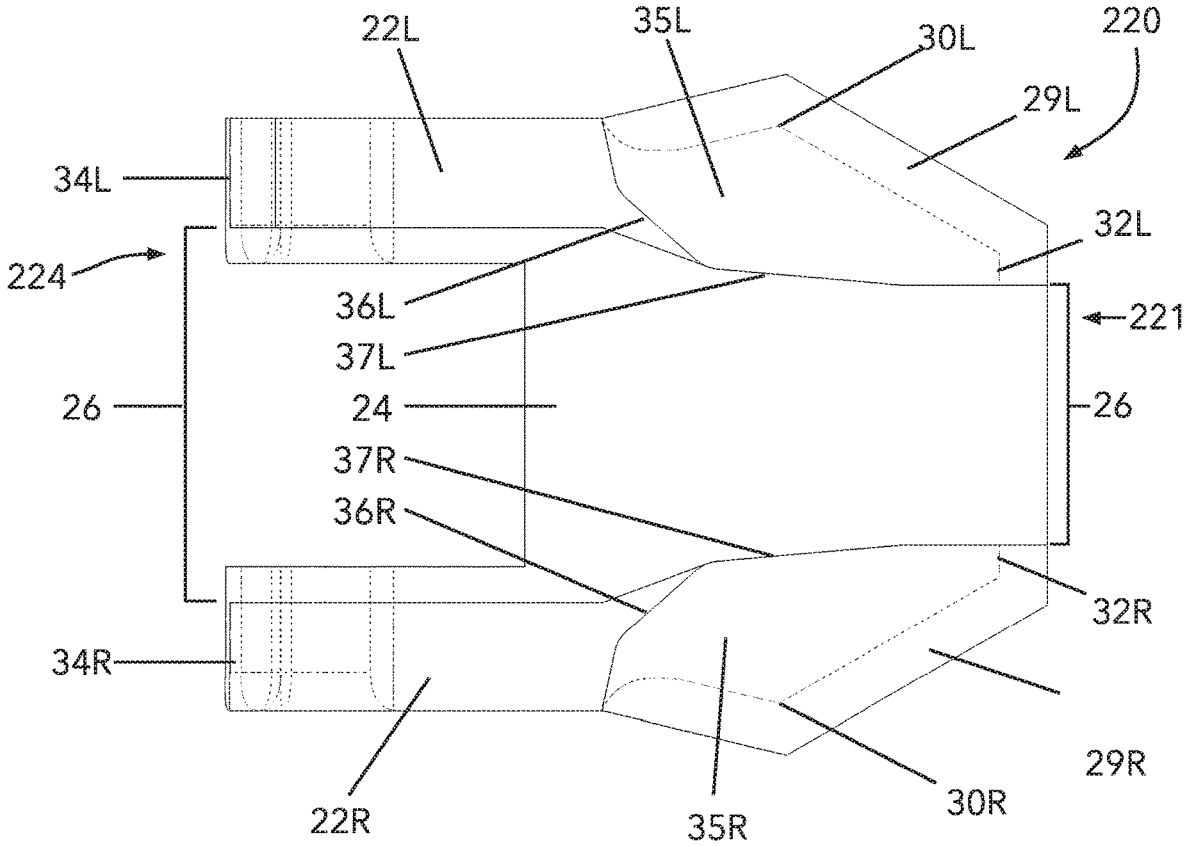
FIG. 2B is a top view of the connector member of FIG. 2A.
Figure 2C:
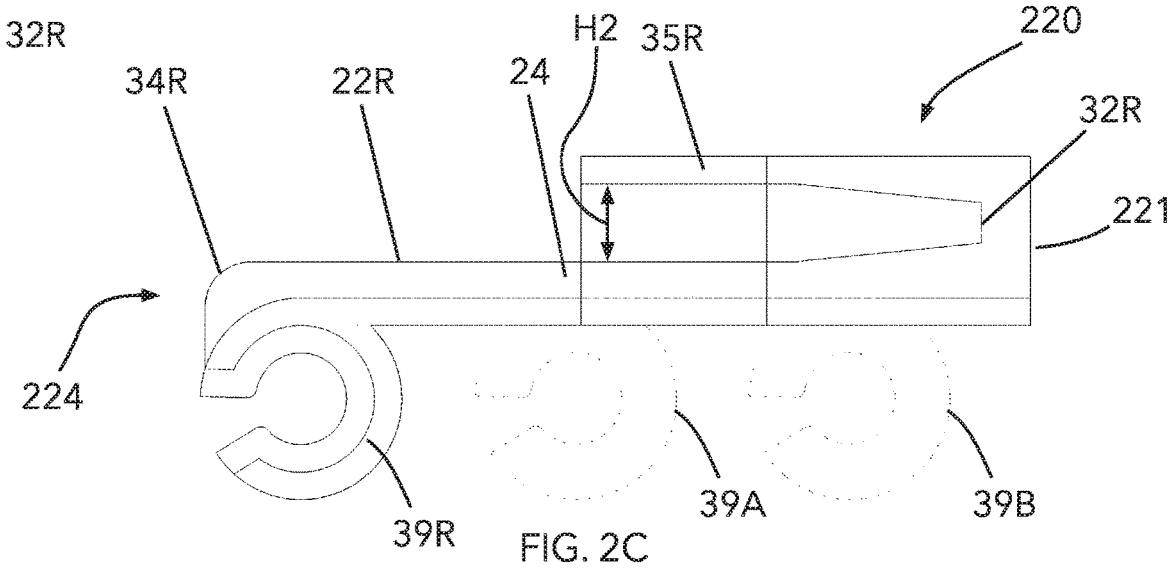
FIG. 2C is a side view of the connector member of FIG. 2A.
Figure 2D:
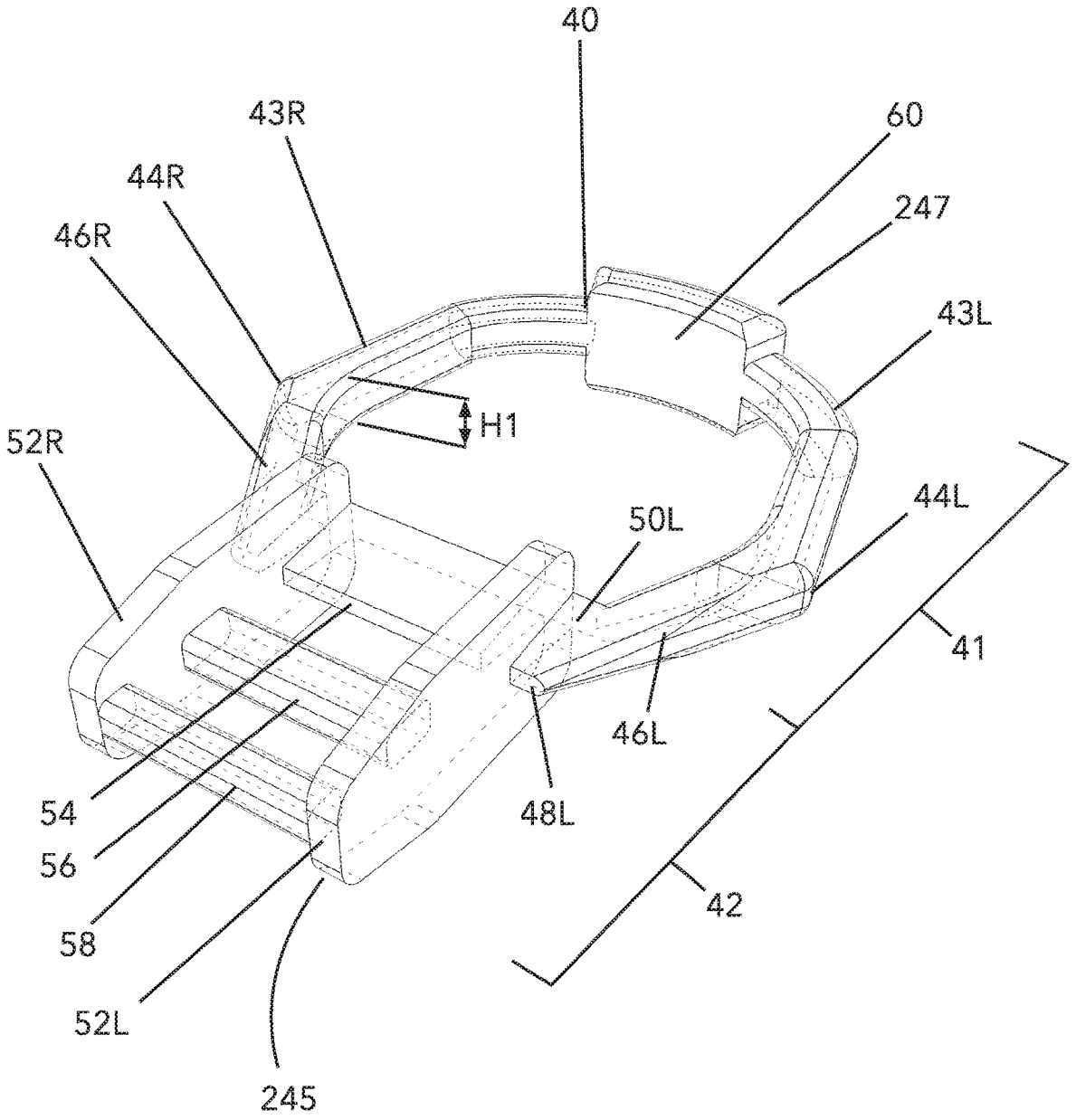
FIG. 2D is a perspective view of a connector member in accordance with an embodiment.
Figure 2E:
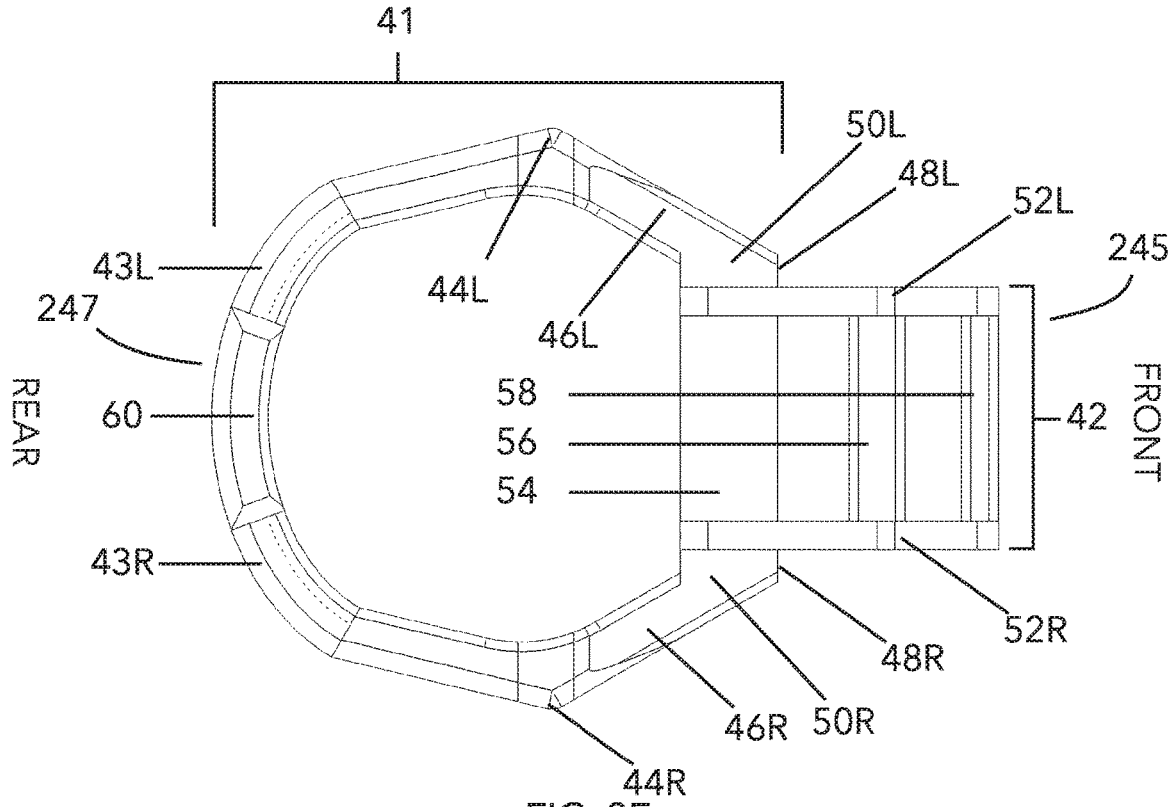
FIG. 2E is a plan view of the connector member of FIG. 2D.
Figure 2F:
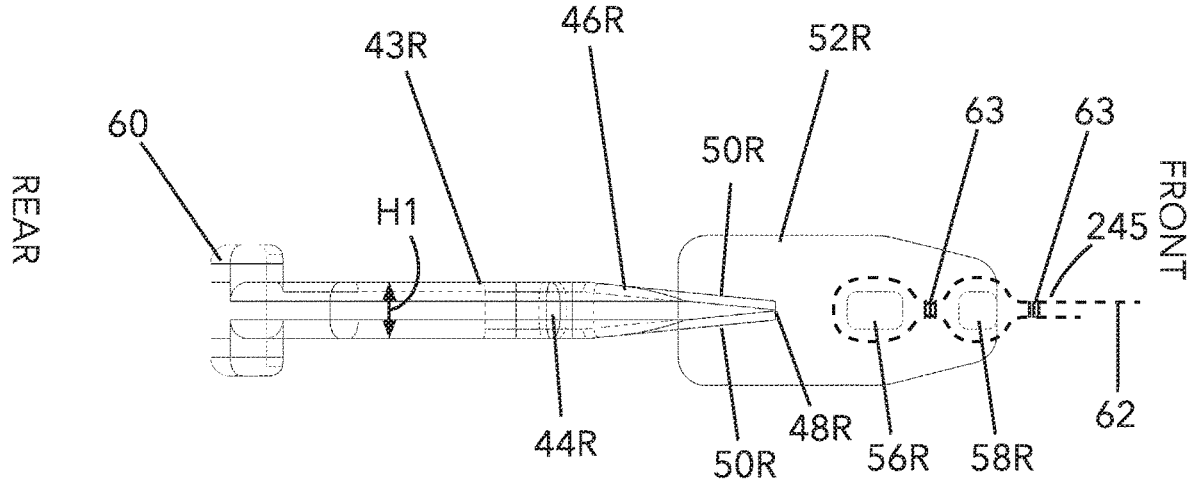
FIG. 2F is a side view of the connector member of FIG. 2D.
Figure 2G:
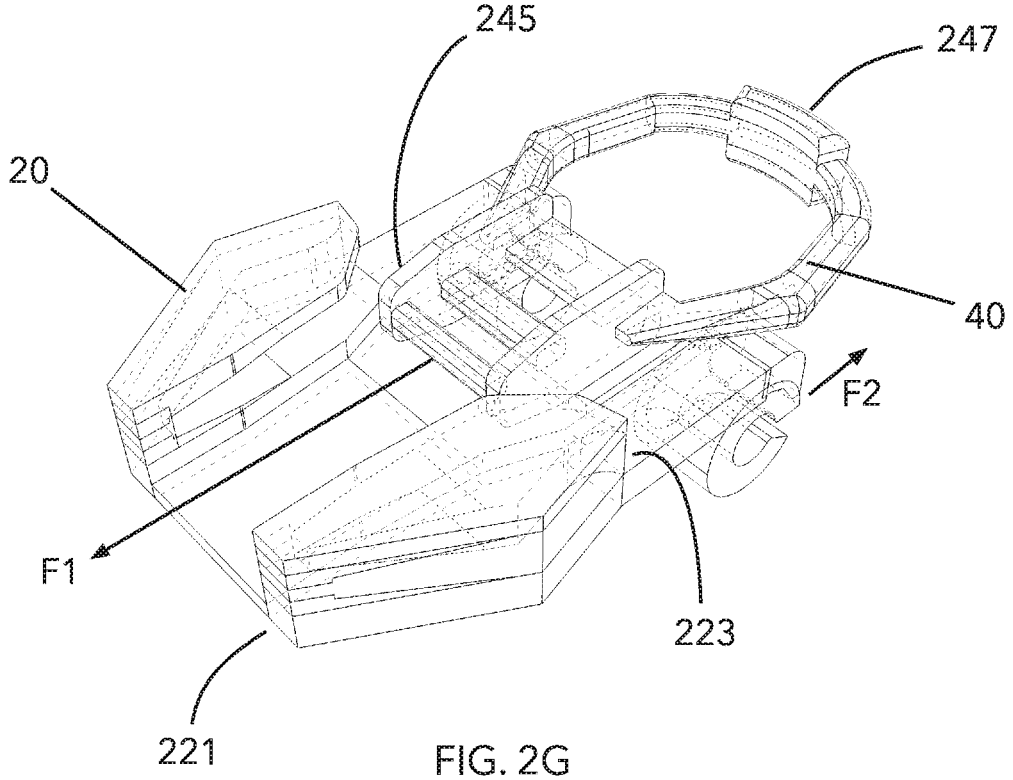
FIG. 2G is a perspective view of an unconnected buckle including the connector members of FIG. 2A and FIG. 2D in accordance with an embodiment.
Figure 2H:
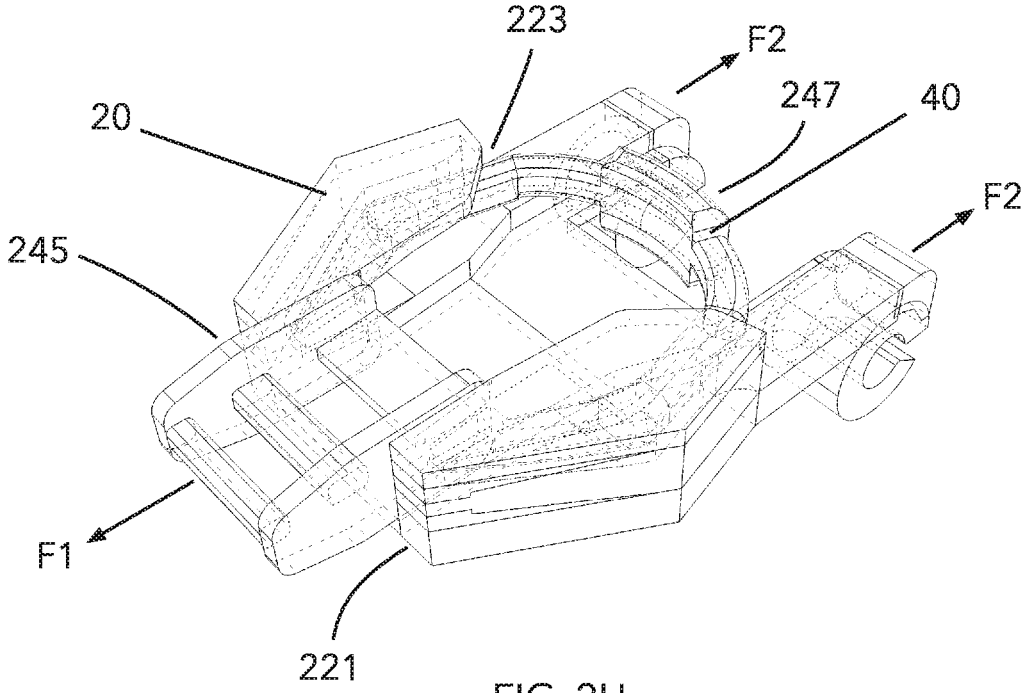
FIG. 2H is a perspective view of a connected buckle including the connector members of FIG. 2A and FIG. 2D in accordance with an embodiment.
Figure 2I:
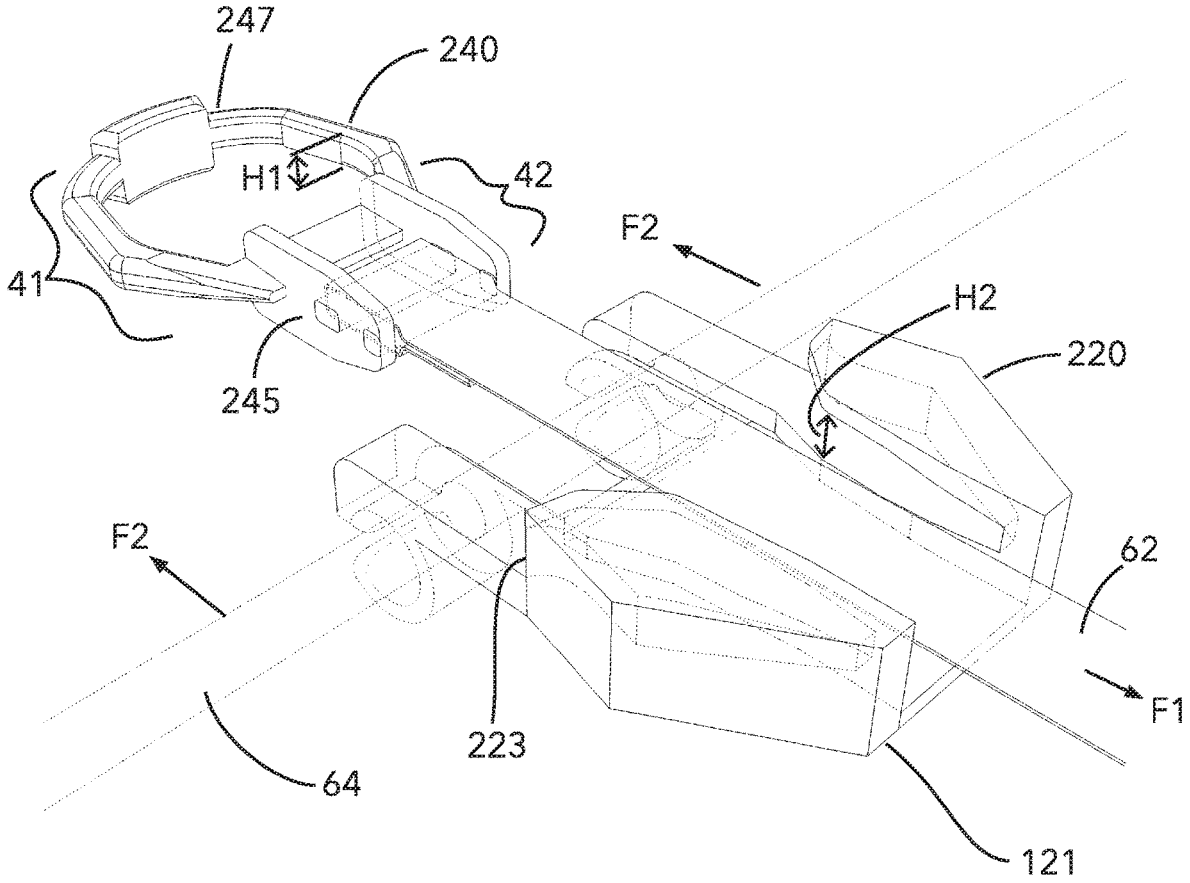
FIG. 2I is a perspective view of an unconnected buckle including the connector members of FIG. 2A and FIG. 2D attached to respective anchors in accordance with an embodiment.
Figure 2J:
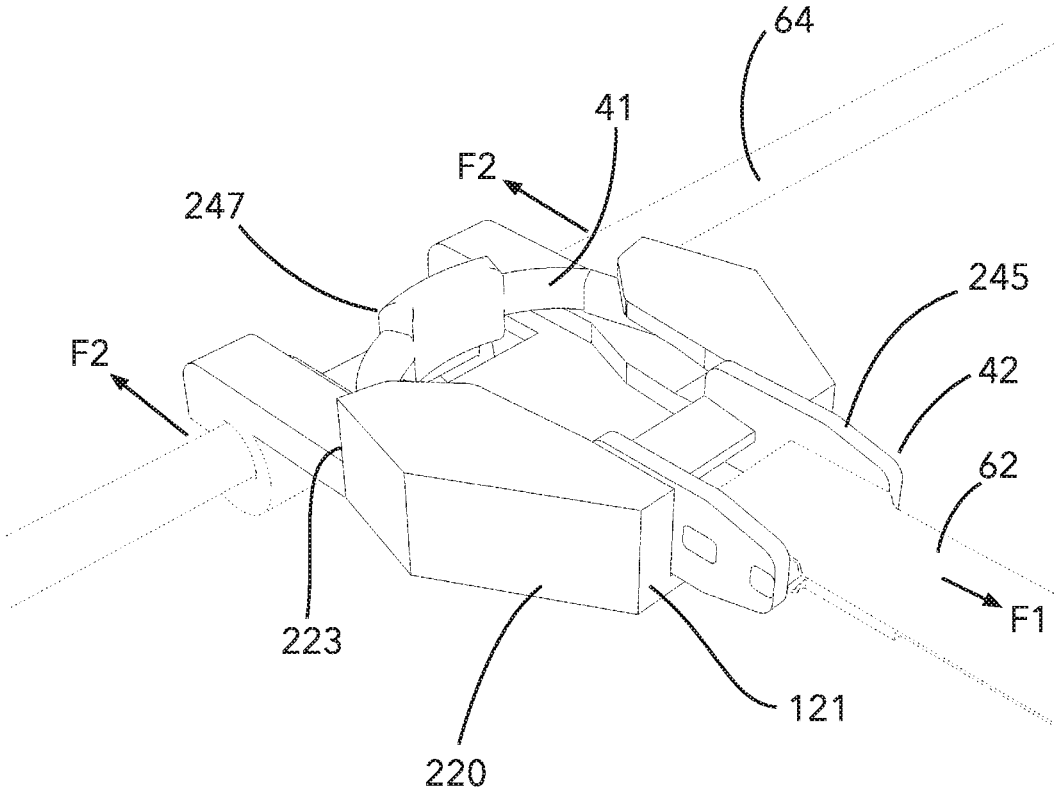
FIG. 2J is a perspective view of a connected buckle including the connector members of FIG. 2A and FIG. 2D attached to respective anchors in accordance with an embodiment.
Figure 2K:
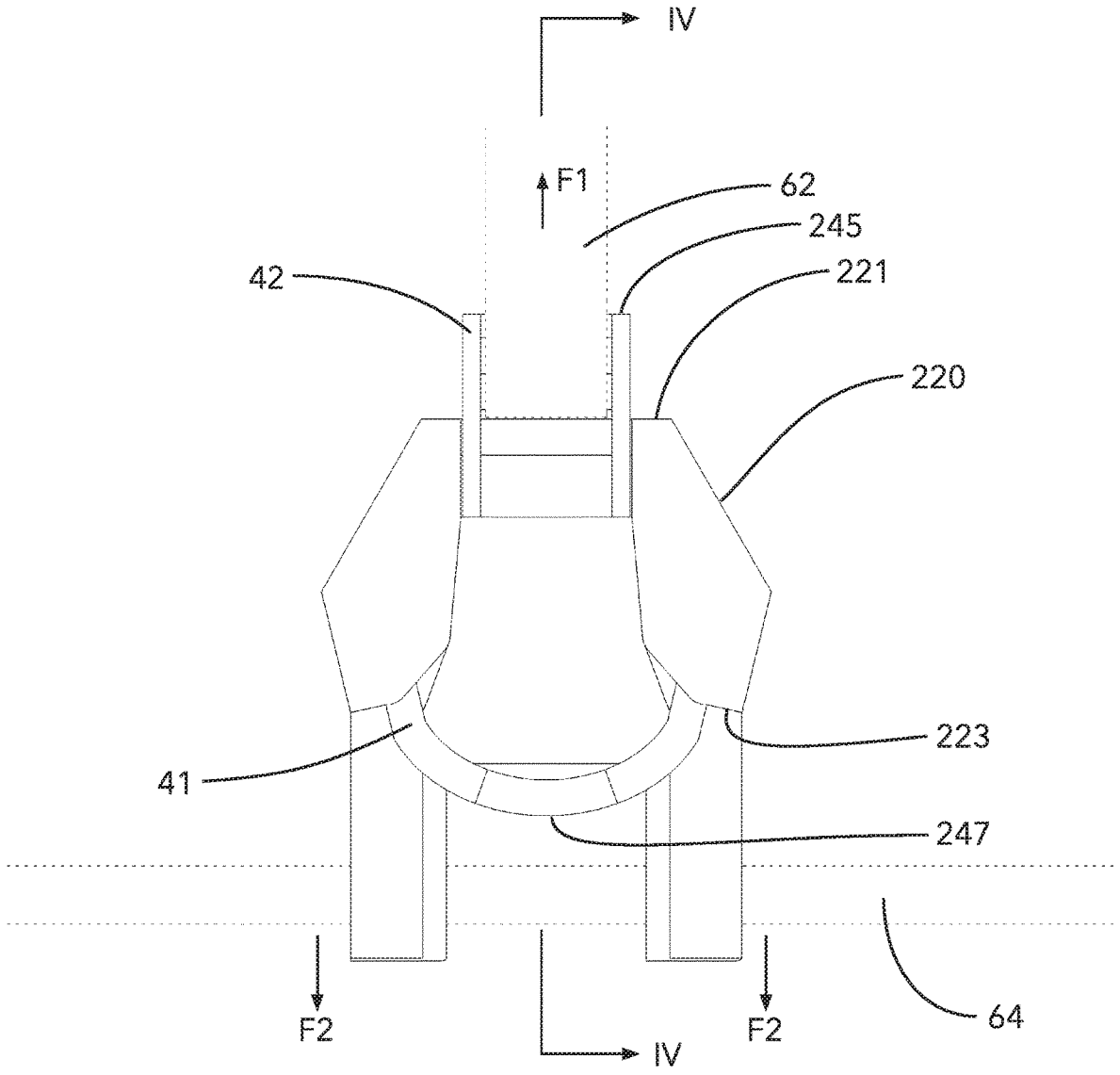
FIG. 2K is a top view of a connected buckle including the connector members of FIG. 2A and FIG. 2D attached to respective anchors in accordance with an embodiment.
Figure 2L:
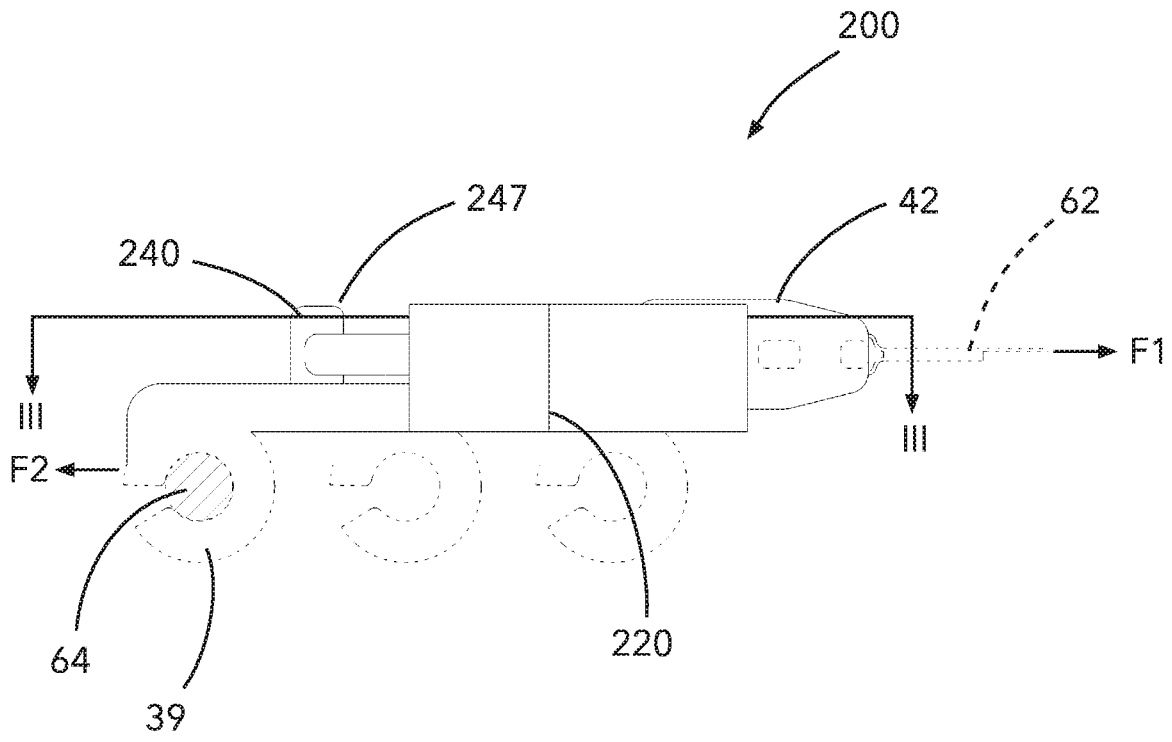
FIG. 2L is a side view of a connected buckle including the connector members of FIG. 2A and FIG. 2D attached to respective anchors in accordance with an embodiment.
Figure 2M:
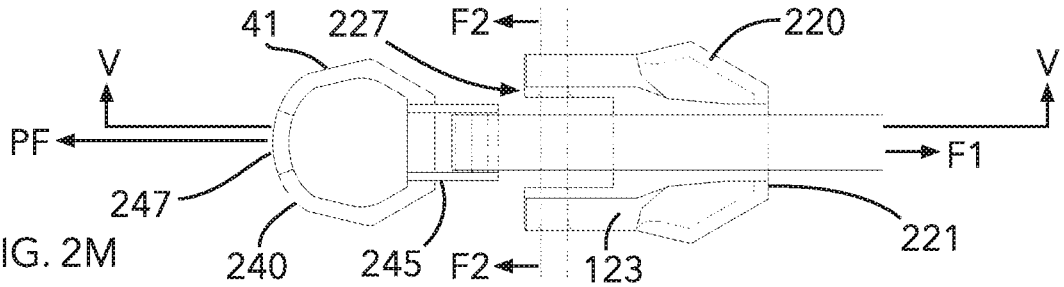
FIG. 2M is a top view of a buckle including the connector members of FIG. 2A and FIG. 2D being connected in accordance with an embodiment.
Figure 2N:
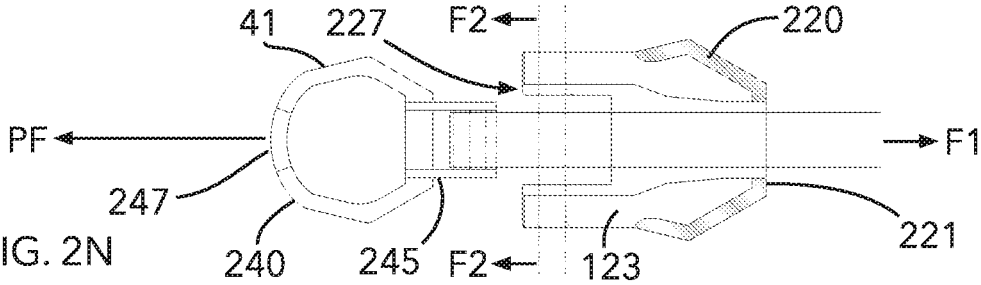
FIGS. 2N-2Q are cross-sectional top views of a connected buckle including the connector members of FIG. 2A and FIG. 2D and viewed along section shown in FIG. 2L in accordance with an embodiment.
Figure 2O:
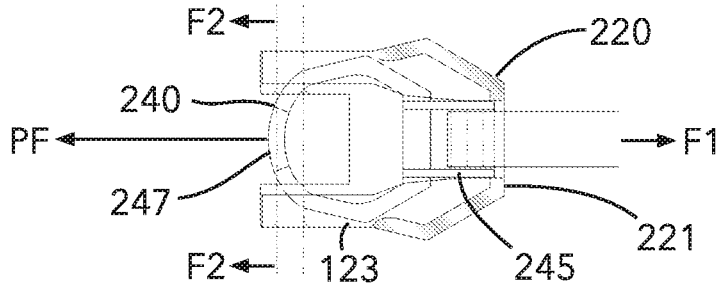
Figure 2P:
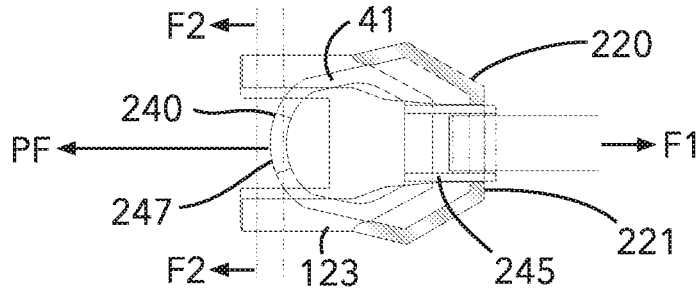
Figure 2Q:
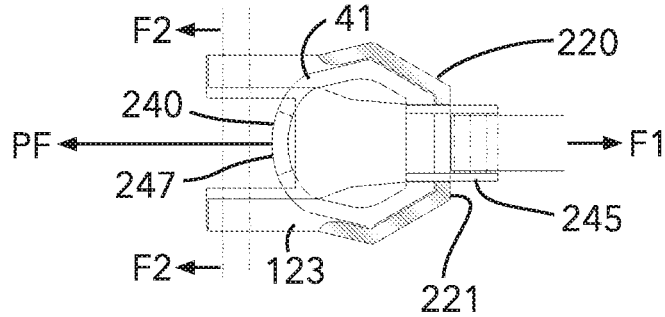
Figure 2R:
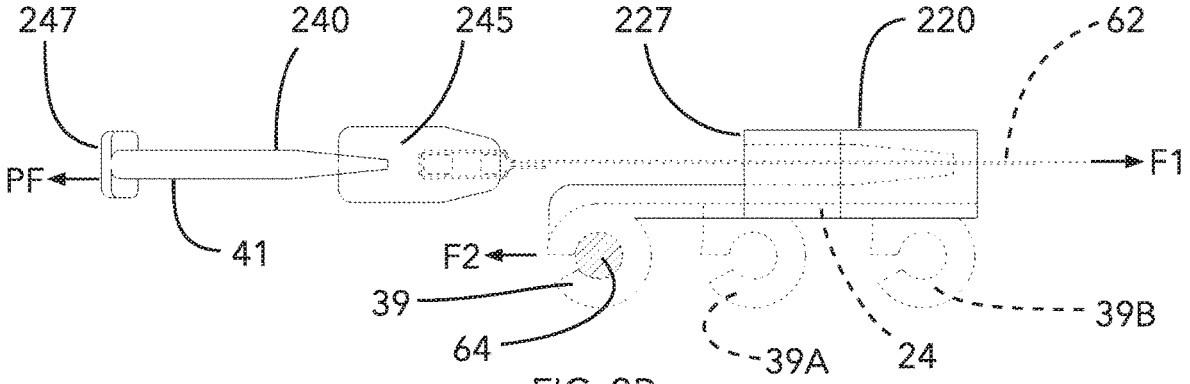
FIG. 2R is a side view of an unconnected buckle including the connector members of FIG. 2A and FIG. 2D in accordance with an embodiment.
Figure 2S:
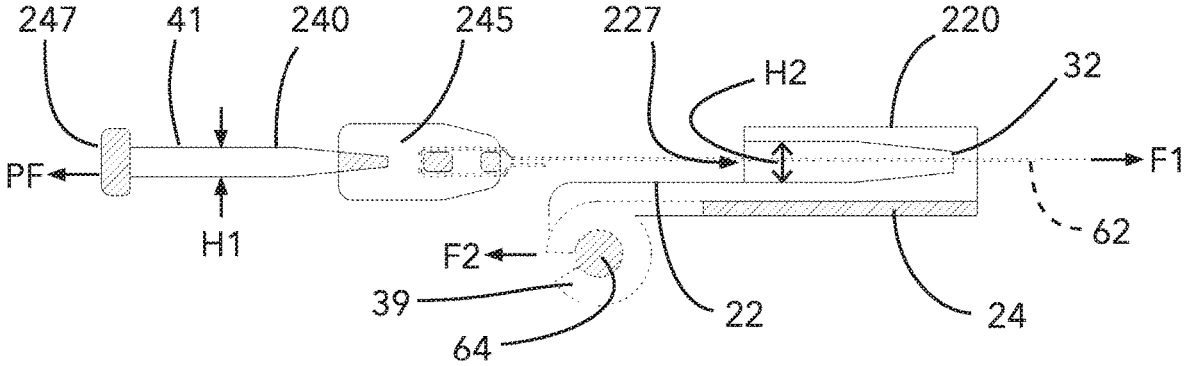
FIG. 2S is a cross-section side view of an unconnected buckle including the connector members of FIG. 2A and FIG. 2D shown along section line V-V in accordance with an embodiment.
Figure 2T:
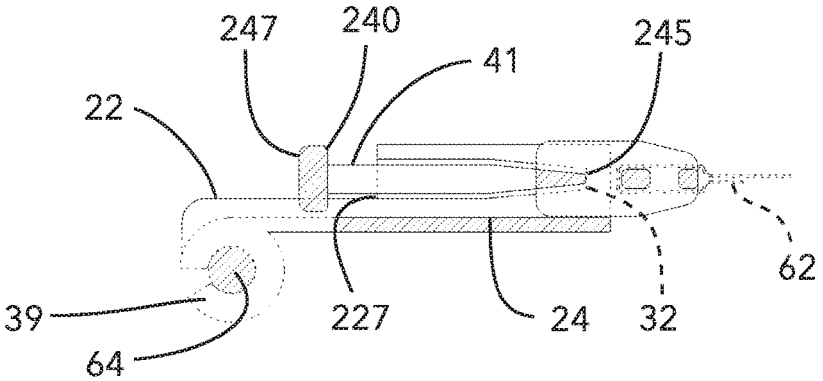
FIG. 2T is a cross-section side view of a connected buckle including the connector members of FIG. 2A and FIG. 2D shown along section line IV-IV in accordance with an embodiment.
Figure 3A:
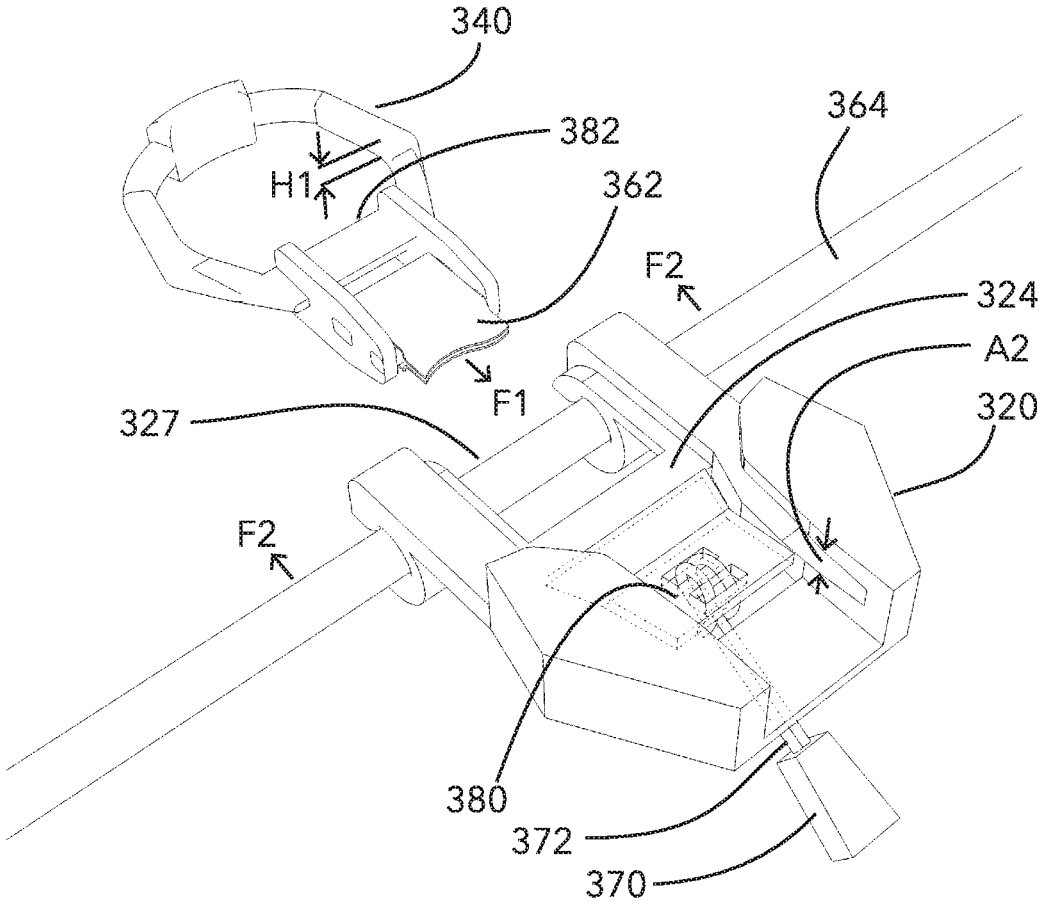
FIG. 3A is a perspective view of an unconnected buckle having a disconnect lock in accordance with an embodiment.
Figure 3B:
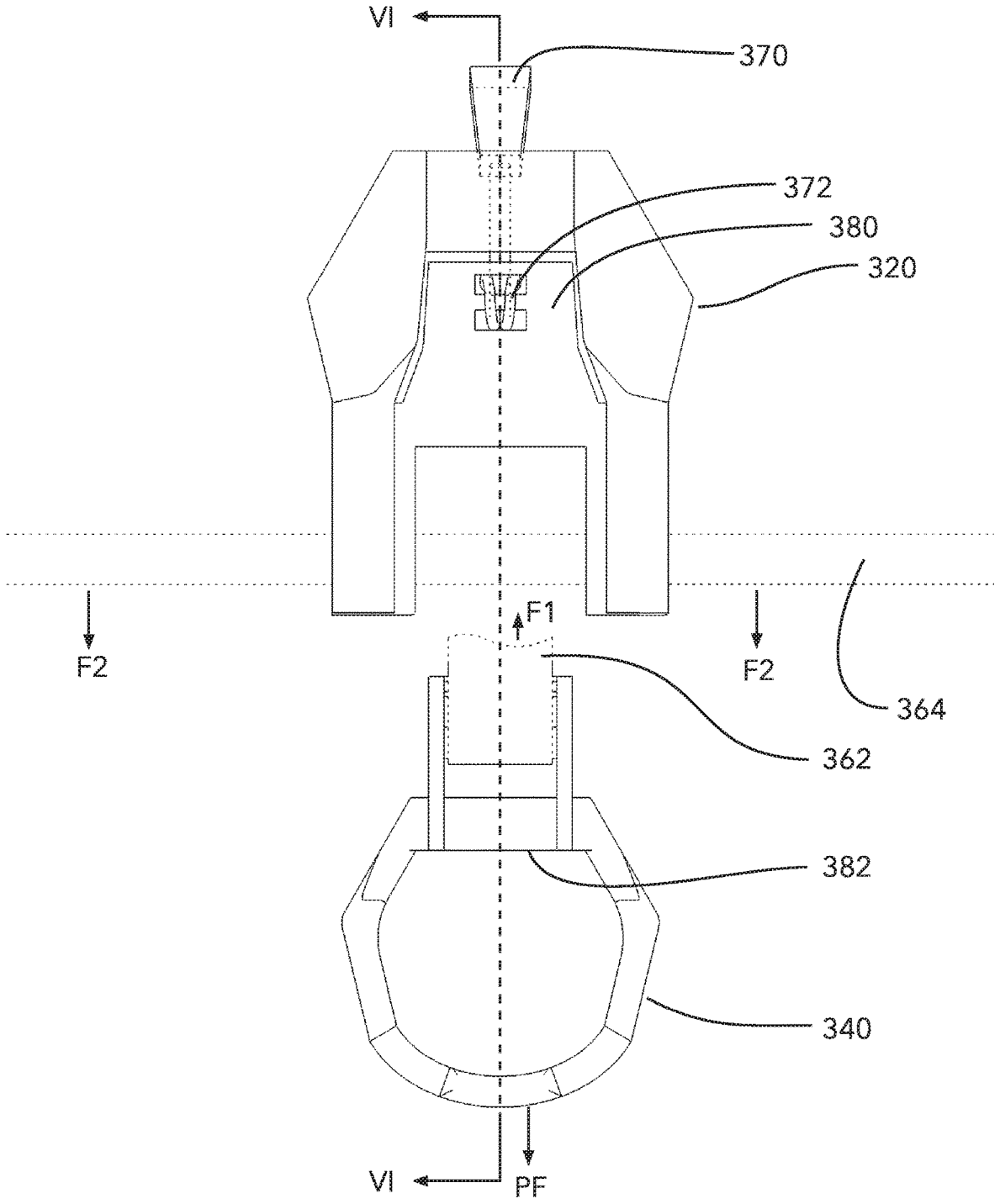
FIG. 3B is a top view of the unconnected buckle having a disconnect lock of FIG. 3A.
Figure 3C:
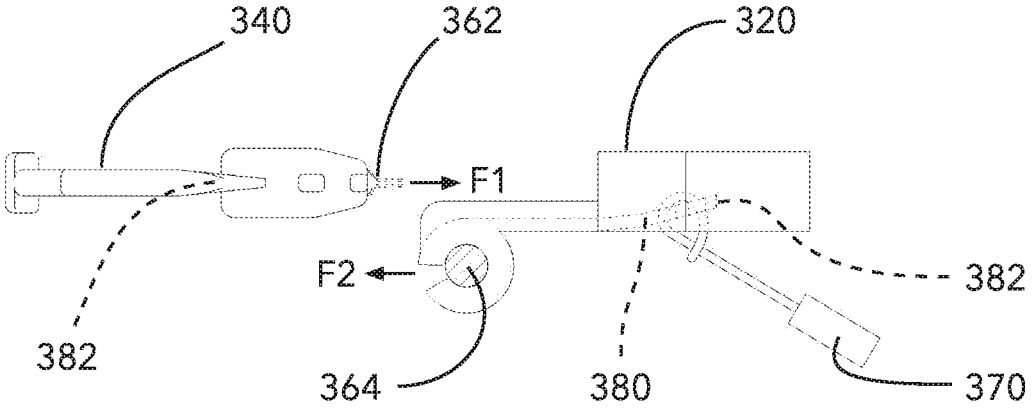
FIG. 3C is a side view of the unconnected buckle having a disconnect lock of FIG. 3A.
Figure 3D:
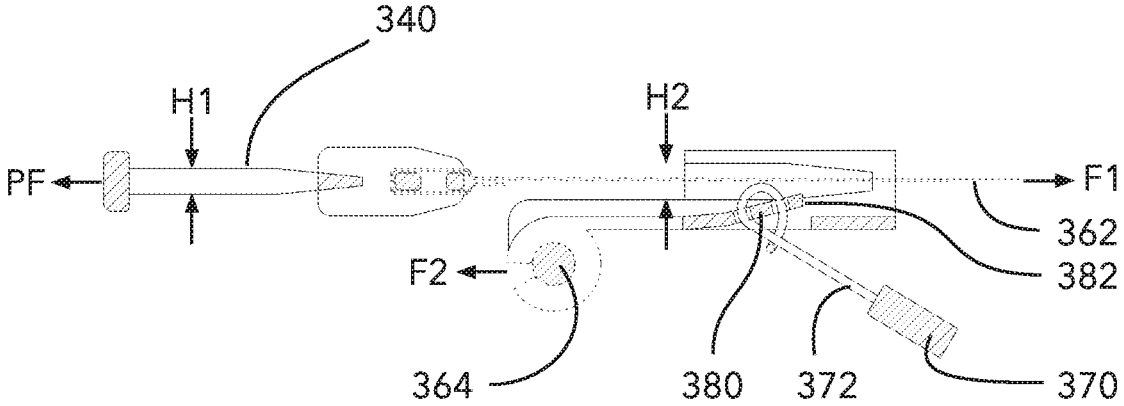
FIGS. 3D-3I are side cross-sectional side views of the buckle of FIG. 3B in various states from unconnected to connected as shown along section line VI-VI.
Figure 3E:
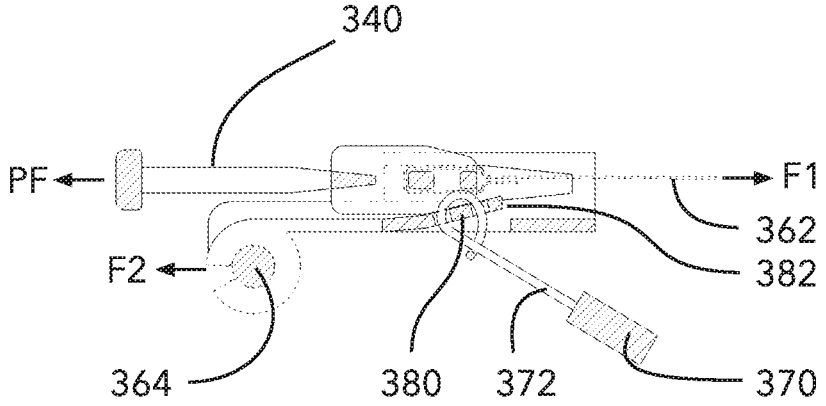
Figure 3F:
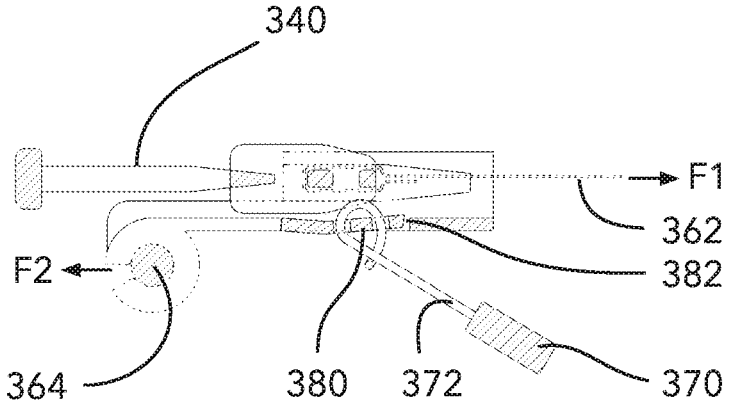
Figure 3G:
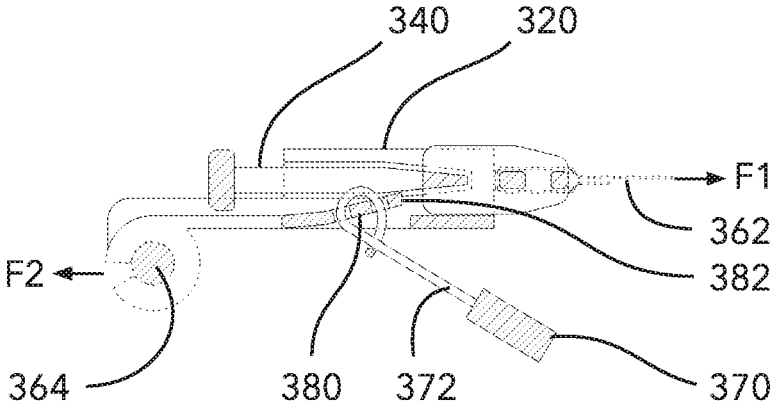
Figure 3H:
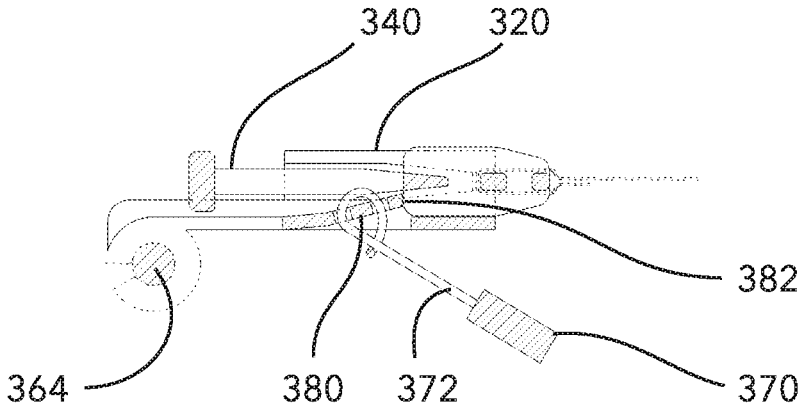
Figure 3I:
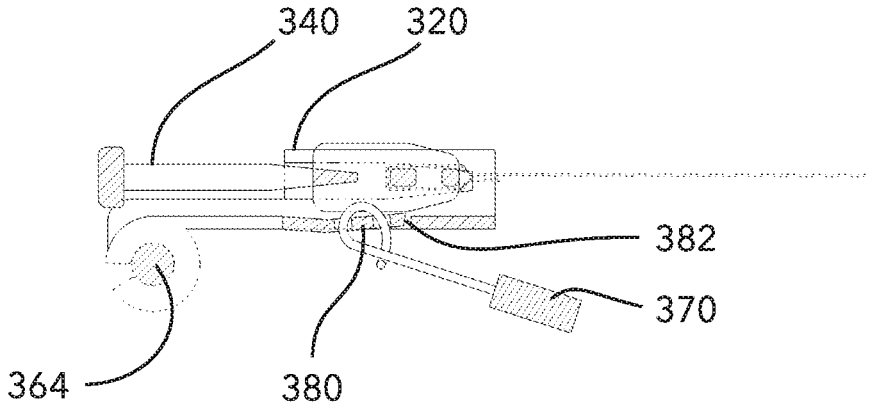

FIGS. 2A-2T show an embodiment of a buckle 200 having opposing engagement members 20, 40. In the examples shown, the engagement members 20, 40 include a female receiving member 20 and a male plug member 40. Similar to the embodiment discussed above, the bottom of receiving member 20 includes a base plate 24 and alignment channel 26. The embodiments shown in the examples provided in FIGS. 2A-2T also include additional features that help align the plug member 40 as it is received into receiving member 20.

In one example, the exterior sides of receiving member 20 include side walls 29L and 29R. The rear edges of side walls 29L and 29R include interior surfaces 31L and 31R. Toward the middle of side walls 29L and 29R are receiving features 30R and 30L, which can be notches configured to receive corresponding features on the plug member 40. In various examples, the receiving features are positioned on the interior surfaces of side walls 29L and 29R.

In some embodiments, the front edge of side walls 29L and 29R define wall ends 32L and 32R, which function as end stops for the plug member 40. The end stop portion may be a fixed stop. Side walls 29L and 29R connect base plate 24 to top plates 35L and 35R. The top plate interior facing surfaces 37L and 37R (i.e. the interior edges of the top plate) define a part of the alignment channel 26. The top plates 35L and 35R also include chamfered corners 36L and 36R proximal to the rear interior surface of the top plates. These chamfered corners define a portion of the rear edges of top plates 35L and 35R.

In some embodiments, the base plate 24 may extend from the extremities of the rear of receiving member 20 to the extremities of the front of receiving member 20. In other embodiments, the base plate 24 includes clearances for the plug member 40 features. For example, shoulders 34L and 34R may extend from each rear side of the base plate 24 forming a space between these shoulders. Thus, the back edge of base plate 24 does not extend back as far as shoulders 34L and 34R. In some embodiments, the shoulders may support the connection portions 39L and 39R. In accordance with one embodiment, the connection portions 39L and 39R are separated along with the shoulders providing for room there between for plug member 40 features to extend through, such as a thumb press plate 60 discussed below. Further, one edge of the rings of connection point 39L and 39R have been eased so as to allow the user to attach or remove the slider from the track as desired." For example, the eased edges can be seen when comparing #39L/R in FIGS. 2A and 2I. In various embodiments, slider and track are types of connections used in attaching the one portion of the buckle to an article (e.g. backpack strap.)

In accordance with various embodiments and similar to those discussed above, the plug member 40 includes a body portion 41. The plug member 40 also includes a connection portion 42, which can be a trestle as shown in the FIGS. 2A-2T but can also be other types of connection portions suitable to attach to an article or a portion of an article consistent with other embodiments described herein. In some examples, a central guide arm on the male plug member could be widened to allow it to connect to a strap and serve the function of trestle 42. Two side arms of the male plug member could be moved further apart to accommodate the increased width of the central guide arm. The female portion of the buckle could be widened and designed to have a central alignment channel, just as the embodiment shown in the drawings contains alignment channel 26. Such an arrangement is similar to typical side-release buckle but modified such that it is a counter release buckle as otherwise disclosed herein.

The body portion 41 can include the arms 43L and 43R. The arms 43L and 43R form a ring. The body portion 41 can also include a thumb press plate 60. The arms 43L and 43R of body portion 41 connect from thumb press plate 60 to connection portion 42 (e.g. a trestle as shown). Between the thumb press plate and the connection portion 42 are elbows 50L and 50R that are slightly rounded corners along the length of arms 43L and 43R. In accordance with various examples, the elbows 44L and 44R are the widest portion of male plug member 40. Between the elbows 44L and 44R are forearms 46L and 46R that connect the elbows 44L and 44R to the arm ends 48L and 48R. The arms 43L and 43R may have any shape. In one example, the forearms 46L and 46R taper in transition from the elbows to the arm ends. At the connection portions of arms 43L and 43R and connection portion 42, the arm ends 48L and 48R form the blunt front edge. The top and bottom of arms 43L and 43R can include palms 50R and 50L. Palms 50R and 50L are broad areas configured to slide within a receiving channel 227 in the receiving member 20.

The connection portion 42 is configured to attach to an article or portion of an article and can be any component configured to do so. In one example, as shown, the connection portion 42 is a trestle that is comprised of trusses 52L and 52R and three beams, the rear beam 54, middle beam 56, and front beam 58. The trusses 52L and 52R are flat on the top and bottom and taper between middle beam 56 and front beam 58. The width of trestle 42 (the distance from the outside edge of truss 52L to the outside edge of truss 52R) is slightly less than the width of alignment channel 26. As illustrated, the article portion 62 may be a strap that is connected to trestle 42 by snugly wrapping around middle beam 56 and being attached back onto itself in front of beam 58. The strap is also attached to itself between middle beam 56 and front beam 58, creating a more rigid connection between strap 62 and plug member 40.

In accordance with some embodiments, the male plug member 40 is symmetrical along one or more axes. For example, it may be symmetric laterally (i.e. left to right in accordance with the symmetric callouts in FIGS. 2A-2T), and vertically (i.e. top to bottom). While the plug member 40 can be symmetrical longitudinally (i.e. front to back), the examples shown are an example of a vertically asymmetrical configuration.

FIGS. 2G-2T illustrate the relationship of the forces on the buckle portions. The portion of the article 62 connecting to the connection portion 42 is configured to exert a reactive force F1 on the engagement member 40. In embodiments in which the portion of the article 62 is a strap as shown in FIGS. 2G-2T, the force F1 is merely a tensile force. For purposes of orientation and description of the buckle 200 herein, the furthermost side of the plug member 40 in the direction of force F1 is designated as the rear portion or end 45. The furthermost side of the engagement member 40 opposite the direction of force F1 is the front portion or end 47. It should be understood, however, that regardless of the direction of force F1, the connection portion 42 may be located along any portion of the engagement member 40 including the front, middle, or rear portion. For example, the connection portion 42 is shown on the rear portion 45 of engagement member 140 in each of FIGS. 2D-2T.

As shown in FIGS. 2G-2T, due to the structure of the portion of the article 64 illustrated (e.g. piping), the force F2 can be a tensile force or a compressive force. Thus, F2 can resist any force applied on the connection portion 39L/R. As illustrated in FIGS. 2G-2T, F2 is shown as a tensile force that would be applied to the connection portion 39R/F in response to the buckle 100 being placed in tension. For purposes of orientation and description of the buckle 200 herein, the furthermost side of the receiving member 20 in the direction of force F2 is designated as the rear portion or end 23. The furthermost side of the receiving member 20 opposite the direction of force F2 is the front portion or end 21. It should be understood, however, that regardless of the direction of force F2, the connection portion 39L/R may be located along any portion of the engagement member 40 including the front, middle, or rear portion in FIGS. 2C and 2R (see 39A, 39B). But, by way of example, the connection portion 39L/R is shown between the front and rear portions of engagement member 20.

To perform the clipping action as illustrated in FIGS. 2M-2Q, the plug member 40 is pulled past the receiving member 20 (FIGS. 2M and 2N). The plug member 40 is set on base plate 24 of the female receiving member 20 with trestle 42 in alignment channel 26, and between the edges of the two top plates 37L and 37R (FIG. 20). In this position, arms 43L and 43R rest on receiving ledges 22L and 22R while the trestle 42 rests on base plate 24 within alignment channel 26. In accordance with various embodiments, lateral sides of the base plate 24 may define the receiving ledges 22L and 22R. The lateral sides may be stepped up in height from the base plate forming the receiving ledges 22L and 22R. The lower portion of the stepped sides may be substantially planer with the base plate and configured such that part (e.g. the connection portion 42) of the plug member 40 can slide along the lower portion. The upper portion of the lateral step may be configured for the body portion 41 of the plug member 40 to slide along. The contact points between these members assist in aligning the plug member 40 within receiving member 20 to allow the user to clip the buckle. As pressure is first applied to strap 62 or to plug member 40 to pull plug member 40 into receiving member 20, the tapered forearms 46L and 46R easily slide beneath top plates 35L and 35R. The base plate 24 and the top plates 35L and 35R are separated by a height H2. The height of the plug member 40 has a height of H1. H1 is about the same as or less than H2 so that the plug member 40 can slide within the channel having the height H2. This action further aligns the plug member 40 in receiving member 20. Additional pressure applied to strap 62 or plug member 40 to pull plug member 40 into receiving member 20 will result in contact between elbows 44L and 44R and beginning of walls 31L and 31R (FIG. 2P). Here the elbows 44L and 44R have a width of W1 and the beginning of walls 31L and 31R have a width of W2. When untentioned W1 is greater than W2. When tension or compressed, W1 can change until it's less than W2. Elbows 44L and 44R are slightly wider than beginning of walls 31L and 31R. Once contact between elbows 44L and 44R and beginning of walls 31L and 31R occurs, the male plug member cannot easily fall out of alignment due to trestle 42 being within alignment channel 26 and between top plate surfaces 37L and 37R, and the palms 50L and 50R and forearms 46L and 46R are between the base plate 24 and top plates 35L and 35R (FIG. 2P). Pressure applied to strap 62 or plug member 40 to pull plug member 40 into receiving member 20 will result in the deformation of the body portion of plug member 41 as elbows 44L and 44R are squeezed toward one another so that they slide past beginning of walls 31L and 31R. In some embodiments, the receiving member 20 may also appreciably deform outward during this process. Once elbows 44L and 44R are past beginning of walls 31L and 31R, they come to rest within receiving features 30L and 30R (e.g. notches) in side walls 29L and 29R (FIG. 2Q). The buckle has been clipped. In this position, the forces experienced during normal use will act to pull plug member 40 further into receiving member 20. The wall ends or end stop portions 32L and 32R make contact with arms ends 48L and 48R to prevent plug member 40 from pulling through receiving member 20.

To separate plug member 40 from receiving member 20 and thus unclip the buckle, pressure is applied to the inside edge (the edge opposite trestle 42) of thumb press plate 60. Optionally, one's finger may be placed on either shoulder 34L or 34R when one's thumb is placed on thumb press plate 60 in order to more easily separate the two members. With fingers in this position, the motion of unclipping the buckle is not substantially different from the motion of 'snapping' using one's thumb and finger. As plug member 40 slides out of receiving member 20, the two pieces can be separated as soon as palms 50L and 50R and forearms 46L and 46R clear chamfered top plate corners 36L and 36R. The angles of these pieces in the embodiment shown allow plug member 40 to move a minimal amount to the rear in order for full separation to occur, e.g. 10-20 millimeters. When exposed to forces that occur during normal use, the rear release buckle is less likely to pull apart. Pulling on the rear release buckle in this way would pull the male plug member into the female receiving member. To release the buckle, force is applied in the opposite direction from the forces encountered during normal use.

The various components described in FIG. 2 are merely examples, and other variations, including eliminating components, adding components, combining components, and substituting components of other embodiments disclosed herein are all contemplated.

FIGS. 3A-3I show an embodiment of a buckle 300 having elements similar to those discussed above in addition to a locking mechanism 380. In accordance with various embodiments and as illustrated by way of example in FIGS. 3A-3I, the buckle 300 includes opposing engagement members 320 and 340. The locking mechanism (e.g. tab 380) may include any device suitable to further secure the engagement member 340 within the engagement member 320. In various examples, the locking mechanism may be actuated by manually manipulating the locking mechanism while separating the engagement members 320 and 340 from one another. The opposing engagement members 320, 340 are configured to place various forces on one another to connect to one another and form an engageable and disengageable connection on an article. In accordance with various embodiments, the receiving member 320 includes a receiving channel 327 suitable to engage and receive the plug member 340 therein. The receiving channel 327 may include a base plate defining the bottom portion of the receiving channel 327. The base plate 324 may be configured similarly to any of the other embodiments herein. Additionally, in various embodiments the base plate 324 can include a locking mechanism 380. In one embodiment, the locking mechanism includes a portion of the base plate 324 that is separated from the rest of the base plate 324 and flexibly protrudes into the receiving channel at an angle opposite the tension direction F2 (i.e. the reactive force against F1) of the engagement member 320. (Doesn't make sense to me, please double-check.) The protruding portion of base plate 324 forms a tab 380. The cantilevered free end of the tab 380 extends at least partially into the path of the engagement member 340 forming an interference surface 382.

In accordance with various embodiments, the engagement member 340 is configured to be connected to article portion 362 such that article portion 362 can assert a force F1 on the engagement member 340. A user can also assert a force PF on the engagement member 340 by pulling on it opposite the force F1. In accordance with various embodiments, the engagement member 340 may include one or more vertical surfaces 384 suitable to engage with and interfere with the interference surface 382. Because the tab 380 extends into the receiving channel 327 at an angle in one direction (i.e. the direction in which the engagement member 340 is received within the engagement member 320), the tab 380 does not interfere with the engagement member 340. However, once the engagement member 340 is connected to the engagement member 320, the tab 380 may extend up into the empty area around the vertical surface 384 and the interference surface 382 and the vertical surface 384 may interfere with one another limiting or preventing the removal of the engagement member 340 from the engagement member 320.

In order to remove the engagement member 340 from the engagement member 320, the tab 380 is depressed, removing the interference between the vertical surface 384 and the interference surface 382. The tab 380 can be depressed by a finger through the clearance in the engagement member 340 or, in other embodiments, the tab 380 can be connected to a cord 372. In response to the cord 372 being pulled, the force of the pull may depress the tab 380 sufficiently to remove the engagement member 340 from the engagement member 320. In some embodiments, the cord may include a tab 370 on the end of the cord 372 to increase the surface area for holding and pulling the cord 372.

Figure 4A:
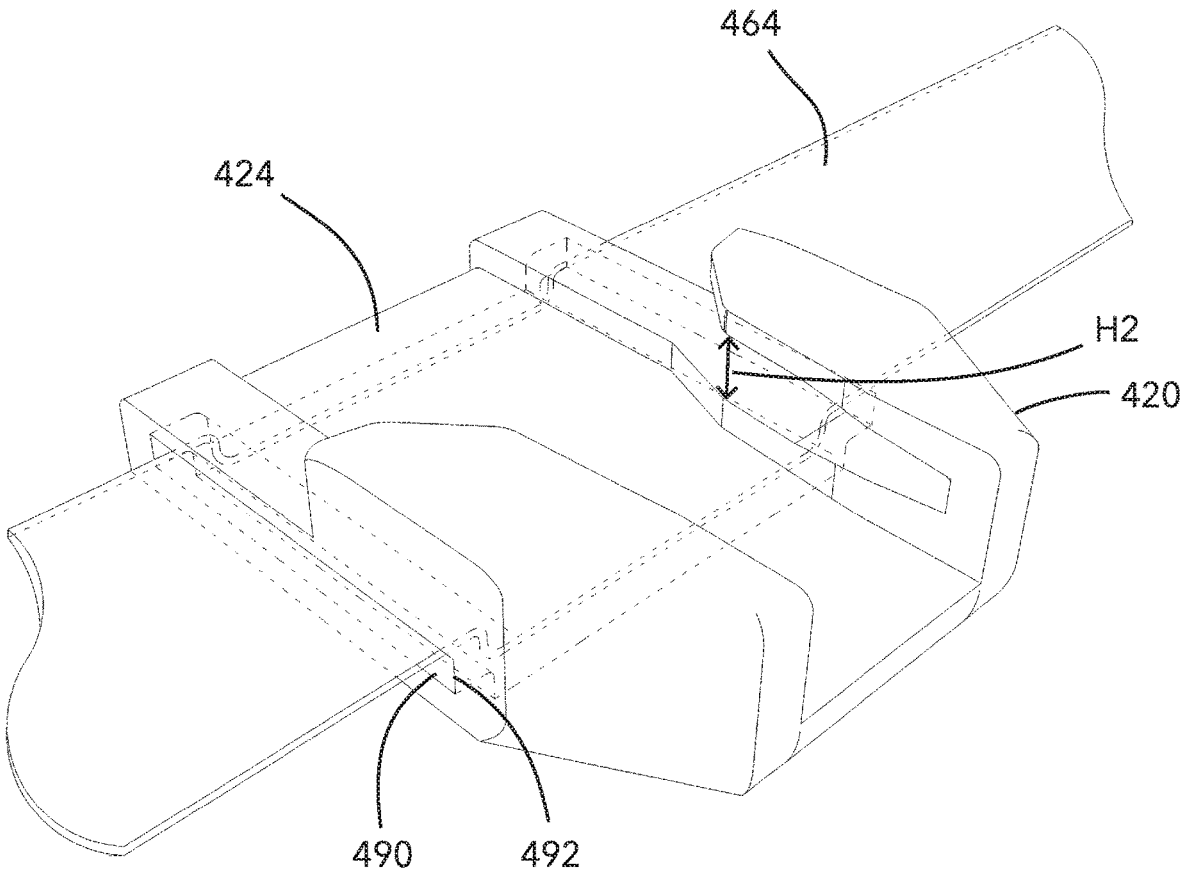
FIG. 4A is a perspective view of the connector member having a perpendicular strap attachment in accordance with an embodiment.
Figure 4B:
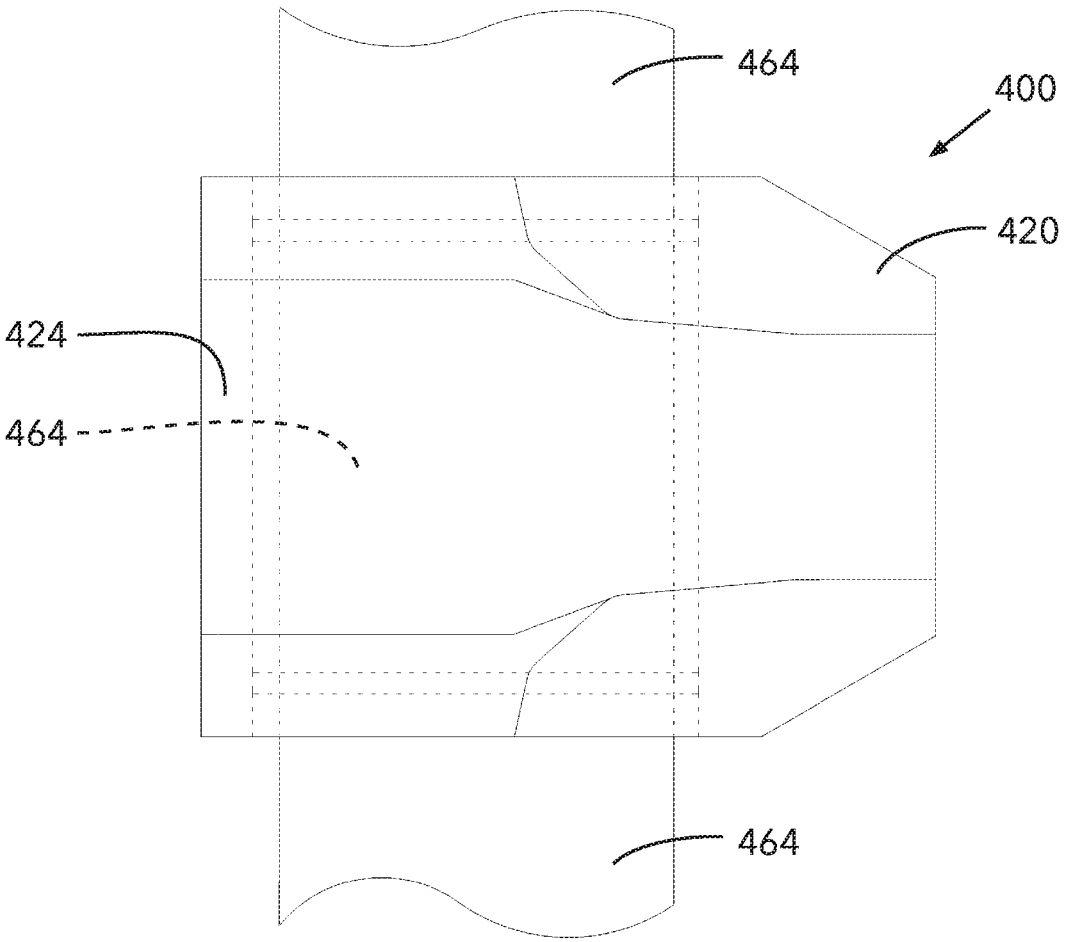
FIG. 4B is a top view of the connector member having a strap attachment as shown in FIG. 4A.
Figure 4C:
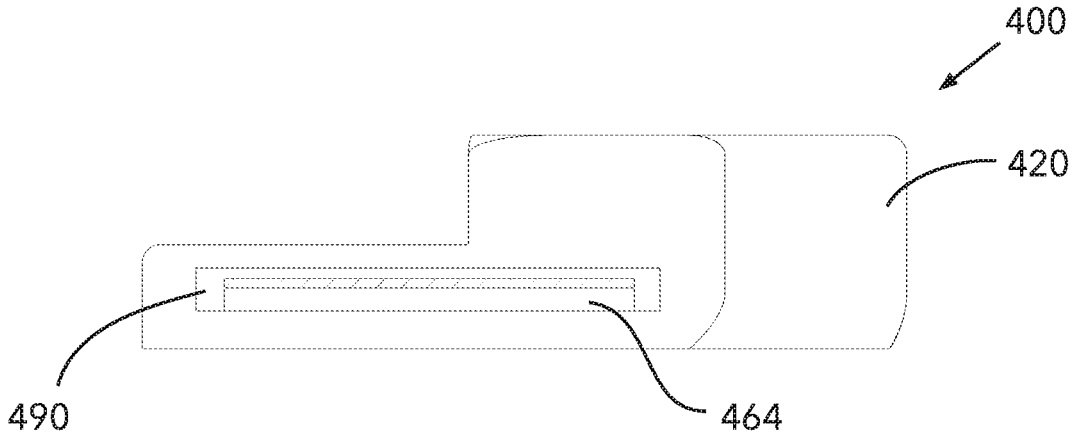
FIG. 4C is a side view of the connector member having a strap attachment as shown in FIG. 4A.

As discussed in above, the connection portion of the engagement member may be configured in a variety of manners. The embodiments discussed above have been directed to c-shaped clamps suitable for holding/clamping onto article features such as piping. In other embodiments as shown in FIGS. 4A-C, an engagement member 420 may include a connection portion 490 configured to attach the engagement member 420 to an article portion such as a strap 464. In such an embodiment, an aperture 492 may extend below a base plate 424 of the engagement member 420. The aperture 492 may extend across the transverse width of the engagement member 420 allowing the strap 464 to extend through the transverse width of the engagement member 420. As shown, the aperture 492 is a slot having bottom, top, and side walls that extend through the transverse width of the engagement member 420. In other embodiments, the aperture may be cylindrical for supporting an article portion such as a cable, rope, string lanyard or the like. The aperture may also extend through the engagement member 420 side wall and through the base plate 424 such that the article portion is exposed from the top of the engagement portion 420. Any configuration suitable to connect the portion of the article (e.g. strap 464) to the engagement portion 420 such that the article portion is positioned transverse or substantially transverse to the engagement portion 420 is contemplated herein.

Figure 5A:
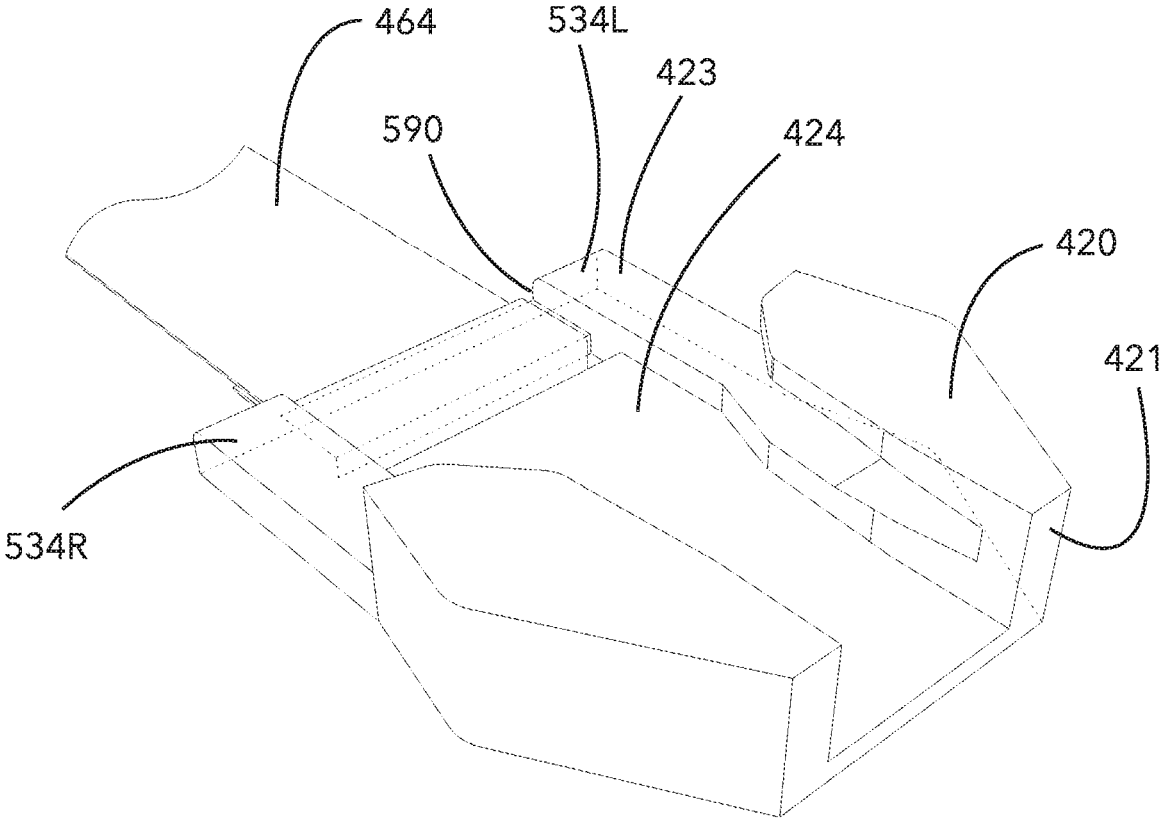
FIG. 5A is a perspective view of the connector member having a longitudinal strap attachment in accordance with an embodiment.
Figure 5B:
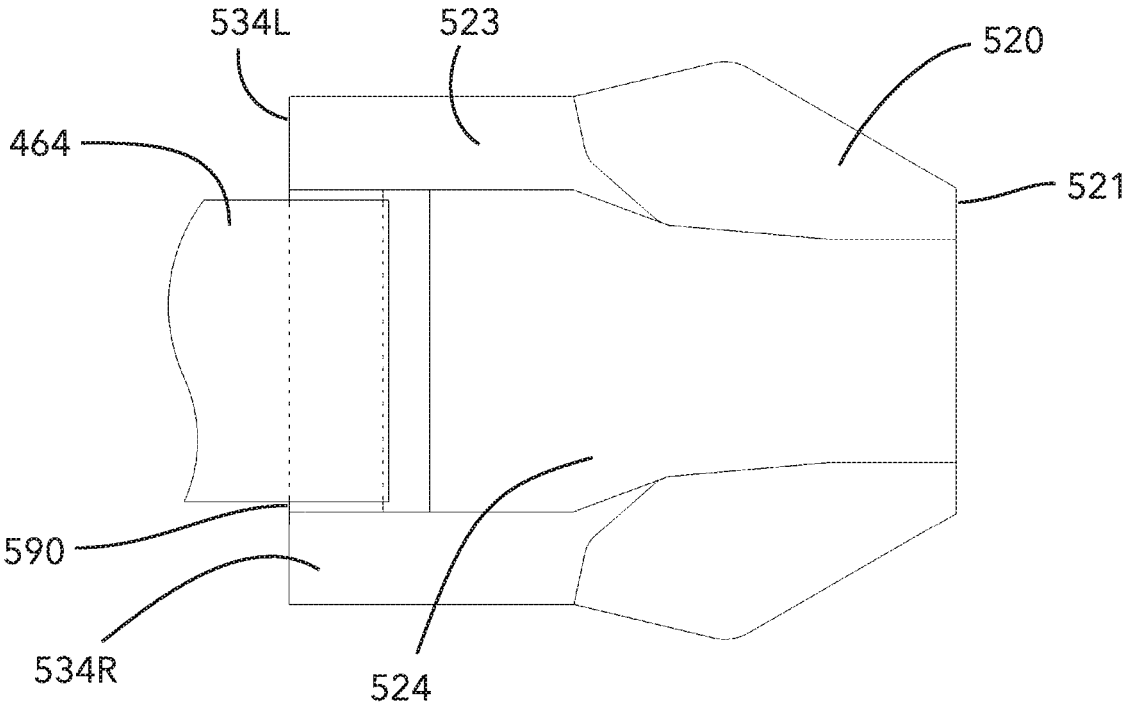
FIG. 5B is a top view of the connector member having a strap attachment as shown in FIG. 5A.
Figure 5C:
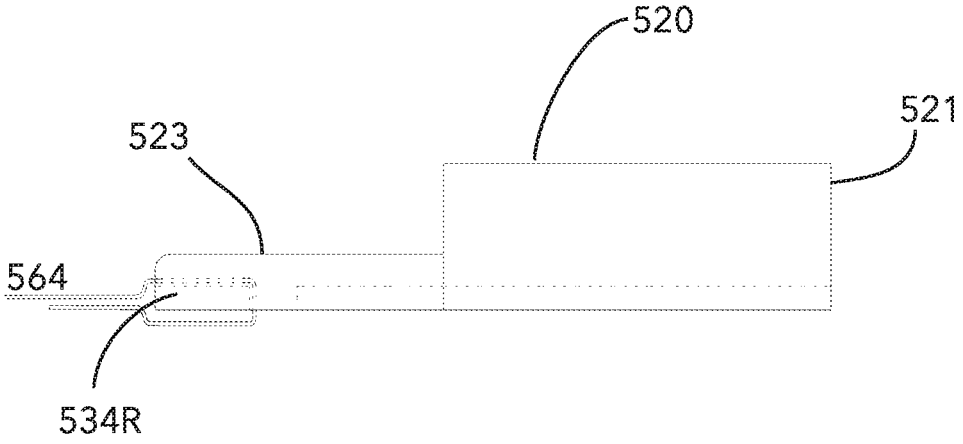
FIG. 5C is a side view of the connector member having a strap attachment as shown in FIG. 5A.

In accordance with another embodiment as shown in FIGS. 5A-C, an engagement member 520 may include a connection portion 590 configured to attach the engagement member 520 to an article portion such as a strap 564. In such an embodiment, shoulders 534L and 534R may extend from each rear side of a base plate 524. The shoulders 534L and 534R may have a space there between. Thus, the back edge of base plate 524 does not extend back as far as shoulders 534L and 534R. In some embodiments, the shoulders may support a beam which extends across the space between the shoulders 534L and 534R, thereby defining the connection portion 590. This configuration forms somewhat of a trestle similar to the configuration described above in regards to engagement members 40 and 140. However, it should be appreciated that any configuration suitable to connect the portion of the article (e.g. strap 564) to the engagement portion 520 such that the article portion is positioned longitudinally or substantially longitudinally with the engagement portion 520 is contemplated herein.

FIGS. 6A-6K show various views of an embodiment of a buckle 600 having opposing engagement members 620, 640. In the examples shown, the engagement members 620, 640 include a female receiving member 620 and a male plug member 640. Similar to the embodiment discussed above, the bottom of receiving member 620 includes a base plate 624 and alignment channel 626. The embodiments shown in the examples provided in FIGS. 6A-6K also include alternative features for the plug member 640 as it is received into alternative features of receiving member 620.

Consistent with other embodiments provided herein, the opposing engagement members 620, 640 are configured to place various forces on one another. Each of the opposing engagement members 620, 640 also includes a connection portion. For example, engagement member 620 includes connection portions 639R and 639L. Engagement member 640 includes connection portion 642. The connection portions include structures suitable to exert forces on the buckle 600. For example, the buckle 600 may be placed in tension between the respective connection portions of engagement member 620 and engagement member 640.

The connection portions (e.g. 642 or 690) can be positioned on the respective engagement member 620, 640 in any position suitable to allow the buckle 600 to exert the desired closing functionality on the article. For example, engagement member 640 includes the connection portion 642 on end 645. The portion of the article 662 connecting to the connection portion 641 is configured to exert a reactive force F1 on the engagement member 640. In embodiments in which the portion of the article 662 is a strap as shown in FIGS. 6A-6K, the force F1 is merely a tensile force. For purposes of orientation and description of the buckle 600 herein, the furthermost side of the engagement member 640 in the direction of force F1 is designated as the rear portion or end 645. The furthermost side of the engagement member 640 opposite the direction of force F1 is the front portion or end 647. It should be understood, however, that regardless of the direction of force F1, the connection portion 642 may be located along any portion of the engagement member 640 including the front, middle, or rear portion. But, by way of example, the connection portion 642 is shown on the rear portion 645 of engagement member 640.

In another example, engagement member 620 includes the connection portion 690. The portion of the article 664 connecting to the connection portion 690 is configured to exert a reactive force F2 on the engagement member 620. In contrast to the example described above, the portion of the article 664 is not a longitudinal strap in this example but is instead a transverse strap that is substantially perpendicular to F1. However, a longitudinal orientation can be used in accordance with other embodiments of the connection portion 690. Due to the structural nature (e.g. transverse orientation) of the portion of the article 664, the force F2 can be a tensile force or a compressive force. Thus, F2 can resist any force applied on the connection portion 639R/L. However, F2 is shown as a tensile force that would be applied to the connection portion 690 in response to the buckle 100 being placed in tension. For purposes of orientation and description of the buckle 600 herein, the furthermost side of the engagement member 620 in the direction of force F2 is designated as the rear portion or end 623. The furthermost side of the engagement member 620 opposite the direction of force F2 is the front portion or end 621. It should be understood, however, that regardless of the direction of force F2, the connection portion 690 may be located along any portion of the engagement member 640 including the front, middle, or rear portion. But, by way of example, the connection portion 690 is shown here as a slot 694 formed in the base plate 624 with a beam extending there through so that the strap 664 can thread through the smaller slots formed on either side of the beam 692.

In accordance with various embodiments, the buckle 600 is configured such that the engagement member 620 and the engagement member 640 engage with one another along their rear portions. To further clarify, the buckle 600 is configured to be placed in tension by tensile forces F1 and F2 and the engagement member 620 and the engagement member 640 engage with one another in the direction of these forces and disengage with one another in the opposite direction as these forces. Thus, in response to the buckle 600 being placed in tension, the engagement member 620 and the engagement member 640 have a tendency to be pulled into engagement as opposed to being pulled apart. In order to separate the engagement member 620 and the engagement member 640, tensile forces F1 and F2 must be overcome to create the separation.

As illustrated in FIGS. 6A-6K, engagement member 620 may be a receiving member and engagement member 640 may be a plug member. The receiving member 620 may be suitable to receive the plug member 640 therein. The connecting of the two parts occurs by pulling the male plug member into the female holster member from the back edge of the female holster member. The releasing of the buckle occurs by sliding the plug member out of the back of the receiving member.

In accordance with various embodiments, the receiving member 620 includes a receiving channel 627 along the rear portion suitable to engage and receive the plug member 640 therein. Accordingly, the connection portion 642 may extend toward or out of the front portion 621 of the receiving member 620 such that article portion 662 can extend from the front portion 621 of the receiving member in the direction of F1 and apply a force in that direction.

The receiving channel 627 may include a base plate 624, one or more walls (e.g. 629L/R), and a top plate (e.g. 635 L/R). The receiving channel 627 may be formed between the base plate 624 and the top plate (e.g. 635 L/R). The walls may connect the base plate 624 and the top plate (e.g. 635 L/R) and/or provide lateral guidance for the plug 640 into the receiving channel 627.

The receiving member 620 may also include an alignment channel 626. The alignment channel 626 may be structured to form a path to guide the plug 640 along the receiving member 620 until the two are engaged. Examples of a straight path are shown, but other paths could also be included. In accordance with one embodiment, the alignment channel 126 may be defined by a separation in the receiving channel 627 forming separate sides of the receiving channel. For example, one side of the receiving channel 627 may include a base plate 624, a wall 629R and a top plate 635R. This side of the receiving channel 627 is formed between the base plate 624 and the top plate 635R. The wall 629R connects the base plate 624 and the top plate 635R. An opposing structure also can be provided. For example, the other side of the receiving channel 627 may include a base plate 624, a wall 629L and a top plate 635L. This side of the receiving channel 627 is formed between the base plate 624 and the top plate 635L. The wall 629L connects the base plate 624 and the top plate 635L. Accordingly, the base plate 624 connects the separate walls 629R and 629L, the space between the top plates 635R and 635L define the alignment channel 626 and the space between the top plates and the base plate define the receiving channel.

The receiving channel may include receiving ledges 622L and 622R that are spaced above the base plate 624. This allows the connection portion 642 to rest on base plate 624 within an alignment channel 626. The contact points between these members assist in aligning the plug member 640 within receiving member 620 to allow the user to clip the buckle.

The plug member 640 may include one or more features that engage with one or more features of the receiving member 620. For example, the body portion 641 may be sized and shaped to be securely received within the receiving channel 627. In another example, the connection portion 642 may be sized and shaped to be securely guided by the alignment channel.

In accordance with one embodiment, the connection portion 642 is a trestle having two side plates 652R and 652L with one or more bars extending there between. The side plates 652R and 652L may be attached to the rear portion 645 of the plug member 640. The side plates 652R and 652L may also be spaced apart such that they are about the same width as the alignment channel 626 but sufficiently smaller to still be able to slide easily within the alignment channel 626. The bars extending between the side plates 652R and 652L may be connected to the article portion 662. In a particular example, the article portion 662 is a strap that extends to the larger article (e.g. a bag). The body portion may have a H1 that is approximately the same as the height H2 between the base plate 624 and the top plate (e.g. 635R/L) but still be sufficiently smaller to slide between the base plate 624 and the top plate (e.g. 635R/L).

In accordance with various embodiments, the engagement between the plug member 640 and the receiving member 620 may include a securing mechanism to limit separation. The securing mechanism can include detents, latches, locks, pins or any other mechanism that can limit or prevent separation of the plug member 640 and the receiving member 620 until desired. For example, a detent can securely engage the plug member 640 and the receiving member 620. In such an example, one or more portions of the plug member 640 may be flexible and one or more portions of the receiving member 620 may be sufficiently rigid such that when the two members are engaged, the plug member 640 flexes to accomplish the engagement but then retains its shape or at least tries to retain its shape in order to hold the engagement. For example, the body portion 641 of the plug member may include one or more flexible arms (e.g. 646 L/R). The arms can collapse toward one another in the direction of the arrows shown at C. The collapse allows the width of the body portion 641 to be narrowed. The flexible arms (e.g. 646 L/R) may include one or more protrusions (e.g. 644L/R) extending from each side. In some embodiments, the flexible arms (e.g. 646 L/R) may be cantilever beams extending from the connection portion 642 with the protrusion (e.g. 644L/R) extending laterally out to the exterior. The protrusions (e.g. 644L/R) may be configured to engage in corresponding features within the receiving channel 627. The forward end of the plug member 640 may have a cord 653 threaded through holes in the opposing arms (e.g. 646 L/R). The cord 653 may be bundled by tab 655 to form a pulling device. By pulling on the cord 653 or tab 655 and placing the plug 140 in tension with a pull force in the PF direction shown in FIGS. 6A-6D, the cord 653 can force the arms (e.g. 646 L/R) to collapse in the direction C.

In accordance with various embodiments, the receiving member 620 may include a feature that corresponds to and receives the protrusions (e.g. 644L/R). For example, the receiving channel 627 may have a corresponding dimple 630R/L position in side walls 629R/L configured to engage the protrusions (e.g. 644L/R) as the plug member 640 is engaged within the receiving member 620. Thus, as the plug is pulled/pushed into the receiving channel the protrusions (e.g. 644L/R) cause the arms (e.g. 646 L/R) to collapse inwardly along C so that the arms and the protrusions can slide along the receiving channel 627. The dimples 630R/L receive the protrusion (e.g. 644L/R) therein, securely engaging the plug 640 within the receiving member 620.

In accordance with various embodiments, the receiving channel 627 may form an end stop portion (e.g. 632R/L)

proximal to the front portion 621 of the receiving member 620. The end stop portion (e.g. 632R/L) may limit or prevent the plug member 640 from pulling through the receiving channel 627 or alignment channel 626. The end stop portion (e.g. 632R/L) may engage with forward surfaces 648R/L of the arms (e.g. 646 L/R) of the plug 640. An end stop portion 632R and 632L, respectively on each side of the receiving channel 627, may contact the forward surfaces 648R/L thereby limiting or preventing any additional movement of the plug member 640 through the receiving member 620.

Figure 6A:
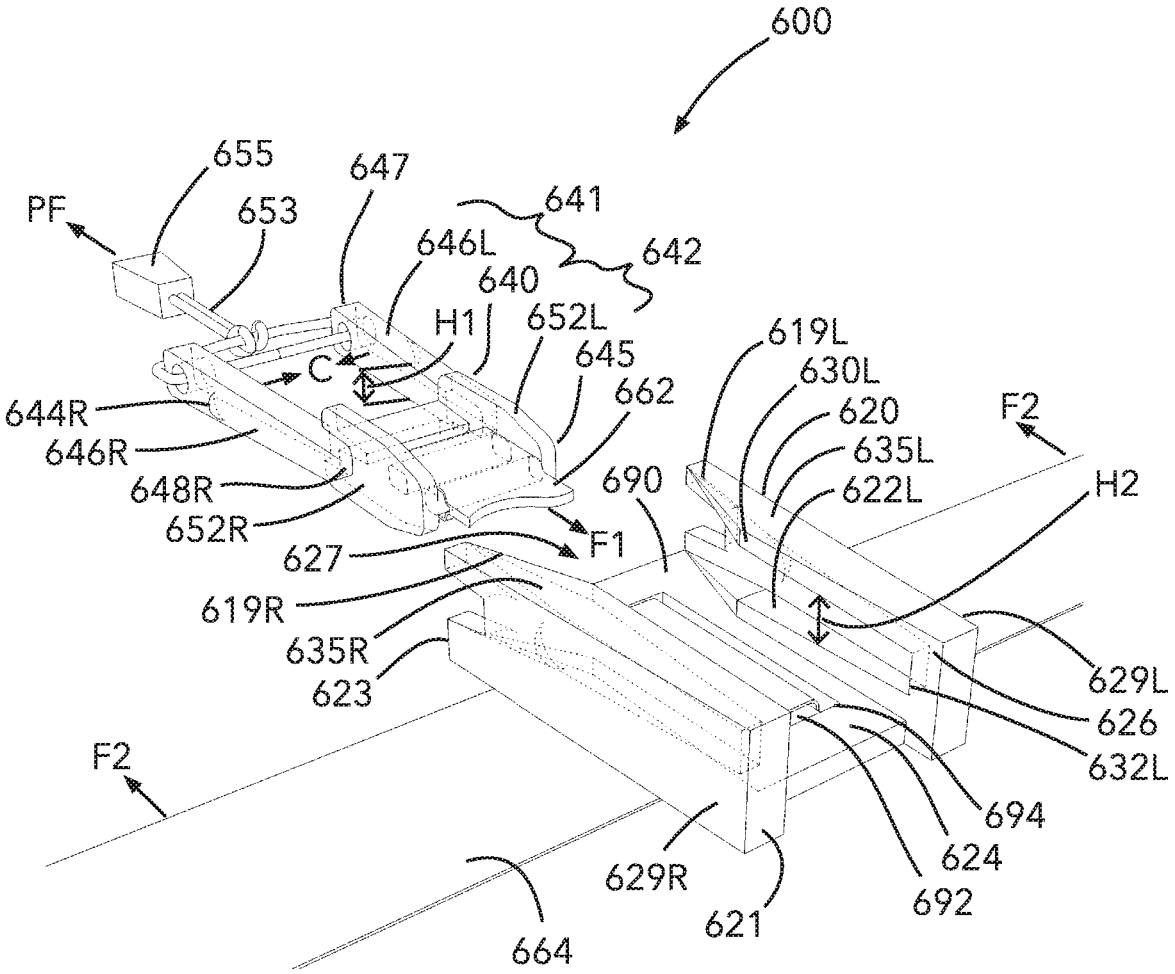
FIG. 6A is a perspective view of an unconnected buckle in accordance with an embodiment.
Figure 6B:
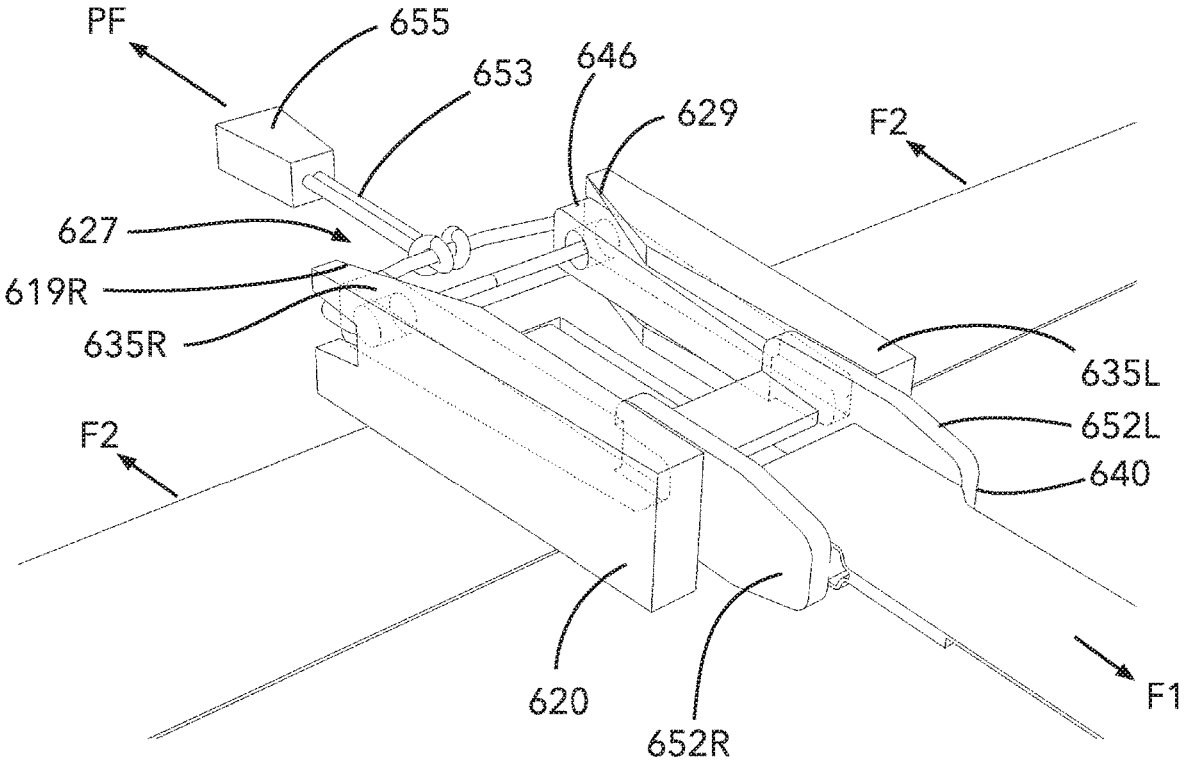
FIG. 6B is a perspective view of the connected buckle as shown in FIG. 6A.
Figure 6C:
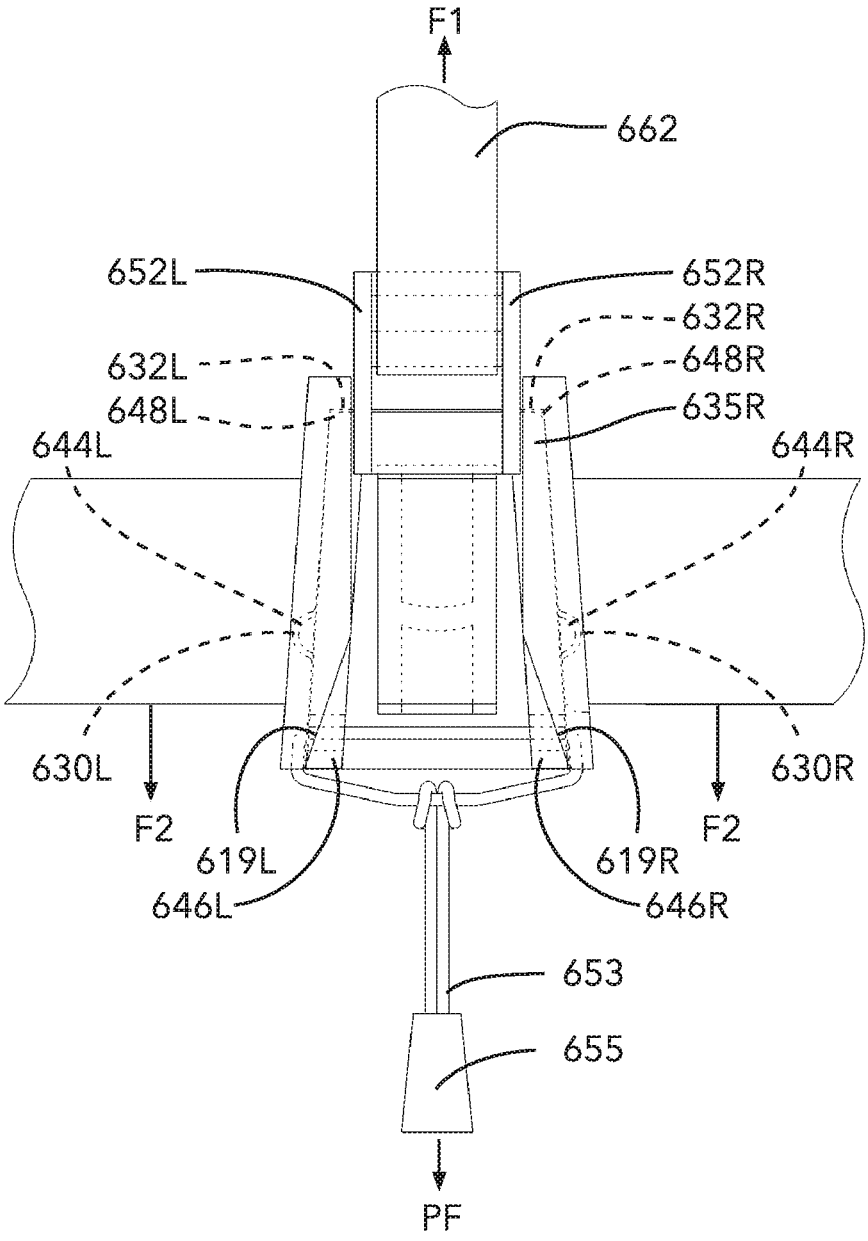
FIG. 6C is a top view of the buckle as shown in FIG. 6A unconnected.
Figure 6D:
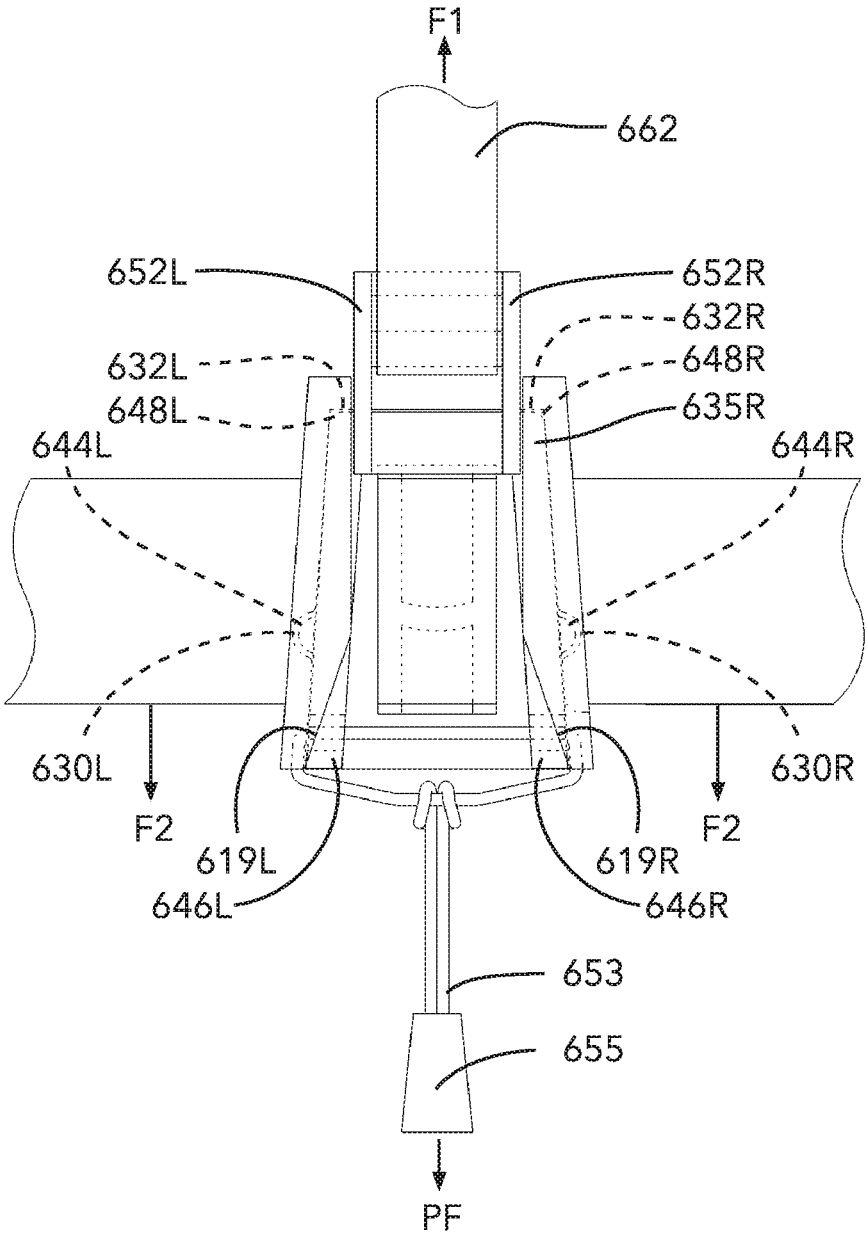
FIG. 6D is a top view of the buckle as shown in FIG. 6A connected.
Figure 6E:
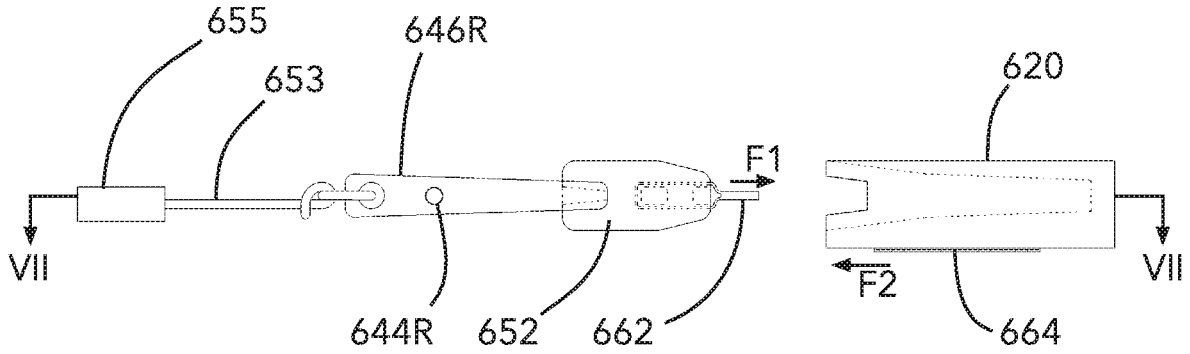
FIG. 6E is a side view of the buckle as shown in FIG. 6A unconnected.
Figure 6F:
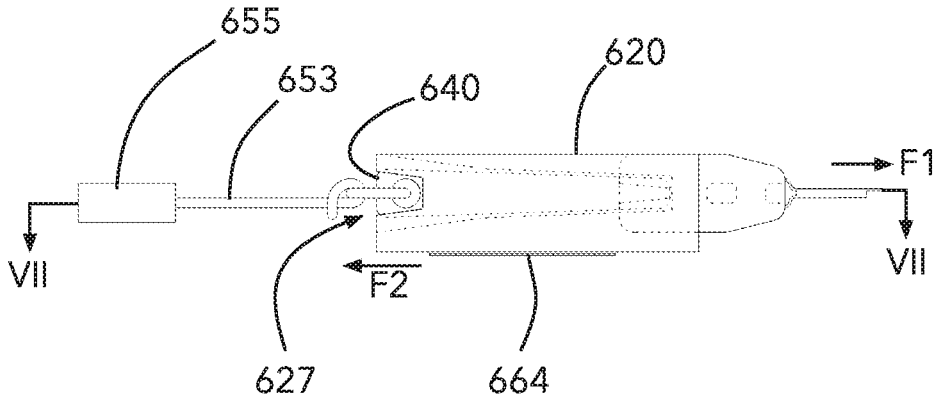
FIG. 6F is a side view of the buckle as shown in FIG. 6A connected.
Figure 6G:
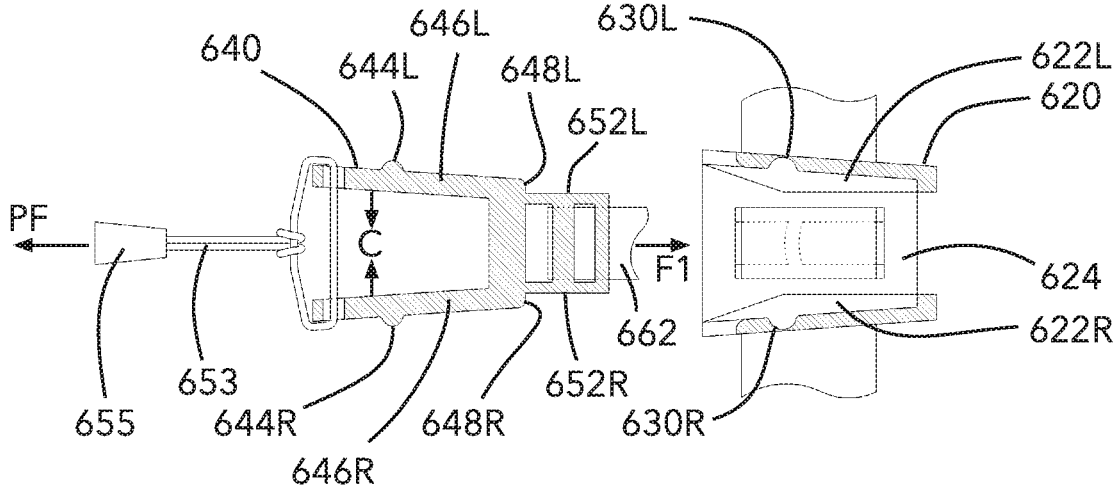
FIG. 6G is cross-sectional top views of the buckle taken along the section line VII-VII shown in FIG. 6E.
Figure 6H:
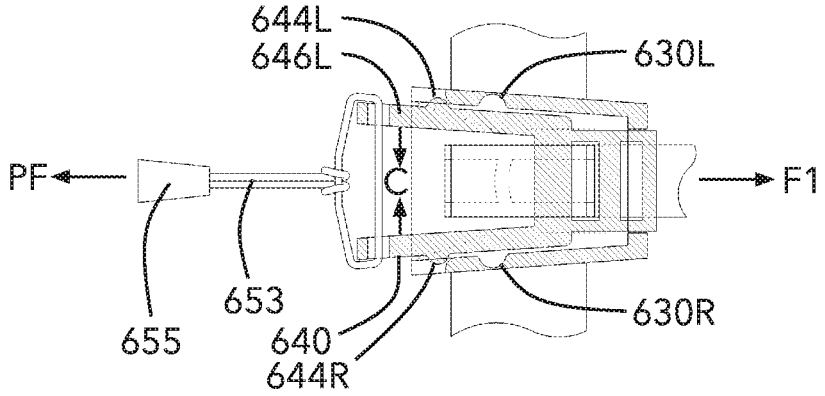
FIGS. 6H-6I are cross-sectional top views of the buckle as shown in FIG. 6A at intermediate steps between those shown in FIGS. 6G and 6J.
Figure 6I:
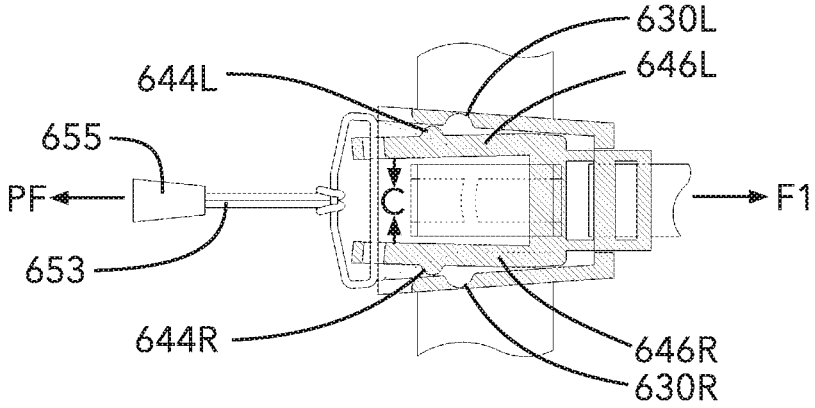
Figure 6J:
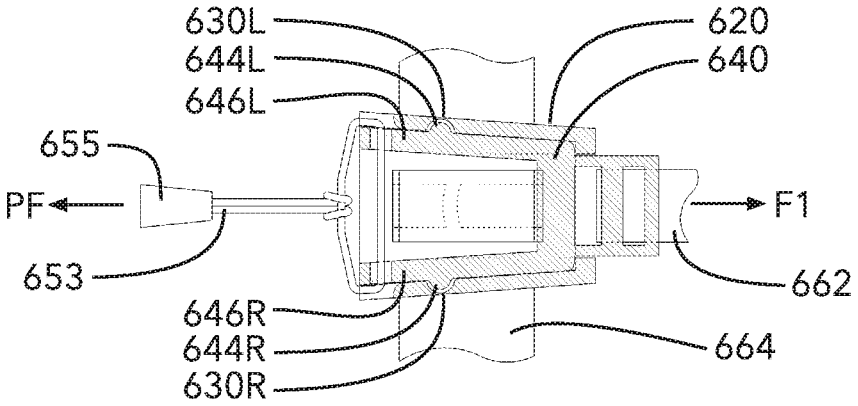
FIG. 6J is cross-sectional top views of the buckle taken along the section line VIII-VIII shown in FIG. 6F.
Figure 6K:
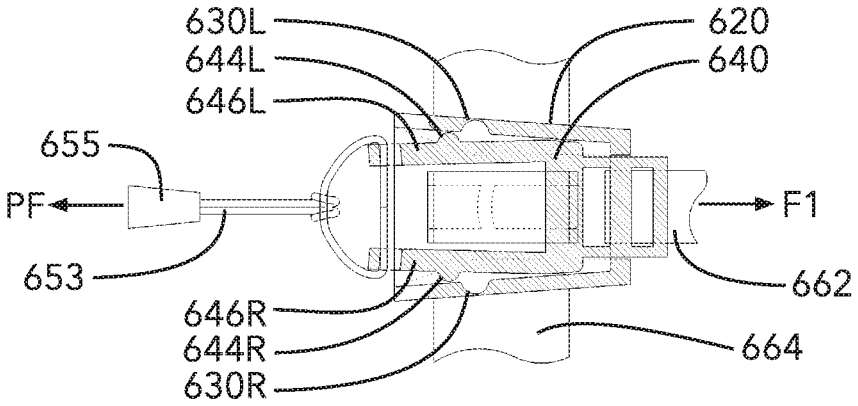
FIG. 6K is cross-sectional top views of the buckle as it is being disconnected from the position shown in FIG. 6J.

The plug member 640 is attached to article portion 662 and the receiving portion is attached to article 664 such that the article portions 662 and 664 have a tendency to pull away from one another or there is a reason to place a tensioning force between the two. As shown in FIG. 6G, the plug member 640 is pulled past the receiving member 620 such that the article portion 662 does or would have a tendency to pull the plug member 640 toward the receiving member 620 if the article portion 662 was placed in tension. To perform the clipping action, the body portion 641 of the plug 640 is set on the base plate 624 of the receiving member 620 with the connection portion 642 in the alignment channel 626 of the receiving member 620. Subsequently, the connection portion 642 or strap is pulled toward the receiving member 620 (specifically into the rear portion 623 in the direction of F1) to seat the plug member 640 in the receiving member 620. The mouth has a width W2 and the plug has a width W1. W2 is less than W1 in a relaxed state. W1 is about the same as or less than W2 when the arms are collapsed. By providing sufficient force to deform the plug member 640 so that the protrusions 644R and 644L can enter the mouth (here being the narrowest point of the channel before the notches of the receiving channel 627, the protrusions 644R and 644L can engage the respective dimples 630R and 630L. In doing so, the detent is set, thus clipping the two members together. To separate the plug 640 from the receiving member 620, force is applied to the body portion 641 of the plug member 640 in a direction away from the connection portion 642. The force may be applied to the tab 655 causing the arms to collapse and the plug member 640 to be extracted.

FIGS. 7A-7K show various views of an embodiment of a buckle 700 having opposing engagement members 720, 740. In the examples shown, the engagement members 720, 740 include a female receiving member 720 and a male plug member 740. Unlike the other embodiments discussed herein, the embodiment illustrated by buckle 700 includes a plug member 740 that is relatively inflexible compared to a more flexible receiving member 720. Thus, as the receiving member receives the plug member the receiving member 720 flexes to receive the male member protrusion forming the detent. Similar to the embodiment discussed above, the bottom of receiving member 720 includes a base plate 724 and alignment channel 726. The embodiments shown in the examples provided in FIGS. 7A-7K also include alternative features for the plug member 740 as it is received into alternative features of receiving member 720.

Consistent with other embodiments provided herein, engagement member 720 includes a connection portion 739R and 739L. Engagement member 740 includes connection portion 742. The portion of the article 762 connecting to the connection portion 742 is configured to exert a reactive force F1 on the engagement member 740. In embodiments in which the portion of the article 762 is a strap as shown in FIGS. 7A-7K, the force F1 is merely a tensile force. For purposes of orientation and description of the buckle 700 herein, the furthermost side of the engagement member 740 in the direction of force F1 is designated as the rear portion or end 745. The furthermost side of the engagement member 740 opposite the direction of force F1 is the front portion or end 747. It should be understood however, that regardless of the direction of force F1, the connection portion 742 may be located along any portion of the engagement member 740 including the front, middle, or rear portion. But, by way of example, the connection portion 742 is shown on the rear portion 745 of engagement member 740.

In another example, engagement member 720 includes the connection portion 739R/L. The portion of the article 764 connecting to the connection portion 739R/L is configured to exert a reactive force F2 on the engagement member 720. In contrast to the example, described above, the portion of the article 764 is not a longitudinal strap in this example but is instead a transverse strap that is substantially perpendicular to F1. However, a longitudinal orientation can be used in accordance with other embodiments of the connection portion 739R/L. Due to the structural nature (e.g. transverse orientation) of the portion of the article 664, the force F2 can be a tensile force or a compressive force. Thus, F2 can resist any force applied on the connection portion 739R/L. However, F2 is shown as a tensile force that would be applied to the connection portion 739R/L in response to the buckle 700 being placed in tension. For purposes of orientation and description of the buckle 700 herein, the furthermost side of the engagement member 720 in the direction of force F2 is designated as the rear portion 723. The furthermost side of the engagement member 720 opposite the direction of force F2 is the front portion or end 721. It should be understood however, that regardless of the direction of force F2, the connection portion 739R/L may be located along any portion of the engagement member 740 including the front, middle, or rear portion.

In accordance with various embodiments, the buckle 700 is configured such that the engagement member 720 and the engagement member 740 engage with one another along their rear portions. To further clarify, the buckle 700 is configured to be placed in tension by tensile forces F1 and F2 and the engagement member 720 and the engagement member 740 engage with one another in the direction of these forces and disengage with one another in the opposite direction as these forces. Thus, in response to the buckle 700 being placed in tension, the engagement member 720 and the engagement member 740 have a tendency to be pulled into engagement as opposed to being pulled apart. In order to separate the engagement member 720 and the engagement member 740, tensile forces F1 and F2 must be overcome to create the separation.

In accordance with various embodiments, the receiving member 720 includes a receiving channel 727 with an opening along the rear portion suitable to engage and receive the plug member 740 therein. Accordingly, the connection portion 742 may extend toward the front portion 721 of the receiving member 720 such that article portion 762 can extend from the front portion 721 of the receiving member in the direction of F1 and apply a force in that direction.

The receiving channel 727 may include a base plate 724, one or more walls (e.g. 729L/R), and a top plate (e.g. 735 L/R). The receiving channel 727 may be formed between the base plate 724 and the top plate (e.g. 735 L/R). The walls may connect the base plate 724 and the top plate (e.g. 735 L/R) and/or provide lateral guidance for the plug member 740 into the receiving channel 727.

The receiving member 720 may also include an alignment channel 726. The alignment channel 726 may be structured to form a path to guide the plug member 740 along the receiving member 720 until the two are engaged. Examples, of a straight path are shown, but other paths could also be included. In accordance with one embodiment, the alignment channel 726 may be defined by the interior surface of the top plate 735L/R. The receiving channel may include two sides. In this embodiment, the base plate may be separated into sides 124R and 124L by gap 719. One side of the receiving channel 727 may include a base plate 724R, a wall 729R and a top plate 735R. This side of the receiving channel 727 is formed between the base plate 724R and the top plate 735R. The wall 729R connects the base plate 724R and the top plate 735R. An opposing structure also can be provided. For example, the other side of the receiving channel 727 may include a base plate 724L, a wall 729L and a top plate 735L. This side of the receiving channel 727 is formed between the base plate 724L and the top plate 735L. The wall 729L connects the base plate 724 and the top plate 735L.

Figure 7A:
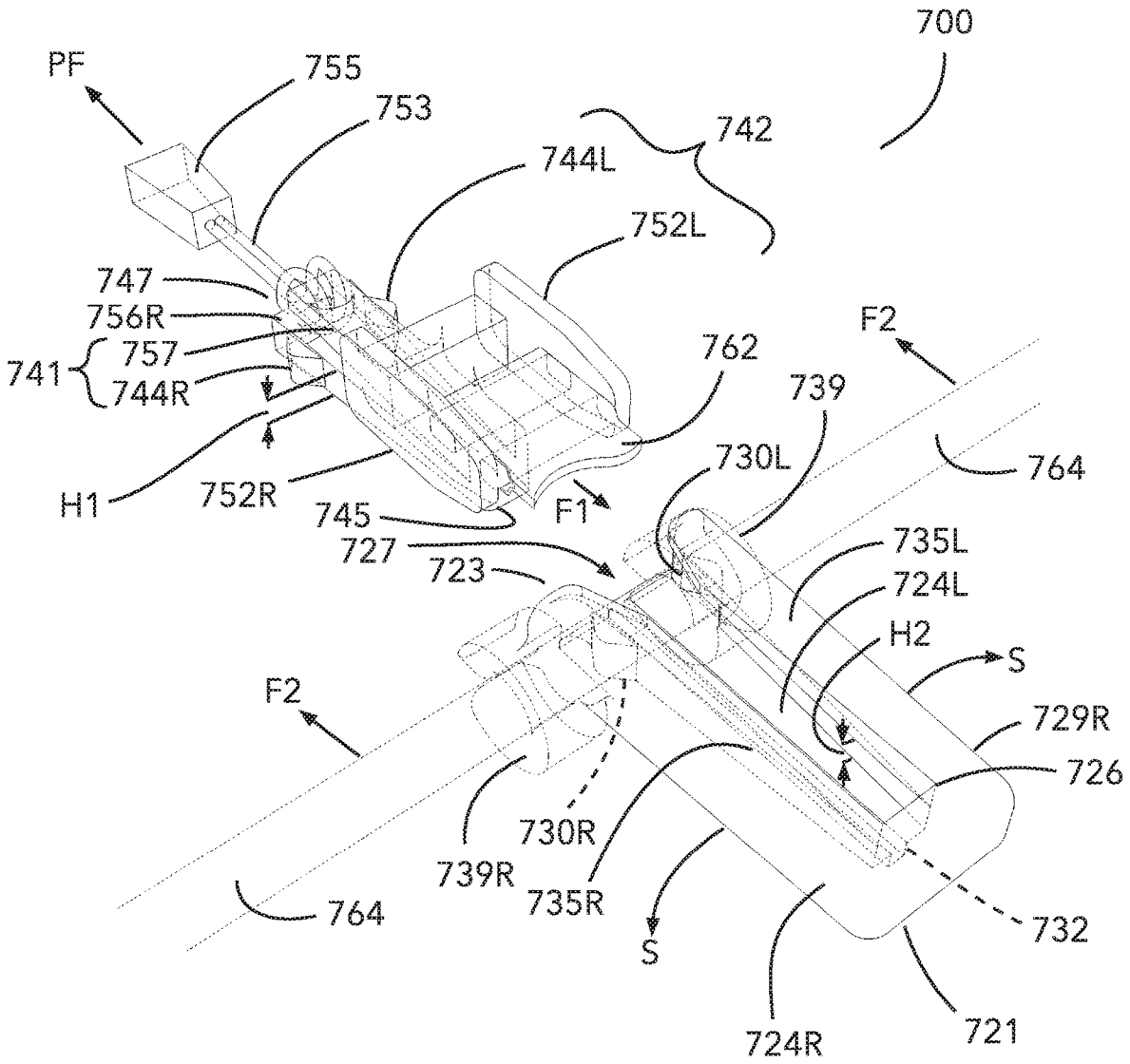
FIG. 7A is a perspective view of an unconnected buckle in accordance with an embodiment.
Figure 7B:
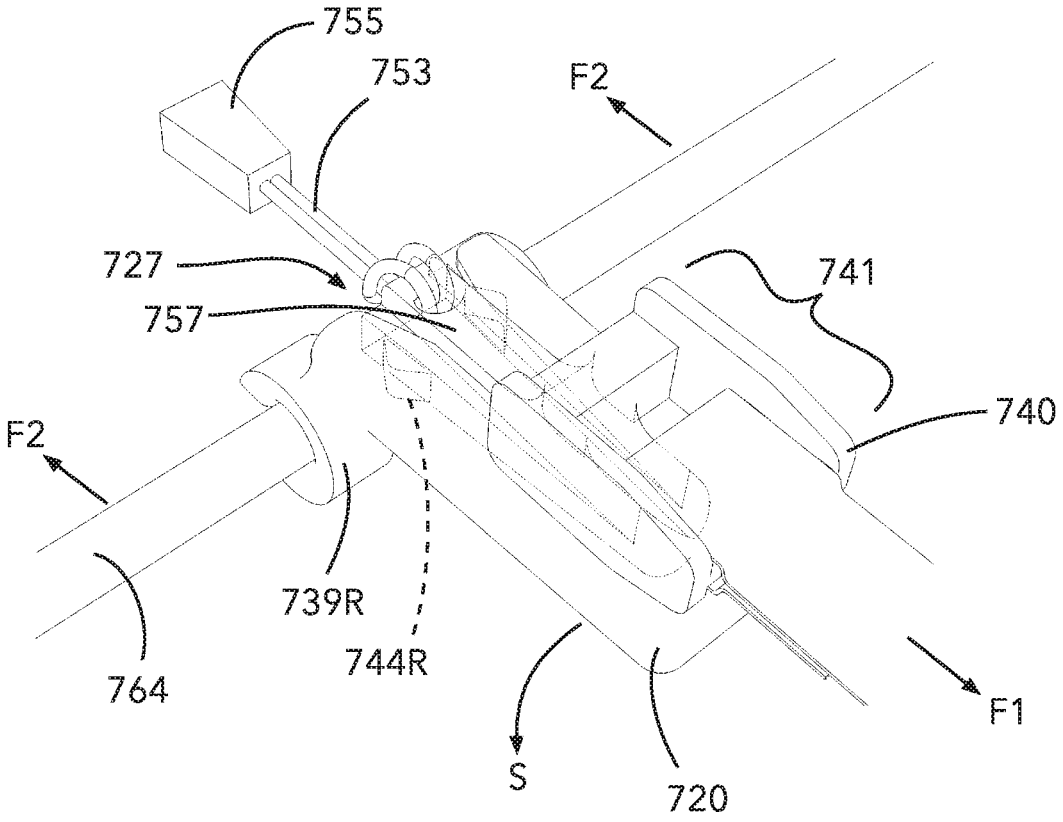
FIG. 7B is a perspective view of the connected buckle as shown in FIG. 7A.
Figure 7C:
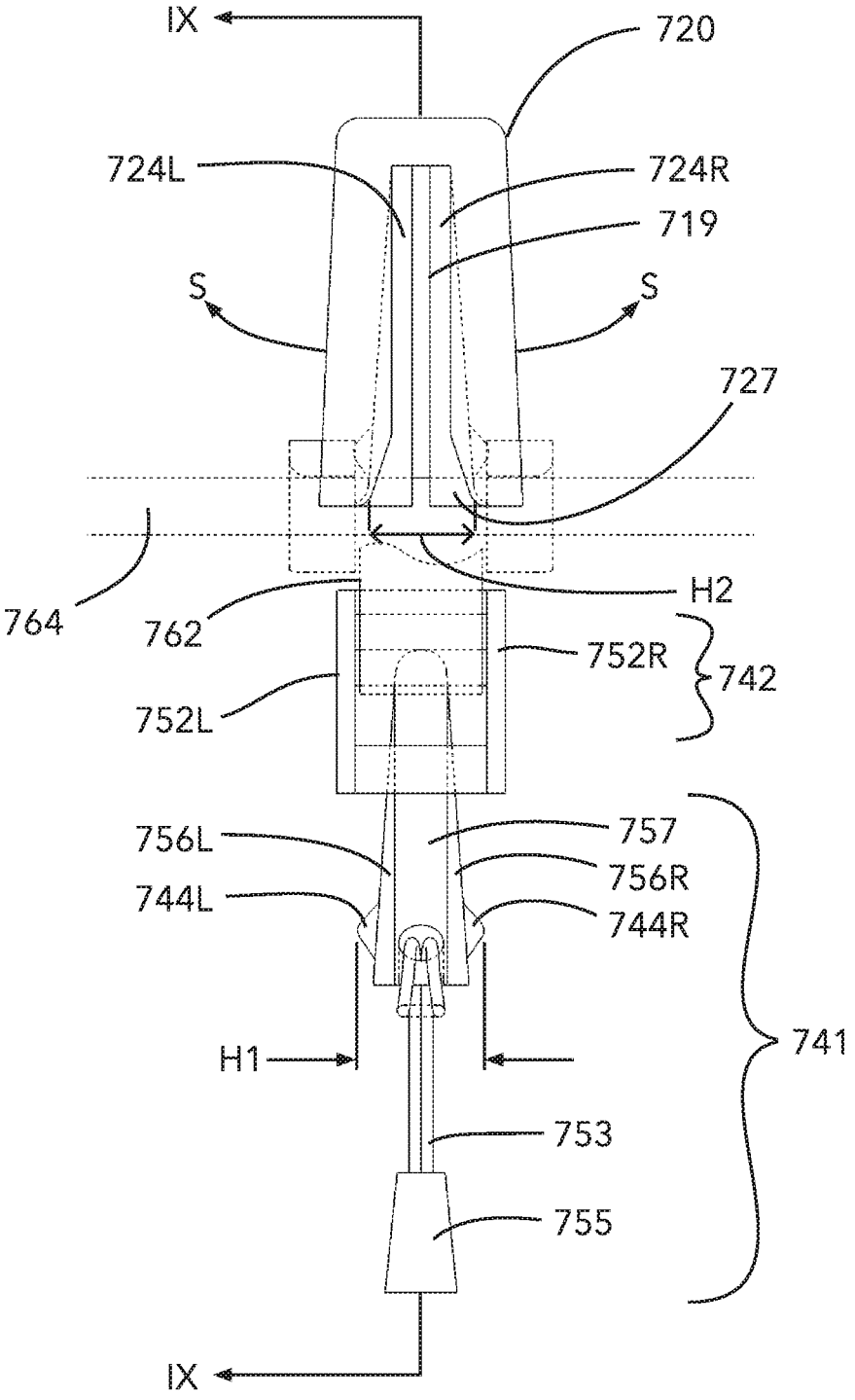
FIG. 7C is a top view of the buckle as shown in FIG. 7A unconnected.
Figure 7D:
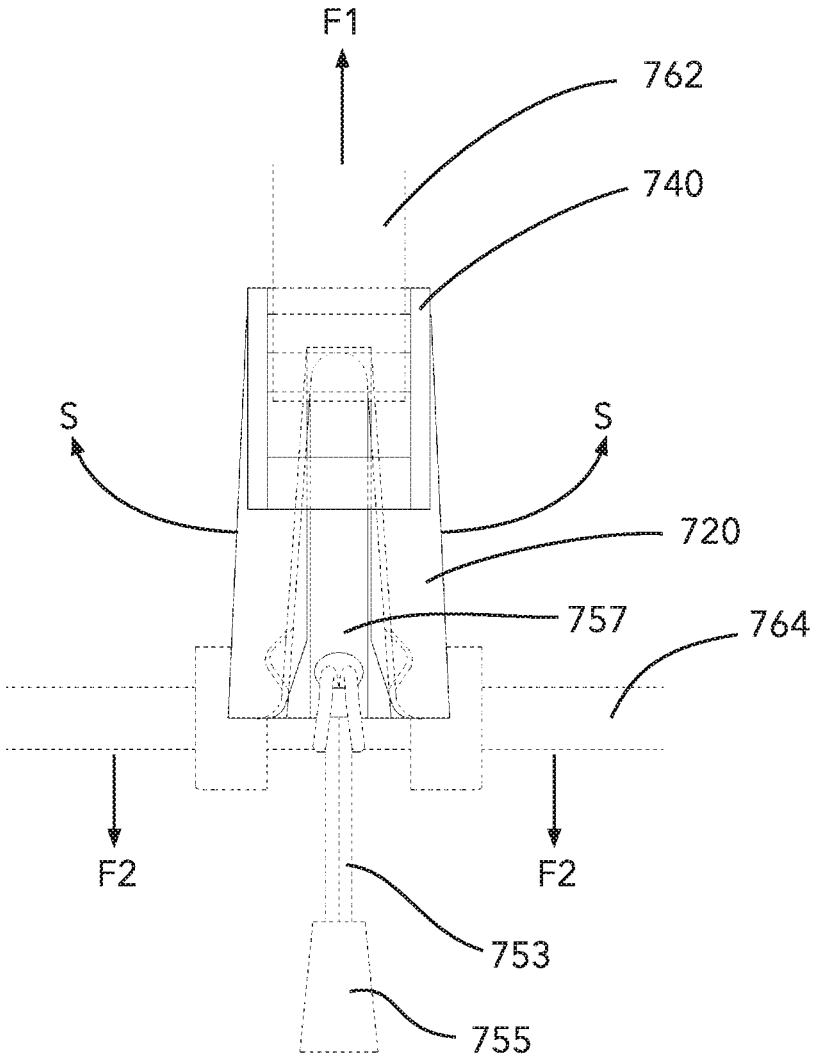
FIG. 7D is a top view of the buckle as shown in FIG. 7A connected.
Figure 7E:
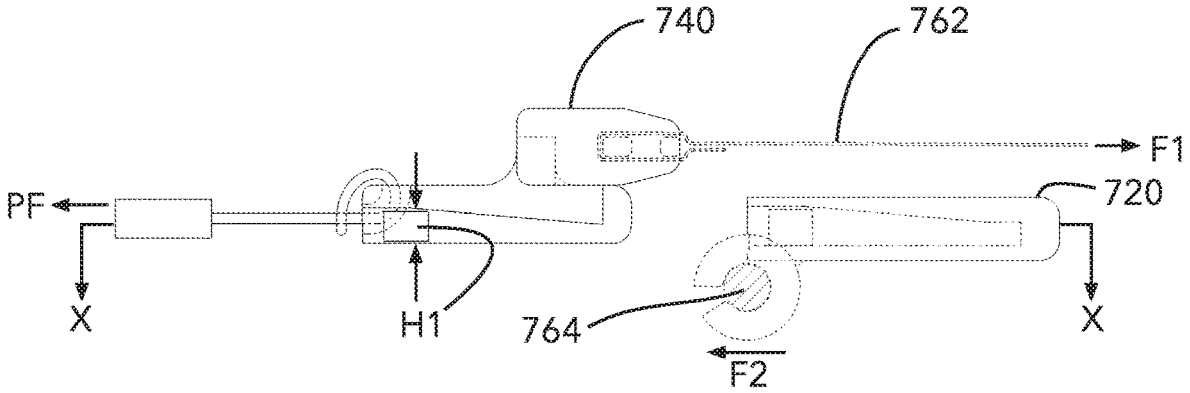
FIG. 7E is a side view of the buckle as shown in FIG. 7A unconnected.
Figure 7F:
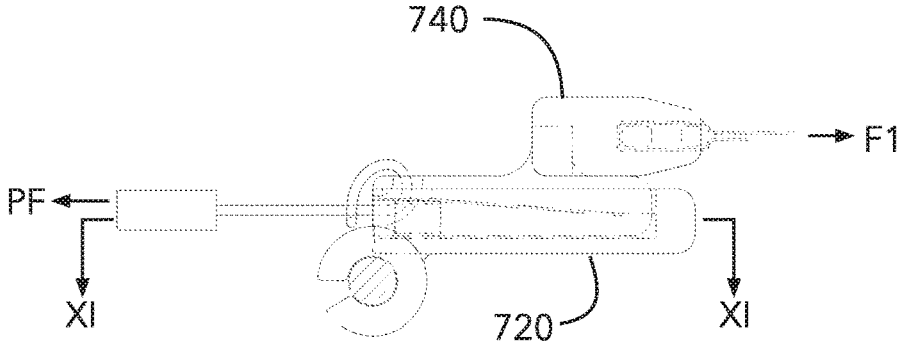
FIG. 7F is a side view of the buckle as shown in FIG. 7A connected.

The plug member 740 may include one or features that engage with one or more features of the receiving member 720. For example, the body portion 741 may be sized and shaped to be securely received within the receiving channel 727. In accordance with this embodiment, the body portion 741 may include a longitudinal protrusion along its length that is sized and shaped to be securely guided by the alignment channel 726. As shown in FIG. 7F, the connection portion 742 may extend from the top of the body portion 741 such that as the plug member 740 is received within the receiving member 720, the connection portion 742 is positioned outside of and above the receiving channel 727.

In accordance with one embodiment, the connection portion 742 is a trestle having two side plates 752R and 752L with one or more bars extending therebetween. The side plates 6752R and 752L may be attached to the rear portion 745 of the plug member 740. The bars extending between the side plates 752R and 752L may be connected to the article portion 762. In a particular example, the article portion 762 is a strap that extends to the larger article (e.g. a bag). The body portion 741 may have lateral protrusions 756L/R that are a height H1 that is approximately the same as the height H2 between the base plate 724R/L and the top plate 735R/L The protrusions 756R/L is still sufficiently smaller to slide between the base plate 724 and the top plate (e.g. 735R/L). The protrusions 756R/L may also have a variable height. For example, the protrusions 756R/L may taper down toward the rear 745 of the plug member 740. The taper may allow for easier engagement into the receiving channel 727.

In accordance with various embodiments, the engagement between the plug member 740 and the receiving member 720 may include a securing mechanism to limit separation. The securing mechanism can include detents, latches, locks, pins or any other mechanism that can limit or prevent separation of the plug member 740 and the receiving member 720 until desired. For example, a detent can securely engage the plug member 740 and the receiving member 720. In such an example, one or more portions of the receiving member 720 may be flexible and one or more portions of the plug member 740 may be sufficiently ridged that when the two members are engaged, the receiving member 720 flexes to accomplish the engagement but then retains its shape or at least tries to retain its shape in order to hold the engagement. For example, the gap 719 that separates portions of the base plate 724L and 724R along with the separation in the top plates by the alignment channel allow the receiving member 720 to flex outwardly along S shown in FIGS. 7A and 7C. The separation S allows the width of the receiving ember 720 to be widened. The plug member 740 may include one or more protrusions (e.g. 744L/R) extending from each side. The protrusion (e.g. 744L/R) extend laterally out to the exterior. The protrusions (e.g. 744L/R) may be configured to engage in corresponding features within the receiving channel 727. In accordance with various embodiments, the receiving member 720 may include a feature that corresponds to and receives the protrusions (e.g. 744L/R). For example, the receiving channel 727 may have a corresponding notch 730R/L position in side walls 729R/L. The notch 730R/L is configured to engage the protrusions (e.g. 744L/R) as the plug member 740 is engaged within the receiving member 720. Thus, as the plug is pull/pushed into the receiving channel the protrusions (e.g. 644L/R) cause the lateral sides of the receiving member 720 to separate outwardly along S so that the plug member 740 and the protrusions (e.g. 744L/R) can slide along the receiving channel 727. The notch 730R/L receives the protrusion 744L/R therein securely engaging the plug member 740 within the receiving member 620.

The forward end 747 of the plug member 740 may have a cord 753 threaded through holes. The cord 753 may be bundled by tab 755 to form a pulling device. By pulling on the cord 753 or tab 755 and placing the plug member 740 in tension with a pull force in the PF direction shown in FIGS. 7A-7D, the cord 753 can force the lateral portions of the receiving member 720 to separate in the direction S.

In accordance with various embodiments, the receiving channel 727 may be entirely closed proximal to the front end 721. The closure may form an end stop portion. The end stop may limit or prevent the plug member 740 from pulling through the receiving channel 727 or alignment channel 726. The end stop portion may engage with forward surface 748 of the plug member 740. In various embodiments, the end stop portion may be a fixed stop.

Figure 7G:
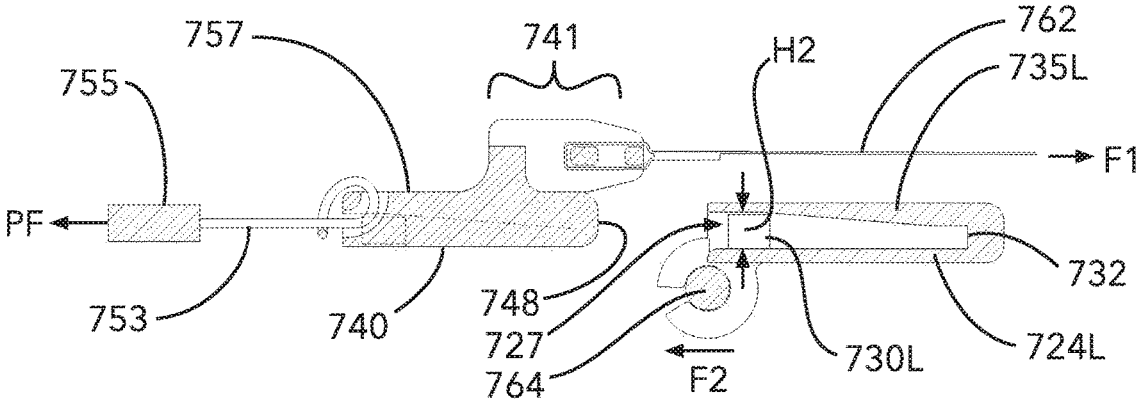
FIG. 7G is cross-sectional side views of the buckle taken along the section line IX-IX shown in FIG. 7C.
Figure 7H:
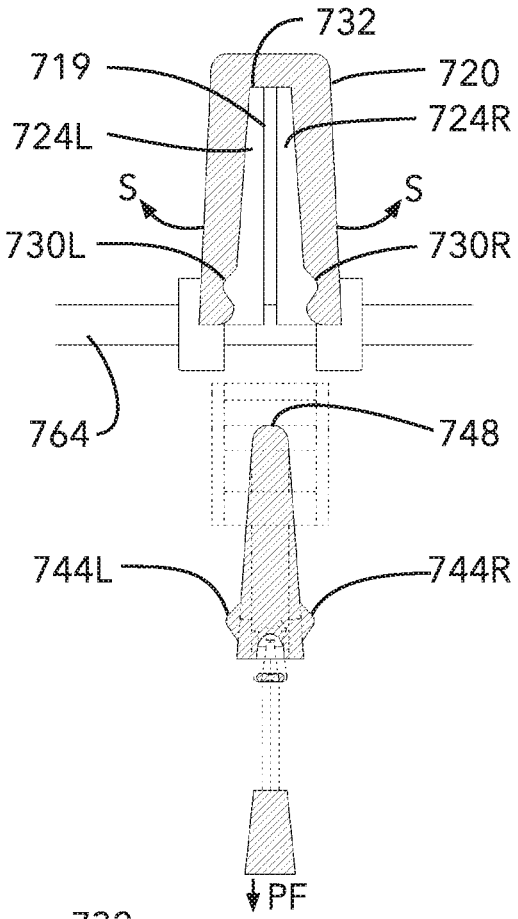
FIG. 7H is cross-sectional top views of the buckle taken along the section line X-X shown in FIG. 7E unconnected.
Figure 7I:
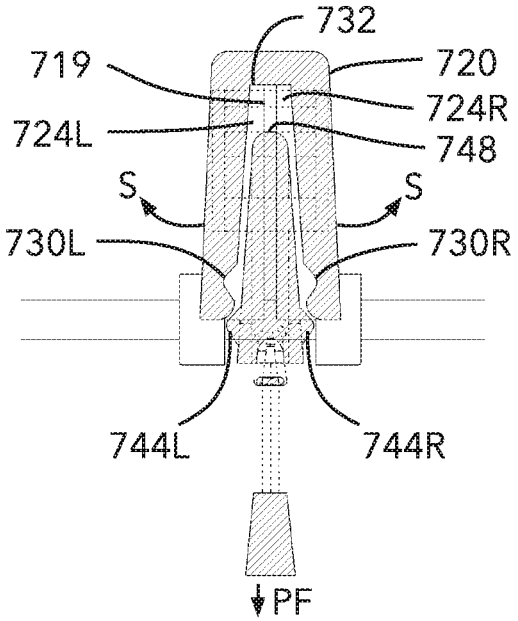
FIGS. 7I-7J are cross-sectional top views of the buckle as shown in FIG. 7A at intermediate steps between those shown in FIGS. 7H and 7K.
Figure 7J:
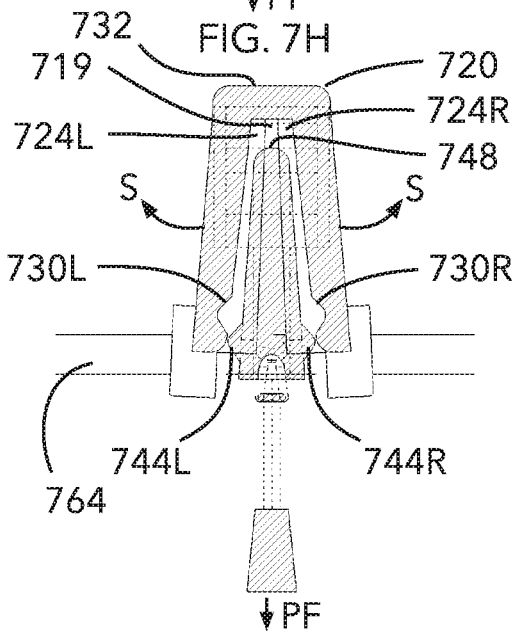
Figure 7K:
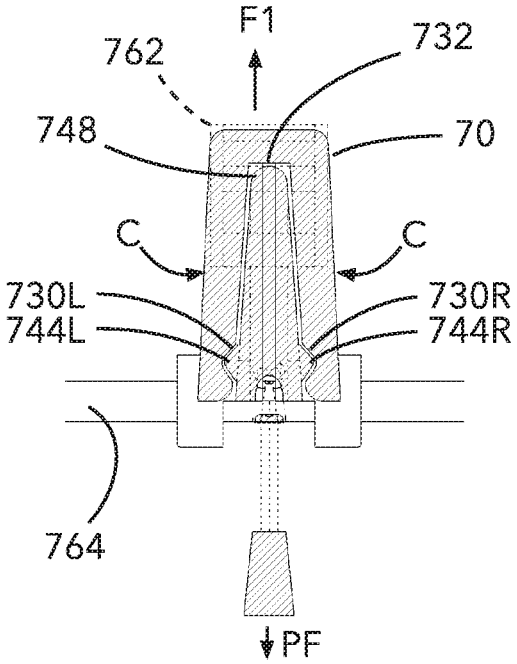
FIG. 7K is cross-sectional top views of the buckle taken along the section line XI-XI shown in FIG. 7F connected.
Figure 8A:
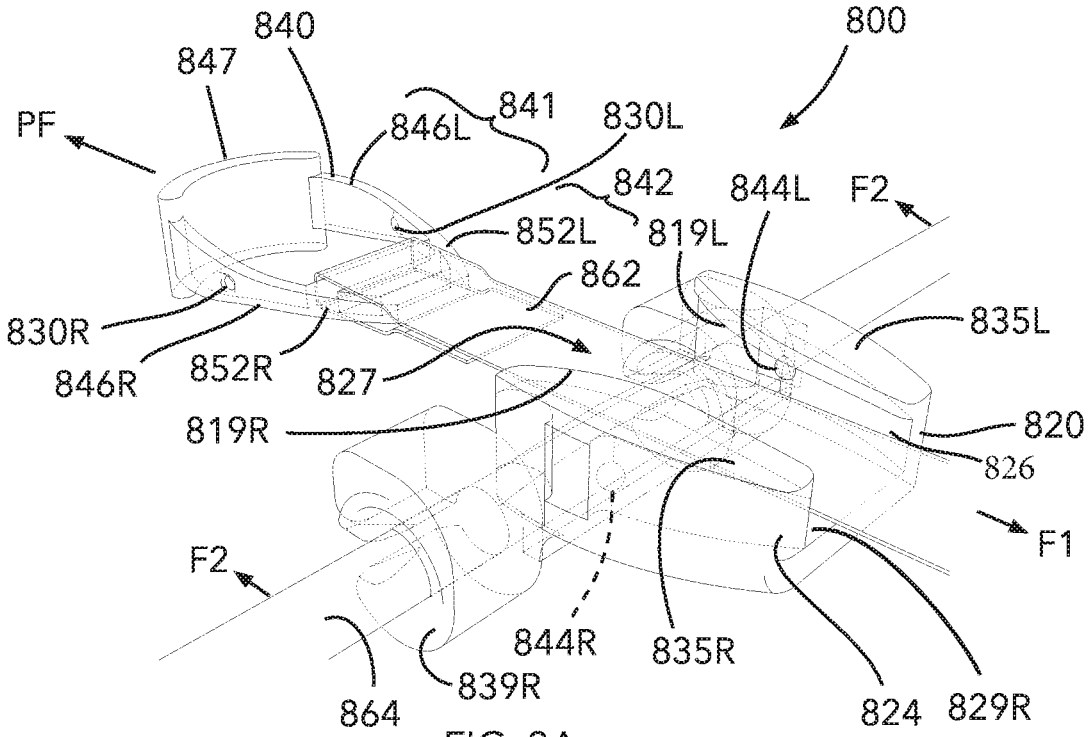
FIG. 8A is a perspective view of an unconnected buckle in accordance with an embodiment.
Figure 8B:
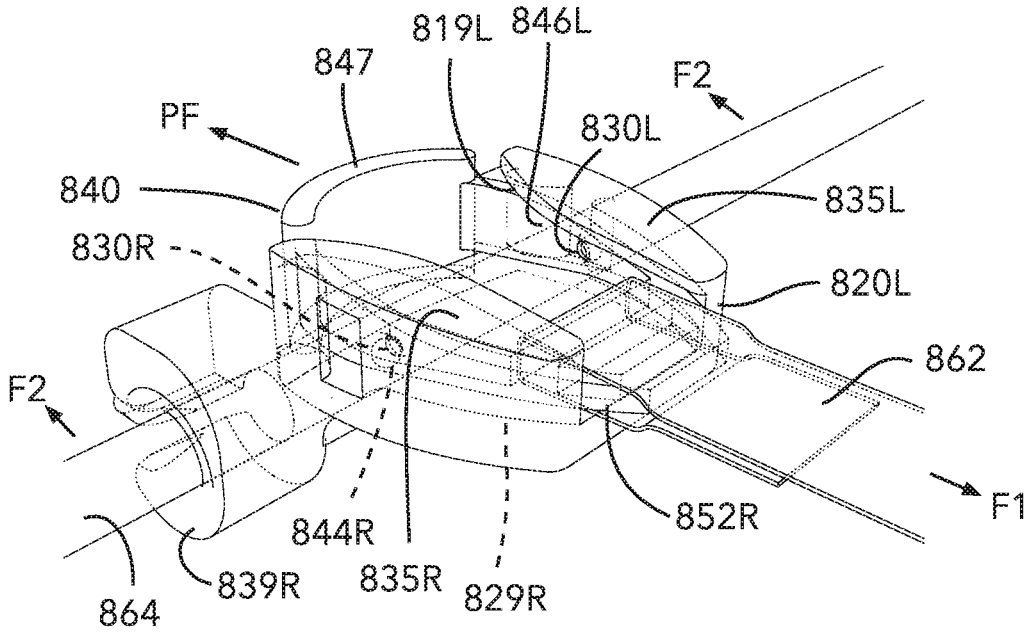
FIG. 8B is a perspective view of the connected buckle in accordance with the embodiment as shown in FIG. 8A.
Figure 8C:
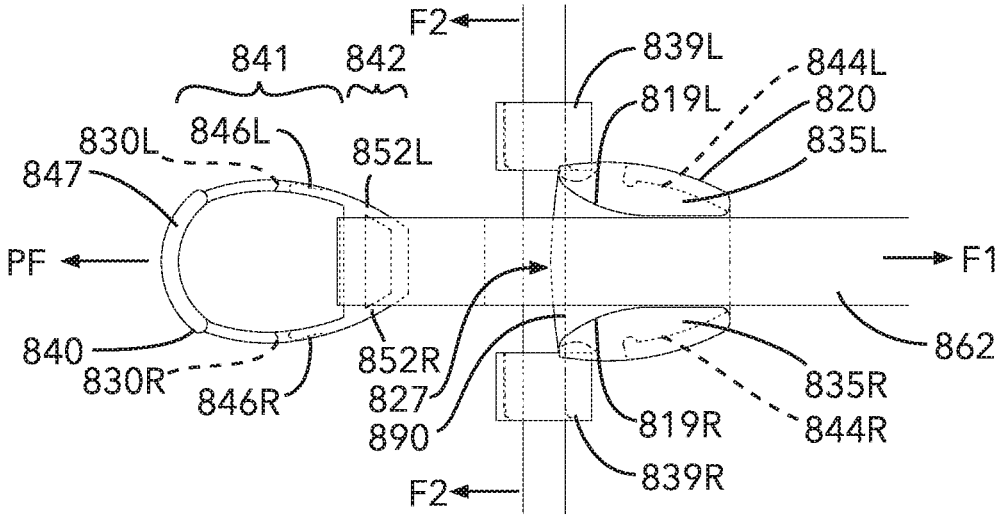
FIG. 8C is a top view of the buckle as shown in FIG. 8A unconnected.
Figure 8D:
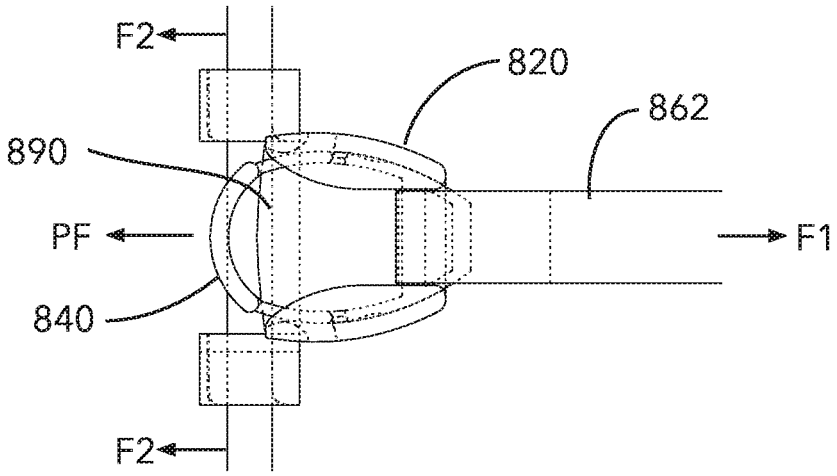
FIG. 8D is a top view of the buckle as shown in FIG. 8B connected.
Figure 8E:
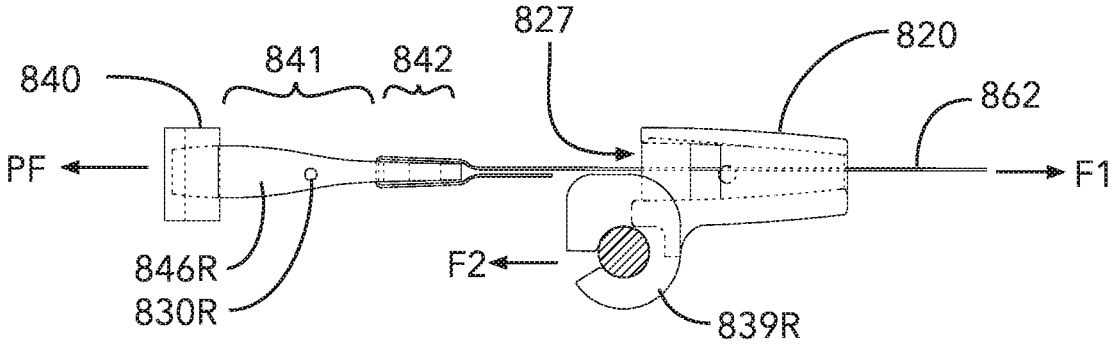
FIG. 8E is a side view of the buckle as shown in FIG. 8A unconnected.
Figure 8F:
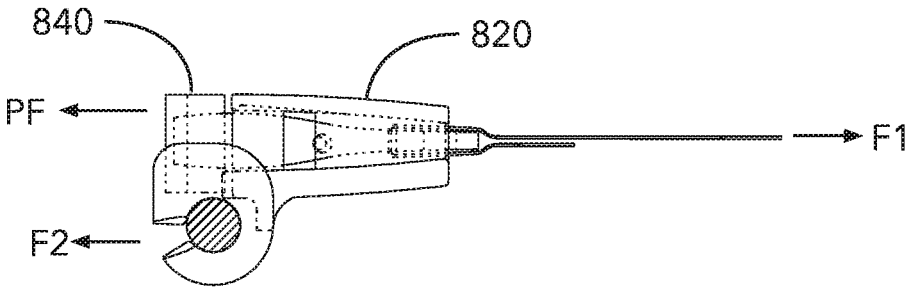
FIG. 8F is a side view of the buckle as shown in FIG. 8B connected.

The plug member 740 is attached to article portion 762 and the receiving portion is attached to article 764, such that the article portions 762 and 764 have a tendency to pull away from one another or if there is a reason to place a tensioning force between the two. As shown in FIGS. 7G and 7H, the plug member 740 is pulled past the receiving member 720 such that the article portion 762 does or would have a tendency to pull the plug member 740 toward the receiving member 720 if the article portion 762 was placed in tension. To perform the clipping action, the body portion 741 of the plug member 740 is set on the base plate 724 of the receiving member 720 with the connection portion 742 in the alignment channel 726 of the receiving member 720. Subsequently, the connection portion 742 or strap is pulled toward the receiving member 720 (specifically into the rear portion 723 in the direction of F1) to seat the plug member 740 in the receiving member 720. By providing sufficient force to deform the receiving member 740 so that the protrusions 744R and 744L can enter the mouth of the receiving channel 727, the protrusions 744R and 744L can engage the respective receiving features 730R and 730L (e.g. notches). In doing so the detent is set, thus clipping the two members together. To separate the plug member 740 from the receiving member 720, force is applied to the body portion 741 of the plug member 740 in a direction away from the connection portion 742. The force may be applied to the tab 755 causing the receiving member sides to separate and the plug member 740 to be extracted. In accordance with various embodiments, the mouth has a width W2 and the plug has a width W1. W2 is less than W1 when the plug member 740 is in a relaxed state. W1 is about the same as or less than W2 when the receiving member is in an expanded state.

FIG. 8A-8F show various views of an embodiment of a buckle 800 having opposing engagement members 820, 840. In the examples shown, the engagement members 820, 840 include a female receiving member 820 and a male plug member 840. Unlike the other embodiments discussed herein, the embodiment illustrated by buckle 800 includes a plug member 840 (e.g. having body 841 and connection portion 842) that is relatively inflexible compared to a more flexible receiving member 820. Thus, as the receiving member receives the plug member the receiving member 820 flexes to receive the male member protrusion forming the detent. Similar to the embodiment discussed above, the bottom of receiving member 820 includes a base plate 824 and alignment channel 826. The embodiments shown in the examples provided in FIGS. 8A-8F also include alternative features for the plug member 840 as it is received into alternative features of receiving member 820.

Consistent with other embodiments provided herein, engagement member 820 includes a connection portion 839R and 839L. Engagement member 840 includes connection portion 842. The portion of the article 862 connecting to the connection portion 842 (e.g. the arms 852R/L with the bars connecting there between) is configured to exert a reactive force F1 on the engagement member 840. In embodiments in which the portion of the article 862 is a strap as shown in FIGS. 8A-8F, the force F1 is merely a tensile force. For purposes of orientation and description of the buckle 800 herein, the furthermost side of the engagement member 840 in the direction of force F1 is designated as the rear portion or end. The furthermost side of the engagement member 740 opposite the direction of force F1 is the front portion or end 847. It should be understood however, that regardless of the direction of force F1, the connection portion 842 may be located along any portion of the engagement member 840 including the front, middle, or rear portion. But, by way of example, the connection portion 842 is shown on the rear portion of engagement member 840.

In another example, engagement member 820 includes the connection portion 839R/L. The portion of the article 864 connecting to the connection portion 839R/L is configured to exert a reactive force F2 on the engagement member 820. In contrast to the example, described above, the portion of the article 864 is not a longitudinal strap in this example but is instead a transverse strap that is substantially perpendicular to F1. However, a longitudinal orientation can be used in accordance with other embodiments of the connection portion 839R/L. Due to the structural nature (e.g. transverse orientation) of the portion of the article 864, the force F2 can be a tensile force or a compressive force. Thus, F2 can resist any force applied on the connection portion 839R/L. However, F2 is shown as a tensile force that would be applied to the connection portion 839R/L in response to the buckle 800 being placed in tension. For purposes of orientation and description of the buckle 800 herein, the furthermost side of the engagement member 820 in the direction of force F2 is designated as the rear portion. The furthermost side of the engagement member 820 opposite the direction of force F2 is the front portion or end.

In accordance with various embodiments, the buckle 800 is configured such that the engagement member 820 and the engagement member 840 engage with one another along their rear portions. To further clarify, the buckle 800 is configured to be placed in tension by tensile forces F1 and F2 and the engagement member 820 and the engagement member 840 engage with one another in the direction of these forces and disengage with one another in the opposite direction as these forces. Thus, in response to the buckle 800 being placed in tension, the engagement member 820 and the engagement member 840 have a tendency to be pulled into engagement as opposed to being pulled apart. In order to separate the engagement member 820 and the engagement member 840, tensile forces F1 and F2 must be overcome to create the separation. In accordance with various embodiments, the receiving member 820 includes a receiving channel 827 with an opening along the rear portion suitable to engage and receive the plug member 840 therein. Accordingly, the connection portion 842 may extend toward the front portion of the receiving member 820 such that article portion 862 can extend from the front portion of the receiving member in the direction of F1 and apply a force in that direction.

The receiving channel 827 may include a base plate 824, one or more walls (e.g. 829L/R), and a top plate (e.g. 835 L/R). The receiving channel 827 may be formed between the base plate 824 and the top plate (e.g. 835 L/R). The walls may connect the base plate 824 and the top plate (e.g. 835 L/R) and/or provide lateral guidance for the plug member 840 into the receiving channel 827.

The receiving member 820 may also include an alignment channel 826. The alignment channel 826 may be structured to form a path to guide the plug member 840 along the receiving member 820 until the two are engaged. Examples, of a straight path are shown, but other paths could also be included. The receiving channel may include two sides. In this embodiment, the base plate may be separated into sides 819R/L forming a gap there between. The gap may be sufficiently wide to allow the connection member 862 to pass through.

In accordance with various embodiments, the engagement between the plug member 840 and the receiving member 820 may include a securing mechanism to limit separation. The securing mechanism can include detents, latches, locks, pins or any other mechanism that can limit or prevent separation of the plug member 840 and the receiving member 820 until desired. For example, a detent can securely engage the plug member 840 and the receiving member 820. In such an example, one or more portions of the receiving member 820 or plug member 840 may be flexible and one or more portions of the opposing members e.g. plug member 840 or the receiving member 820 may be sufficiently ridged that when the two members are engaged, the member flexes to accomplish the engagement but then retains its shape or at least tries to retain its shape in order to hold the engagement. For example, the gap 819 that separates portions of the base plate along with the separation in the top plates by the alignment channel allow the receiving member 820 to flex outwardly. Alternatively the plug member 840 can compress along arms 846R/L to flex inwardly. The receiving member 840 may include one or more protrusions (e.g. 844L/R) extending from each side into the channel 827. The protrusions (e.g. 844L/R) may be configured to engage in corresponding features on the plug member 840. In accordance with various embodiments, the plug member 840 may include a feature that corresponds to and receives the protrusions (e.g. 844L/R). For example, the arms 846R/L may each (or at least one are may have) a corresponding receptacle 830R/L (e.g. an aperture, notch, or similar feature). The receptacle 830R/L receives the protrusion 844L/R therein securely engaging the plug member 840 within the receiving member 820. The gap may be sufficiently wide to allow the connection member 862 to pass through. In this embodiment, the opening to channel 827 may be the widest portion (excluding the protrusions 844R/L) that tapers to a narrower point. The body 841 of the plug 840 may have a similar shape that conforms to the taper. This minimizes the engagement and flex between the plug 840 and the receiving member 820 because the protrusion 844R/L against the arms 846R/L is the primary interference with engagement causing the flex mentioned above. The flex is minor until the protrusion 844R/L engages the receptacle 830R/L at which point the flex is reduced.

The various buckles described herein allow for numerous advantages over known buckles. For example, various embodiments provided herein allow for single handed or impaired operation. Meaning operation is possible with gloves, mittens, or other coverings on the hands. Additionally those with impaired function of hands or other physical limitations can operate the buckle. Additionally a clear view of the buckle is not required for successful operation. The operation of the buckle may be successfully performed by blind individuals. The buckle is mechanically simple to operate. The buckle has a non labor intensive manufacturing process. Operation of the buckle is quieter than typical side release buckles. Also, the tension placed on the buckle does not have a tendency to separate the buckle. Other benefits, advantages, and improvements are also apparent in light of the disclosure herein.

The various buckles discussed herein can be manufactured via a variety of materials including metal, fiberglass, carbon fiber, rubber, wood, polymer, or others or composites or combinations of the same. The parts may also be made via any known process. In one example, the buckle is a polymer manufactured using injection molding of the two members out of a suitably rigidly flexible material similar in composition.

The embodiment of this invention as described is only one of numerous variations. The shape of the plug body, arms, and trestle could be any shape or design so long as the receiving member is complimentary for the two to engage. The embodiment described above and illustrated in the Figs. represent various embodiments, examples, and features of the tension release fastener. A person of ordinary skill in the art understands that there are myriad of arrangements, shapes, sizes and styles that will achieve results, structures, and configurations similar to those described here.

The pieces that make up the buckle could be different sizes to allow for even easier use under specific conditions. For example, variations could be made to allow for easier use with gloved hands. The embodiments shown are of a general purpose shape that balances different applications.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A buckle system configured to be attached to an article that places the buckle in tension when connected, the buckle comprising:

a first engagement member configured to be tensioned in a first direction; and a second engagement member configured to be tensioned in a second direction, wherein the first engagement member is received into the second engagement member on a side of the second engagement member opposite the first direction, wherein the first engagement member and the second engagement member are engaged with one another such that as a tension force is placed on the buckle, the first engagement member is more firmly seated in engagement with the second engagement member; and the first engagement member is a plug member and the second engagement member is a receiving member that receives the plug member into a receiving channel and the receiving channel is defined by a top plate, a base plate and an end stop portion configured to substantially constrain the plug member to linear travel within the receiving member.

2. The buckle of claim 1, wherein the receiving member and the plug member are secured to one another by a detent structure allowing retention by more than just tension.

3. The buckle of claim 1, wherein the receiving member includes an end stop portion that prevents the plug member from being pulled in the first direction through the receiving member.

4. The buckle of claim 1, wherein the receiving channel includes a first side and a second side that are sufficiently separated from one another allowing for a portion of the plug member to extend out of the receiving channel when the plug member and the receiving member are latched or being latched.

5. The buckle of claim 1, wherein the plug member includes a body portion in part defining a ring portion to engage and pull in the first tensioning direction.

6. The buckle of claim 5, wherein the receiving channel includes opposing walls defining a mouth that is narrower than the width of the ring in a relaxed state and wider than the width of the ring portion when the ring is in a tensioned state.

7. The buckle of claim 1, wherein the plug member includes a connection portion on a rear side.

8. The buckle of claim 1, wherein the receiving member includes a connection portion on a bottom side below a base plate.

9. The buckle of claim 1, wherein the first engagement member connection portion is a trestle configured to engage a strap.

10. The buckle of claim 1, wherein the receiving channel includes a first side and a second side having a separation, wherein a portion of the plug member's connection portion extends through the separation between.

11. The buckle of claim 1, wherein the base plate is stepped on lateral sides thereof with an upper portion of the stepped lateral sides forming a portion of the receiving channel and a lower portion of the stepped lateral sides forming a sliding surface for the plug connection portion.

12. The buckle of claim 2, further comprising a locking mechanism that prevents or limits the plug member from being removed from the receiving member without user interaction.

13. The buckle of claim 1, wherein the receiving member is more flexible than the plug member.

14. The buckle of claim 13, wherein the plug member includes protrusions extending out of lateral sides thereof and the receiving channel includes notches on the internal surfaces of the side walls, wherein the notches are suitable to receive the protrusions.

15. The buckle of claim 14, wherein side walls of the receiving member are configured to flexibly separate from one another allowing the protrusions and the notches to engage or disengage securing the plug member and the receiving member together.

16. A buckle system configured to be attached to an article that places the buckle in tension when connected, the buckle comprising:

a first engagement member configured to be tensioned in a first direction; and a second engagement member configured to be tensioned in a second direction, wherein the first engagement member is received into the second engagement member on a side of the second engagement member opposite the first direction, wherein the first engagement member and the second engagement member are engaged with one another such that as a tension force is placed on the buckle, the first engagement member is more firmly seated in engagement with the second engagement member, and the first engagement member is a plug member and the second engagement member is a receiving member that receives the plug member into a receiving channel and the receiving channel includes a first side and a second side having a separation, wherein a portion of the plug member's first connection portion extends through the separation between.

17. The buckle of claim 16, wherein the first engagement member and the second engagement member are engaged with one another such that as a tension force is placed on the buckle, the first engagement member is more firmly seated in engagement with the second engagement member.

18. The buckle of claim 16, wherein the receiving member and the plug member are secured to one another by a detent structure allowing retention by more than just tension.

19. The buckle of claim 18, further comprising a locking mechanism that prevents or limits the plug member from being removed from the receiving member without user interaction.

20. The buckle of claim 16, wherein the receiving member is more flexible than the plug member.

21. A buckle system configured to be attached to an article that places the buckle in tension when connected, the buckle comprising:

a first engagement member configured to be tensioned in a first direction; and a second engagement member configured to be tensioned in a second direction, wherein the first engagement member is received into the second engagement member on a side of the second engagement member opposite the first direction, wherein the first engagement member and the second engagement member are engaged with one another such that as a tension force is placed on the buckle, the first engagement member is more firmly seated in engagement with the second engagement member, the first engagement member is a plug member and the second engagement member is a receiving member that receives the plug member into a receiving channel and the receiving member includes a base plate that is stepped on lateral sides thereof with an upper portion of the stepped lateral sides forming a portion of the receiving channel and a lower portion of the stepped lateral sides forming a sliding surface for the plug connection portion.

22. The buckle of claim 21, wherein the first engagement member and the second engagement member are engaged with one another such that as a tension force is placed on the buckle, the first engagement member is more firmly seated in engagement with the second engagement member.

23. The buckle of claim 21, wherein the receiving channel includes a first side and a second side that are sufficiently separated from one another allowing for a portion of the plug member to extend out of the receiving channel when the plug member and the receiving member are latched or being latched.

24. The buckle of claim 21, wherein the receiving member is more flexible than the plug member.

25. The buckle of claim 12, wherein the locking mechanism is a tab that extends at an angle in the first direction from a base plate on the receiving member and has an end surface that is configured to contact a vertical wall of the plug member when the plug member and the receiving member are engaged.

26. The buckle of claim 25, wherein the tab is resiliently movable such that a finger can press on the tab in order to move the tab below the path of the plug member allowing the plug member to slide clear of the receiving member.

27. The buckle of claim 2, wherein the plug member includes a body portion that extends from a connection portion, the body portion comprising laterally flexible cantilevered arms.

28. The buckle of claim 27, wherein the cantilevered arms have protrusions extending laterally from each.

29. The buckle of claim 28, wherein a cord is connected between the cantilevered arms in a configuration such that as the cord is pulled the arms collapse toward one another.

* * * * *